US010549152B2

(12) United States Patent
Walker

(10) Patent No.: US 10,549,152 B2
(45) Date of Patent: Feb. 4, 2020

(54) ROTATIONAL AND LINEAR RESISTANCE FORCE EXERCISE APPARATUS

(71) Applicant: Aaron Joseph Walker, Albuquerque, NM (US)

(72) Inventor: Aaron Joseph Walker, Albuquerque, NM (US)

( * ) Notice: Subject to any disclaimer, the term of this patent is extended or adjusted under 35 U.S.C. 154(b) by 0 days.

(21) Appl. No.: 15/721,479

(22) Filed: Sep. 29, 2017

(65) Prior Publication Data

US 2018/0361200 A1 Dec. 20, 2018

Related U.S. Application Data

(60) Continuation-in-part of application No. 15/674,403, filed on Aug. 10, 2017, which is a division of (Continued)

(51) Int. Cl.
*A63B 23/12* (2006.01)
*A63B 21/00* (2006.01)
(Continued)

(52) U.S. Cl.
CPC .... *A63B 23/1209* (2013.01); *A63B 21/00069* (2013.01); *A63B 21/0628* (2015.10);
(Continued)

(58) Field of Classification Search
CPC ..... A63B 21/00058; A63B 21/00065; A63B 21/00069; A63B 21/00181; A63B 21/00192; A63B 21/005; A63B 21/0051; A63B 21/008; A63B 21/0083; A63B 21/0085; A63B 21/0087; A63B 21/012; A63B 21/0125; A63B 21/018; A63B 21/02; A63B 21/021; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055;
(Continued)

(56) References Cited

U.S. PATENT DOCUMENTS 4,296,924 A 10/1981 Anzaldua et al.
4,313,603 A 2/1982 Simjian
(Continued)

FOREIGN PATENT DOCUMENTS

WO 2005016464 A1 2/2005
WO 2007139907 A2 12/2007
WO 2011146541 A2 11/2011

OTHER PUBLICATIONS

"Leeway Standing Tummy Twister Heavy Duty with Handle", https://www.amazon.in/Standing-Twister-Exercise-Machine-Fitness/dp/B071S15BDN, 2010.

*Primary Examiner* — Gary D Urbiel Goldner
(74) *Attorney, Agent, or Firm* — Isaac Estrada; Philip D. Askenazy; Peacock Law P.C.

(57) ABSTRACT

An exercise apparatus with an adjustable rotating element around which a force transferring material wraps either clockwise or counterclockwise to provide bidirectional rotational resistance for exercising. The force transferring material is preferably guided to remain in close proximity to the rotating element while wrapping around the rotating element.

21 Claims, 52 Drawing Sheets

Related U.S. Application Data application No. 14/672,030, filed on Mar. 27, 2015, now abandoned.

(51) Int. Cl.

| | |
|---|---|
| ***A63B 21/062*** | (2006.01) |
| ***A63B 23/14*** | (2006.01) |
| ***A63B 23/00*** | (2006.01) |
| ***A63B 23/04*** | (2006.01) |
| ***A63B 23/035*** | (2006.01) |
| ***A63B 23/02*** | (2006.01) |
| ***A63B 21/055*** | (2006.01) |
| ***A63B 21/02*** | (2006.01) |
| ***A63B 21/012*** | (2006.01) |
| ***A63B 21/008*** | (2006.01) |
| ***A63B 21/005*** | (2006.01) |

(52) U.S. Cl.

CPC ..... *A63B 21/4034* (2015.10); *A63B 21/4035* (2015.10); *A63B 21/4047* (2015.10); *A63B 23/14* (2013.01); *A63B 21/005* (2013.01); *A63B 21/008* (2013.01); *A63B 21/0051* (2013.01); *A63B 21/0085* (2013.01); *A63B 21/00181* (2013.01); *A63B 21/00192* (2013.01); *A63B 21/012* (2013.01); *A63B 21/023* (2013.01); *A63B 21/0552* (2013.01); *A63B 21/155* (2013.01); *A63B 21/156* (2013.01); *A63B 23/0238* (2013.01); *A63B 23/03525* (2013.01); *A63B 23/0405* (2013.01); *A63B 23/0482* (2013.01); *A63B 2023/003* (2013.01); *A63B 2208/0204* (2013.01); *A63B 2208/0233* (2013.01); *A63B 2225/093* (2013.01)

(58) Field of Classification Search

CPC ..... A63B 21/0552; A63B 21/0555; A63B 21/0557; A63B 21/06; A63B 21/0608; A63B 21/0609; A63B 21/0618; A63B 21/062; A63B 21/0622; A63B 21/0624; A63B 21/0626; A63B 21/0628; A63B 21/063; A63B 21/0632; A63B 21/08; A63B 21/15; A63B 21/151; A63B 21/152; A63B 21/153; A63B 21/154; A63B 21/155; A63B 21/156; A63B 21/16; A63B 21/22; A63B 21/222; A63B 21/225; A63B 21/227; A63B 21/4003; A63B 21/4005; A63B 21/4011; A63B 21/4017; A63B 21/4019; A63B 21/4027; A63B 21/4033; A63B 21/4034; A63B 21/4035; A63B 21/4039; A63B 21/4045; A63B 21/4047; A63B 21/4049; A63B 2023/003; A63B 23/0238; A63B 23/03525; A63B 23/04; A63B 23/0405; A63B 23/0482; A63B 23/0494; A63B 23/12; A63B 23/1209; A63B 23/1245; A63B 23/1281; A63B 23/14; A63B 2208/0204; A63B 2208/0233; A63B 2225/09; A63B 2225/093

See application file for complete search history.

(56) References Cited

U.S. PATENT DOCUMENTS

| | | | | |
|---|---|---|---|---|
| 4,373,717 | A | 2/1983 | Lambert, Jr. | |
| 4,390,180 | A | 6/1983 | Simjian | |
| 4,391,441 | A | 7/1983 | Simjian | |
| 4,478,413 | A | 10/1984 | Siwula | |
| 4,515,363 | A | 5/1985 | Schleffendorf | |
| 4,602,618 | A | 7/1986 | Berze | |
| 4,673,180 | A | 6/1987 | Rice | |
| 4,878,663 | A | 11/1989 | Luquette | |
| 4,893,808 | A | 1/1990 | McIntyre et al. | |
| 4,988,098 | A | 1/1991 | Miller | |
| 5,067,708 | A | 11/1991 | Oschansky et al. | |
| 5,118,098 | A | 6/1992 | Jones | |
| 5,152,733 | A | 10/1992 | Farenholtz et al. | |
| 5,284,464 | A | 2/1994 | Lee, III et al. | |
| 5,336,138 | A | 8/1994 | Arjawat | |
| 5,344,374 | A | 9/1994 | Telle | |
| 5,399,140 | A | 3/1995 | Klippel | |
| 5,599,262 | A | 2/1997 | Shih | |
| 5,709,637 | A | 1/1998 | Gow et al. | |
| 5,718,654 | A | 2/1998 | Kennedy | |
| 5,776,039 | A * | 7/1998 | Perez, Jr. ..... | A63B 21/055 482/121 |
| 5,788,607 | A | 8/1998 | Baker | |
| 5,888,182 | A | 3/1999 | Shih | |
| 6,106,437 | A | 8/2000 | Brooks | |
| 6,261,212 | B1 | 7/2001 | Vallone et al. | |
| 6,283,899 | B1 | 9/2001 | Charnitski | |
| 6,875,159 | B2 | 4/2005 | Chuang | |
| 7,081,074 | B1 | 7/2006 | Rubin | |
| 7,137,928 | B1 | 11/2006 | Chen | |
| 7,150,682 | B2 * | 12/2006 | Varner ..... | A63B 21/02 473/257 |
| 7,604,576 | B2 | 10/2009 | Drechsler | |
| 7,621,861 | B1 | 11/2009 | Kalember et al. | |
| 7,625,318 | B1 | 12/2009 | Heyn | |
| 7,628,736 | B2 | 12/2009 | Vandyke | |
| 7,909,747 | B1 | 3/2011 | Lacaze | |
| 7,927,262 | B2 | 4/2011 | Clark | |
| 7,951,054 | B2 | 5/2011 | Snow et al. | |
| 3,047,973 | A1 | 11/2011 | Berenshteyn | |
| 8,834,328 | B1 * | 9/2014 | Batca ..... | A63B 21/00043 482/100 |
| 2002/0151417 | A1 | 10/2002 | List | |
| 2004/0097337 | A1 | 5/2004 | Chuang | |
| 2005/0043143 | A1 | 2/2005 | Chuang | |
| 2005/0227827 | A1 | 10/2005 | Liester | |
| 2006/0040799 | A1 | 2/2006 | Pompile | |
| 2006/0252614 | A1 | 11/2006 | Rotondale et al. | |
| 2007/0161472 | A1 | 7/2007 | Drechsler | |
| 2008/0004164 | A1 | 1/2008 | Alsip | |
| 2008/0058182 | A1 | 3/2008 | Pompile | |
| 2008/0176722 | A1 | 7/2008 | Steffee | |
| 2009/0163337 | A1 | 6/2009 | Petrakov | |
| 2010/0317497 | A1 | 12/2010 | Nadim | |
| 2011/0111925 | A1 | 5/2011 | Hobson et al. | |
| 2011/0118096 | A1 | 5/2011 | Nadim | |
| 2011/0237407 | A1 * | 9/2011 | Kaleal ..... | A63B 21/025 482/114 |
| 2011/0287914 | A1 | 11/2011 | Morris | |
| 2012/0322624 | A1 | 12/2012 | Wu | |
| 2014/0087923 | A1 | 3/2014 | Warren | |
| 2014/0121063 | A1 | 5/2014 | Wireman | |
| 2014/0194260 | A1 | 7/2014 | Campanaro et al. | |
| 2014/0336006 | A1 | 11/2014 | Miller | |
| 2015/0297932 | A1 | 10/2015 | Wehrell | |
| 2016/0279459 | A1 * | 9/2016 | Walker ..... | A63B 21/4047 |
| 2017/0340918 | A1 * | 11/2017 | Walker ..... | A63B 21/4047 |

* cited by examiner

ROTATIONAL AND LINEAR RESISTANCE FORCE EXERCISE APPARATUS

CROSS-REFERENCE TO RELATED APPLICATIONS

This application is a Continuation-in-part of U.S. patent application Ser. No. 15/674,403, filed on Aug. 10, 2017, entitled "Rotational and Linear Resistance Force Exercise Apparatus", which is a divisional application of U.S. patent application Ser. No. 14/672,030, filed Mar. 27, 2015, entitled "Rotational and Linear Resistance Force Exercise Apparatus", the specifications and claims of which are incorporated herein by reference.

BACKGROUND OF THE INVENTION

Field of the Invention (Technical Field)

The present invention relates generally to exercise devices, and more particularly to body exercise equipment that utilizes a resistance force to provide the user with rotational as well as linear force to exercise.

Description of Related Art

Athletes, as well as physical therapists, have understood the need to strengthen, increase range of motion, and improve proprioception of the various parts of the body. Most commonly, fitness devices provide the user with an opportunity to extend and/or retract their limbs and/or torso, while acting against some kind of resistance force provided by an exercise apparatus. This is referred to as flexion and extension of the muscles. Rotational strengthening of various parts of the body provides a unique method of strengthening the body, as opposed to flexion and extension. Rotational strengthening involves supination and pronation of the limbs, in whole or in part, as well as left and right rotation of the neck, spine, or both. It is currently difficult to exercise the body in a rotational fashion because current inventions provide the user with an opposing linear force, rather than an opposing rotational force against which to interact their muscles. There are several muscles, and groups of muscles which benefit directly from rotational strengthening. While some currently available devices utilize rotational force for exercising, these systems lack in the ability to select the range of motion, and do not allow the user to attach several different unique attachments. There is a current need for a device which allows the user to gain strength by working against a restrictive force, in a rotational fashion, with multiple parts of their body. Furthermore, exercise equipment users are often limited in area to accommodate exercise equipment, therefore exercise apparatuses should ideally take up a small amount of space while providing many functions.

Embodiments of the present invention preferably allow the user to adjust the range of rotation that an exercise apparatus will encompass relative to the user. This allows users to strengthen their muscles more completely, and increase range of motion. Embodiments of the present invention preferably allow users to adjust the height of an attachment point for various attachments. This allows people of differing heights to utilize the same machine after adjusting it to their height. Embodiments of the present invention allow the user to rotate the attachment point in a plane that is perpendicular to the plane of the force rotation of the attachment point, resulting in a downward, sideward, and upward plane for connecting the various attachments. Embodiments of the present invention allow the users to supinate, pronate, rotate, and/or twist the hand, wrist, forearm, elbow, upper arm, shoulder, neck, spine, lumbar, hip, upper leg, knee, lower leg, ankle, and/or foot, utilizing attachments, or no attachments while working that same motion against resistance force as low as zero pounds of force, in a bidirectional fashion. In addition, embodiments of the present invention provide versatile equipment that uses little space.

Other embodiments of the present invention contain the resistance source, and mechanisms which translate the resistance source to the end user, within a housing. The housing being of a size and weight which can be transported by one person. The housing furthermore having the ability to be secured to a rigid structure commonly found within a home, such as a door frame, or countertop. The housing could optionally be mounted to a framework which holds the housing steady in space as a person exercises against the resistance. With the housing held stationary in space, the resistance force output can be manipulated without the entire housing moving. In one embodiment, a person can install an attachment onto the resistance force output. With the housing secured to a stationary object, and an attachment secured to the resistance force output, a person can then exercise in a rotational fashion against the rotational resistance. This type of relatively small, portable device applies to end users who have very limited space, and a very limited budget for such a device.

In one embodiment, a portable device, which offers rotational resistance to multiple attachments, can be mounted to a framework which can orient such a device in space at a variety of heights, as well as a variety of angles such as pointing the resistance force output towards the ground, or towards the sky, or towards an adjacent wall, or any point in between these points. A rotational exercise apparatus held within a housing, can gain resistance from multiple sources such as, but not limited to, a spring, a torsion spring, a flexible material, an electric motor, friction, pneumatics, or hydraulics. The resistance could be translated from the resistance source to the resistance force output by, for example, but not limited to, a cable, a rope, a flexible material, a direct attachment, or similar means, combinations thereof and the like. Many different attachments can be secured to such a portable device comprising a housing. Potential attachments include, but are not limited to, grips for the hand, platforms for the feet, clamps for the head, or other pads or handles which the user presses parts of their bodies against for exercising against the resistance provided by the apparatus. Certain embodiments of the portable rotational resistance exercise device have the resistance source output translate the linear force of the resistance source by means of a wheel. The wheel can offer rotational resistance in one direction or in two directions. The wheel can be configured in a number of ways. One embodiment of the wheel has a cable attached to the wheel, and when the wheel is turned by the attachment of the user's choice, the cable is wrapped around the wheel. The winding up of the cable causes a pull on the opposite end of the cable, the opposite end of the cable being attached to a resistance source.

A multi-function bidirectional rotational resistance force exercise apparatus can consume a large area while in use, as well as when it is stored while not in use. It is advantageous to have parts which move into a position for a smaller storage area of the unit as a whole. There is a need for a multi-function bidirectional rotational resistance force exercise apparatus which converts to a smaller storage size easily without many conversion steps. Current apparatuses require the user to disengage the locks on the resistance source, or weight stack, before being able to manipulate parts of the machine into storage settings. Embodiments of the present invention do not require the user to disengage the resistance source before folding a bidirectional rotational resistance force exercise apparatus into a storage position, thus saving time and effort. In one embodiment, the main arm of the apparatus can fold up or down to allow for multiple exercise positions, as well as allow for small storage place. Folding the arm without disconnecting the resistance source allows for the apparatus to be used in the folded positions, as well requiring one less step to perform when folding it for storage. Embodiments of the present invention allow for the vertical adjustment of the exercise apparatus to reach the lowest level of the frame, and/or reach the lowest level of floor.

A multi-function bidirectional rotational resistance force exercise apparatus can be oriented in such a way that a user may want to stand on a stationary platform while exercising. In order to keep such a platform from moving while exercising, it is advantageous to have such a stationary platform connectable to the apparatus. Connecting the platform to the apparatus causes it to be rigid and safer for the user. In one embodiment of the present invention, the stationary platform is adjustable in height. In another embodiment of the present invention, the stationary platform has rollers incorporated within it.

A multi-function bidirectional rotational resistance force exercise apparatus can be built to be a very sturdy piece of equipment. With the apparatus being sturdy enough to support the weight of a person, a user could place their body weight upon the apparatus in a number of ways. One of those ways to have the apparatus support the user's weight is to allow them to hang their weight on the apparatus by use of ropes, chains, cables, bands, straps, etc. Providing a location on the apparatus which is to be used for attaching ropes, chains, cables, bands, straps, etc., would be an added benefit for the end user. These training ropes, chains, cables, bands, straps, etc., are typically made of a suitable material such as cloth, metal, or polymer, etc., and require a smooth surface to mount them so as to not cause a tear in the material. In one embodiment, the user can then pull on the straps which are attached to an embodiment of a multi-function bidirectional rotational resistance force exercise apparatus in a way which does not damage the straps, but allows for the user to rely on the apparatus for securing the straps. Not just any location on the machine could be used for such attachment. A designated location and attachment feature are preferably provided to properly secure the items in a way which will not damage them, nor cause the apparatus to lose balance. Arbitrarily securing items to the apparatus for the purpose of suspending your body weight from the items could cause injury by having the apparatus tip over onto the user, or by causing the item to break because the securing point was not designed for such use. Designating a location for such attachment of items from which to hang body weight is a task for a trained professional to determine, design, test, and authorize. In one embodiment, the arm of the bidirectional rotational resistance force exercise apparatus has a feature incorporated upon it which is suitable for securing items from which a person could suspend their body weight. In another embodiment, the frame has a feature incorporated upon it which is suitable for securing items from which a person could suspend their body weight.

A multi-function bidirectional rotational resistance force exercise apparatus can be a stable enough piece of equipment that a user could use it for exercises such as pull-ups, or dips, if the apparatus had features which provided a handling location for such exercises. An articulating safety handle is necessary for this type of operation of such an apparatus. Designing the articulating safety handle in such a way that it provides a stable surface which can support the weight of the user in multiple positions will accomplish the tasks of pull-ups, dips, and standard safety performance. The articulating safety handle could also be used for a location a person could hold onto for stability while exercising. Such a location is preferably adjustable for varying heights of users, as well as being strong enough to support their weight in case they need to rely on the handle to prevent a fall. Embodiments of the articulating safety handle allow for the handle length to be extended or retracted.

A multi-function bidirectional rotational resistance force exercise apparatus may offer only one direction of rotational exercise. In one embodiment, a multi-function bidirectional resistance force exercise apparatus offers resistance in only the clockwise, or only the counterclockwise, direction.

A multi-function bidirectional rotational resistance force exercise apparatus may translate the linear force from the resistance source to the attachment of choice by different means. One embodiment comprises a wheel upon which the user attaches an attachment, and wraps up a cable which is connected to a resistance source. In another embodiment, the wheel, with an attachment attached to it, turns an electric motor which resists the user's exercise force in a rotational fashion. In yet another embodiment, the wheel is attached to a friction material that resists the user's rotational exercise force. In another embodiment, the user exercises against a rotational resistance source that is built in similar fashion to prior art. In another embodiment, a multi-function bidirectional rotational resistance force exercise apparatus changes the linear force of the elongation of a flexible material, into a rotational force by means of wrapping the flexible material around a wheel. In another embodiment, the rotational resistance is supplied by means of a force transferring material passing through a series of wheels and pulleys in order to translate linear force into rotational force.

Persons utilizing exercise equipment have a need for equipment that provides rotational resistance to press against. Some persons need the equipment to be simple for a person to use. Equipment that perform fewer functions is desirable for some facilities because it will be easier for their users to figure out how to operate the piece of equipment. A rotational resistance exercise apparatus can be constructed in a way such that the attachments that the user presses against are not interchangeable. In one embodiment, a rotational resistance source is movable positioned on a vertical frame. In another embodiment, a rotational resistance source is movable located on a frame which is not vertical.

A grip twist rotational resistance exercise apparatus provides a rotational resistance source for a person to strengthen their body against rotational resistance in either a clockwise, or counterclockwise direction, or both. In one embodiment, the axis of rotation of the rotational resistance is directed in a horizontal plane. When a person grips the handle and pronates or supinates their arm, the rotational resistance will resist their effort, and this resistance offers an exercise benefit to the user. In one embodiment, the position of the handle that a user grasps and rotates for exercise is set to a starting position. To choose a starting position, a user disconnects the grip from the resistance source, rotates it to a new position, then reconnects it to the resistance source prior to exercise. The resistance source can be chosen from for example, weight plates, spring, flexible material, electric motor, friction, pneumatic, hydraulic or other resistance source.

In one embodiment, a grip twist rotational resistance exercise apparatus adjusts vertically in height, has a standing platform that adjusts vertically in height, or both, which allows for users of differing height to use the same apparatus. The rotational resistance force output could be designed in a number of ways including, for example, a wheel drawing up a cable, or a wheel wrapping up a flexible material. In one embodiment, a grip a user grasps is directly perpendicular to the axis of rotation of the rotational resistance, or it can be off set. Placing the grip, which a user grasps, on an axis which does not intersect with the axis of rotation of the rotational resistance offers the opportunity to have the rotational resistance directed, for instance, down the center of the user's unbent wrist while they grasp the grip. This direction of orientation is beneficial for superior ergonomics of exercise. In one embodiment, the handle connected to the rotational resistance is a flat surface. In another embodiment, the handle connected to the rotational resistance is in the shape of a sphere.

Exercise equipment users have a need for equipment that offers rotational resistance for the spine, hips, knees, ankles, and feet. Standing on a platform that is attached to a rotational resistance source, while grasping a stationary object with other parts of their body, allows a person to rotate the platform for exercise. In one embodiment, the standing platform attachment is connected to a rotational resistance source. The user engages certain muscles in order to rotate the standing platform they are standing on. The rotational resistance works against the person causing them to gain an exercise benefit. A person can stand on the platform with one foot, while standing on a nearby stationary platform with their other foot. The user would then rotate their one leg against the rotational resistance for exercise, while the leg standing on the stationary platform offers stability. In one embodiment, a stationary handle is nearby for the user to grasp for stationary stability. In one embodiment, the rotational resistance is offered by an electric motor. In another embodiment, the rotational resistance is provided by a curved shaped material which is connected to a resistance source such as a spring with a cable, the cable being wound up by the curved shaped material that is being turned by the standing platform, which is turned by the user's effort. In one embodiment, the standing platform itself has the resistance source connected directly to its periphery. In one embodiment, the standing platform is generally flat. In another embodiment, the standing platform has at least one surface that is free to spin independently from the rotational resistance source.

A person's hip joint can move in many directions. Flexion, extension, abduction, adduction, internal rotation, external rotation, and circumduction. The neck of the femur bone sits at approximately 120-135 degrees inclination relative to the femur bone in a normal adult, and at very different degrees of inclination in abnormal persons. Exercising the hip joint in a flexion or extension pattern is a common activity. Most common positions for such exercises are done with a person standing straight up, while lifting their knee upwards towards the chest, or pressing their knee back down from their chest to a standing position. Lifting the knee proximally and laterally simultaneously, as well as the converse motion, helps keep the femur head within its socket. Keeping the femur head within its socket can be beneficial to the person performing the exercise. An exercise apparatus that offers rotational resistance to a user in a direction that allows their femur head to stay within its socket while performing exercise offers benefit to the user. The exercise apparatus would be more useful to many persons if it can accommodate users of differing height, and/or strength. In one embodiment, the center of rotation of the rotational resistance is at an angle coincident with the user's femur neck. One embodiment provides an adjustable standing platform for a person to stand upon, the platform being adjustable in height. One embodiment provides a platform for a person to lay upon while performing exercise.

A person's leg can move in an internal and external rotation pattern. Moving the leg in an internal or external rotational pattern against resistance can be beneficial to a user. A rotational resistance exercise apparatus that provides resistance for a person to exercise against in the pattern of internal and/or external rotation of the leg is useful in strengthening the user's body. In order to focus the exercise effort more onto the muscles near the hip, as opposed to muscles near the ankle, in the motion of internal and external rotation of the leg, a person's leg could be in a flexion position while internally or externally rotating their leg. One embodiment of the present invention provides rotational resistance to a person whose leg is in a flexion position while internally or externally rotating. Other embodiments of the present invention have the ability to accommodate persons of differing heights by extending the exercise surface which the person presses upon closer to the person's body, and/or by changing the altitude of the surface upon which they are standing. In one embodiment the user can place the axis of rotation of their femur closely to coincidental to the axis of rotation of the rotational resistance, then rotate their femur around its axis of rotation for exercise against the resistance.

A person's shoulder joint is very complex. Exercising the shoulder joint against resistance can be done in a variety of ways. When a person performs the motion of flexion, extension, abduction, or adduction of the shoulder, a circular motion of the arm, hinging at the shoulder joint is performed. A rotational resistance exercise apparatus that provides the user a surface to press upon with a part of their upper limb will give the user the opportunity to perform resistance exercise in a rotational pattern. The circular motion would be best resisted by an apparatus that provides rotational resistance, as opposed to linear resistance. One embodiment of the present invention preferably allows a user to press their forearm against a pad while performing shoulder flexion, extension, abduction, or adduction motions. Another embodiment of the present invention adjusts to accommodate persons of differing heights. Another embodiment of the present invention directs the axis of rotation of the rotational resistance at an angle that is preferable to exercise muscles against rotational resistance. Another embodiment of the present invention allows the user to grasp a handle with one and/or two hands while exercising against rotational resistance. The handle of one embodiment of the present invention rotates independently of the rotational resistance offered by the apparatus. In one embodiment, the starting and/or stopping position of the rotational resistance can be adjusted.

Performing a motion similar to stirring a pot of substance with a tool, has been a desirable motion to perform for exercise. Performing motions against resistance is beneficial for a person's body. The present invention embodies a rotational resistance exercise apparatus that provides rotational resistance to a person who is moving their body in a motion similar to that of stirring a pot. One embodiment of the present invention has a handle a person grasps with their hand. The handle is then moved in a circular motion by the person's body, while the apparatus provides rotational resistance to the person's effort. In one embodiment, the handle is free to rotate on its own axis, which is independent of the axis of rotation of the rotational resistance of the apparatus. In one embodiment, the apparatus adjusts in order to accommodate users of differing heights. In another embodiment, the handle that the user grasps with their hand is adjustable in position relative to the axis of rotation of the rotational resistance. The handle could be positioned further away from or nearer to the axis of rotation of the rotational resistance. In one embodiment, the handle is oriented perpendicular to the axis of the rotational resistance. In one embodiment, the axis of rotation of the rotational resistance is parallel to the axis of rotation of the grip. In another embodiment, the grip has an axis of rotation that is not parallel nor perpendicular with the axis of rotation of the rotational resistance.

Rotating the body against rotational resistance from a standing position can help a user gain strength. An exercise apparatus that provides rotational resistance which a person can exercise against while rotating their spine to the left and/or to the right would be beneficial to the user. Embodiments of the present invention provide a handle that a user can press against with their body while exercising their spine in a rotational motion. Embodiments of the present invention adjust for users of differing heights. In addition, embodiments of the present invention position the axis of rotation of the rotational resistance in a vertical position. Other embodiments of the present invention have the axis of rotation of the rotational resistance in a non-vertical position. Embodiments of the present invention have the option to position the handle in a variety of distances from the axis of rotation of the rotational resistance. With the axis of rotation of the rotational resistance being in a position that is non-vertical, a person's spine would be allowed to combine rotational motion with a flexion motion resulting in a different exercise benefit.

The shoulder rotator cuff has long been an area of weakness and injury for the human body. Rotational resistance offers a more beneficial resistance source to exercise the rotator cuff against than linear resistance. Having the ability to supinate or pronate your hand independently while performing internal and external rotations of the shoulder provides a more complete exercise. In one embodiment, a grip is free to spin on an axis that is perpendicular from the grip. In another embodiment, the grip is adjustable in distance from the axis of the rotational resistance to accommodate different users' arm lengths. In another embodiment, the height of the rotational resistance is adjustable. In another embodiment, the platform a user stands on is adjustable for people of different heights.

A rotational exercise apparatus has an axis of rotation of the resistance. In order for a user to rotate rotational resistance, they need a surface upon which to press a part of their body. In one embodiment, the surface that receives the pressure from the user is a cylindrical shaped surface that has an axis of rotation. The axis of rotation of the cylindrical shaped surface, and the axis of rotation of the rotational resistance can be parallel. In one embodiment, the axis of rotation of the cylindrical surface a person presses against for exercise, and the axis of the rotational resistance are adjustable in distance from one another.

A rotational resistance exercise apparatus resists the rotation of a person's head. A person's head has an axis of rotation about which the head can turn left and right. In one embodiment of the present invention, a person's rotation of their head is translated to interact against the rotational resistance of the rotational exercise apparatus by means of a head attachment. In one embodiment, the head attachment secures against the exterior of a person's head, while also being secured to the rotational resistance of the rotational exercise apparatus. In one embodiment, the head attachment is adjustable to fit different sizes of heads.

Circumduction of a person's arm is accomplished by moving a straight or bent arm in a circular motion. Resistance to circumduction motion will enhance a person's strength in their body. The present invention of a rotational resistance exercise apparatus for circumduction offers rotational resistance to the circular motion of circumduction. In one embodiment, a flexible rope is attached to a member that is attached to the rotational resistance offered by the apparatus. Moving the rope in a circular pattern causes the member to move against the resistance of the apparatus, thus giving the person exercise. In another embodiment, the distance from the handle a person is holding, which is attached to the member, which is attached to the rotational resistance, is adjustable in distance from the axis of rotation of the rotational resistance. In another embodiment, the elevation of the axis of rotational resistance is adjustable in elevation to accommodate users of different heights. In yet another embodiment, the platform a user stands upon is adjustable in height. In one embodiment, the axis of rotation of the rotational resistance is horizontally oriented.

Resistance training of leg circumduction is best performed against rotational resistance. The circular path a person's leg follows when performing circumduction is best exercised against resistance that follows the same general path. In one embodiment of the current invention, a person places one foot upon a surface, and the surface is connected to a rotational resistance source in such a way that when the surface is moved in a circular path, the rotational resistance source counteracts the user's efforts in a rotational direction. In one embodiment, the rotational resistance apparatus has a platform a user can place their other foot that is not performing the circumduction exercise. In another embodiment, the surface a user places their foot upon is free to spin independent of the rotational resistance.

The swinging of a golf club follows a mostly circular path. Exercising a golf swing against rotational resistance would be beneficial to strengthening the body. In one embodiment of the present invention, a person interacts against the rotational resistance exercise apparatus by moving the rotational resistance around a circular path while holding and moving a handle in the similar motion of swinging a golf club. In one embodiment, the axis of rotation of the rotational resistance is directed in generally the same direction as a person's spine axis of rotation while swinging a golf club. In one embodiment, the handle a person holds is partially cylindrical handle. In another embodiment, the partially cylindrical handle is attached to a rope. In yet another embodiment the rope is attached to an arm that is attached to the rotational resistance. In one embodiment, the distance from the rope attachment point and the axis of rotation of the rotational resistance is adjustable. In one embodiment, the altitude of the axis of rotation of the rotational resistance is adjustable. In another embodiment, the surface upon which a user stands is adjustable in altitude.

A generic handle can be attached to a rotational resistance exercise apparatus for accommodating exercise motions of a person. In one embodiment, a rotational resistance exercise apparatus has an attachment extension extending from the rotational resistance in a direction perpendicular to the axis of rotation. The attachment extension optionally has a bend in it. Upon the attachment extension, a person optionally attaches a generic attaching point attachment. In one embodiment, the attachment of a handle is accomplished by securing a carabiner onto the generic attaching point attachment. A person optionally secures a handle of choice onto the carabiner. When rotating the attachment extension by means of attached handle, a person gains exercise by working against the rotational resistance provided by the apparatus. In yet another embodiment, the arm that is attached to the rotational resistance extends in the direction of the axis of rotation of the rotational resistance. The extension of the arm allows the user more distance from the moving parts of the apparatus. In one embodiment the distance from the end of the arm, and the axis of rotational resistance is adjustable.

A person's foot moves in a circular path when riding a bicycle. Bicycles offer resistance in one direction only. A person does not get the benefit of eccentric loading of their leg muscles when riding a bicycle. A rotational resistance exercise apparatus has the potential to offer eccentric loading of the muscles when a person's leg or arm is performing generally the same motion as that of rotating a common bicycle crank. In one embodiment, a rotational resistance exercise apparatus has one or more arms attached to the rotational resistance in a position perpendicular, or approximately perpendicular to the axis of rotation of the rotational resistance. In one embodiment, a bicycle pedal or a handle is attached upon the arm or arms. A person can press upon the bicycle pedal with their foot or hand in order to rotate their foot or hand against the rotational resistance of the exercise apparatus. In one embodiment, the rotational resistance is provided by a cable attached to the rotational resistance on one end and to linear resistance on the other end, such as a weight stack. In another embodiment, the arm has multiple positions the pedal or handle could be placed. In one embodiment, the axis of rotation of the rotational resistance is horizontal. In another embodiment, the arm has threaded holes.

Multi-function rotational resistance exercise apparatuses, rotational resistance apparatuses within a housing, and rotational resistance exercise apparatuses can have attachments that are attached to them. These attachments are the surface upon which a person presses for exercise of their body. In one embodiment, an attachment is for the exercising of the supination and pronation of the hand. In another embodiment, an attachment provides a location or a series of locations for attaching yet another attachment. Another embodiment of the invention comprises an attachment that is a grip that is optionally able to spin freely upon an axis of rotation that is perpendicular to the axis of rotation of the rotational resistance of the apparatus. Another embodiment is an attachment to a rotational resistance exercise apparatus that is a grip which is optionally free to spin on an axis, which is parallel to the axis of rotation of the rotational resistance. Embodiments of the present invention allow the user to attach a pad to a rotational resistance exercise apparatus that is optionally free to spin on an axis which is parallel to the axis or rotation of the rotational resistance. Embodiments of the present invention allow the user to attach a dome to a rotational resistance exercise apparatus that is optionally free to spin on an axis which is parallel to the axis of rotation of the rotational resistance. Embodiments of the present invention allow the user to attach a shaped surface to a rotational resistance exercise apparatus which is optionally free to spin on an axis that is parallel to the axis of rotation of the rotational resistance. Embodiments of the present invention allow the user to attach a knob to a rotational resistance exercise apparatus that is optionally free to spin on an axis which is parallel to the axis of rotation of the rotational resistance. Embodiments of the present invention comprise a grip, pad, dome, knob, or concave dish attachment which is free to spin on an axis of rotation which is parallel, perpendicular, or any other angle in relation to the axis of rotation of the rotational resistance.

Embodiments of the present invention comprise a rotational resistance assembly which is rotational resistance. Embodiments of the present invention allow the user to attach an articulating joint to a rotational resistance exercise apparatus which is optionally free to spin on an axis which is parallel to the axis of rotation of the rotational resistance. An attachment for a rotational resistance exercise apparatus embodies a device which secures onto a person's head such that when a person rotates their head, the device is rotated, and optionally when the device is rotated and attached to a rotational resistance exercise apparatus, the person can rotate their head against the resistance provided by the apparatus.

Embodiments of the present invention comprise a knee cradle. The knee cradle optionally provides a surface upon which a person can rest their flexed leg upon. Optionally the knee cradle is attached to the rotational resistance provided by an exercise apparatus. In one embodiment, the axis of rotation of the exercise apparatus is aligned nearly to the axis of rotation of a person's femur. Embodiments of the present invention allow for a general attaching point to have a plurality of constructions including a location to secure a carabiner, a hook, a peg, a ring, etc. Embodiments of the present invention have the general attaching point adjustable in distance from the attachment extension.

Embodiments of the present invention provide a user with the ability to perform the motion of pedaling a bicycle with one or two legs or arms against rotational resistance of an exercise apparatus. The rotational resistance of the exercise apparatus counteracts the rotational force generated by a user. Embodiments of the invention provide multiple locations which a person could attach a pedal or grip to a crank or arm that is attached to the rotational resistance. In one embodiment, the rotational resistance is derived from a weight stack, connectable by a cable.

Throwing a ball with a person's arm generally is done by the person moving their arm in a mostly circular path. Exercising a person's body in a similar motion to that of throwing a ball is beneficial to the body. In one embodiment of the invention, a ball has a strap attached to it, and optionally the other end of the strap is attached to an armature that is attached to a rotational resistance exercise apparatus. In another embodiment, the distance from the ball and the axis of rotation of the rotational resistance exercise apparatus is adjustable. In another embodiment, a shaft shaped handle is used in place of the ball. In another embodiment, the axis of rotation of the rotational resistance exercise apparatus is adjustable in direction it is pointed towards.

Embodiments of the present invention allow the user to stand on an attachment which is a surface that is connected to the rotational resistance. When a person rotates their body, the surface they are standing on will resist their body's rotation.

Embodiments of the invention comprise an attachment extension that serves as an intermediary between the rotational resistance, and an attachment of choice. In one embodiment, the attachment extension accommodates an attachment extension counterweight. In another embodiment, a rotation resistance interface is coupled to the rotational resistance and allows for the attaching of other attachments. In one embodiment, the attachment extension and the attachment is permanently mounted. In another embodiment, the attachment extension is permanently mounted to the rotational resistance source.

In one embodiment of the present invention, an attachment to a rotational resistance exercise apparatus is shaped like a wheel. The attachment preferably has an axis of rotation. When the attachment's axis of rotation is placed coincidental with and secured to the axis of rotation of the rotational resistance exercise apparatus, a person can exercise against the resistance of the apparatus by turning the wheel. In one embodiment, the wheel height can be adjusted in altitude. In another embodiment, the axis of rotation of the exercise apparatus can be adjusted.

Embodiments of the present invention provide for the axis of rotation of the rotational resistance to be held at an angle which is vertical, horizontal, or any angle in between vertical and horizontal.

Embodiments of the invention allow for a carriage that has a rotational resistance rotatable mounted upon a carriage, wherein the carriage is movable along the frame, and the frame is set at an angle of choice.

Embodiments of the present invention have a platform which a user stands upon, and the platform is adjustable in height.

Embodiments of the present invention comprise a paddle rotation attachment which a person can press against with their body for exercise.

Embodiments of the present invention comprise an attachment permanently mounted to an attachment extension. Embodiments of the present invention comprise an attachment extension permanently mounted to the rotational resistance.

Therapists, trainers, and end users have a need for an attachment for a rotational resistance device that has a perpendicular free spinning grip, and whose center of rotation is perpendicular to the center of rotation of the rotational resistance. This perpendicular free spinning grip will allow the user's wrist to rotate freely, and independently from the rotational resistance offered by the device. This will allow for greater muscle activation.

A parallel free spin grip attachment is designed for a multi-function rotational resistance exercise apparatus which is free to spin on an axis which is independent from the axis of rotation of the rotational resistance. The attachment preferably has an axle positioned with axis of rotation directed in the same direction, though not coincidental, with the resistance source axis of rotation. In one embodiment, a post is covered in a pad, grip, bearing, or a flat or domed shaped plate. The covering over the post will provide comfort, safety, and a surface upon which the user can exert exercising force against the apparatus. Between the pad, grip, plate, or dome and the post, it would be beneficial to have a type of bearing, or surface which allows the pad, grip, plate or dome to spin freely around the tangent of the post. Such parallel free spinning of the grip, plate, pad, or dome allows the user to have a much more dynamic exercise as compared to a post which does not spin freely.

BRIEF SUMMARY OF THE INVENTION

Embodiments of the present invention comprise an exercise apparatus comprising a comprises a housing securable to a stationary framework. The housing comprising a rotating element. The rotating element being a feature upon which a person can install an exercise attachment. The rotating element being connected to a force transferring material. The force transferring material being connected to a resistance source. The level of resistance being either adjustable, or non-adjustable.

One embodiment comprises a housing which holds a spring that is attached to a tension adjustment feature at one end and attached to a cable at the other end, the cable being attached to a rotating element, and the rotating element being connectable to a variety of attachments that a person can exert force upon.

Another embodiment comprises a housing which contains a torsion spring. The torsion spring being connected to the housing at one end, and connected to a resistance force output at the other end. The resistance force output being a location which a user can connect a choice of attachment to perform exercise against the rotational force.

Another embodiment comprises a housing which contains a piece of polymer which is secured at one end to the housing, and the other end is secured to the resistance force output. An attachment is placed onto the resistance force output and rotated by the user. The rotation of the attachment ultimately causes a twisting effect on the polymer which resists being twisted.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

Figure 1:
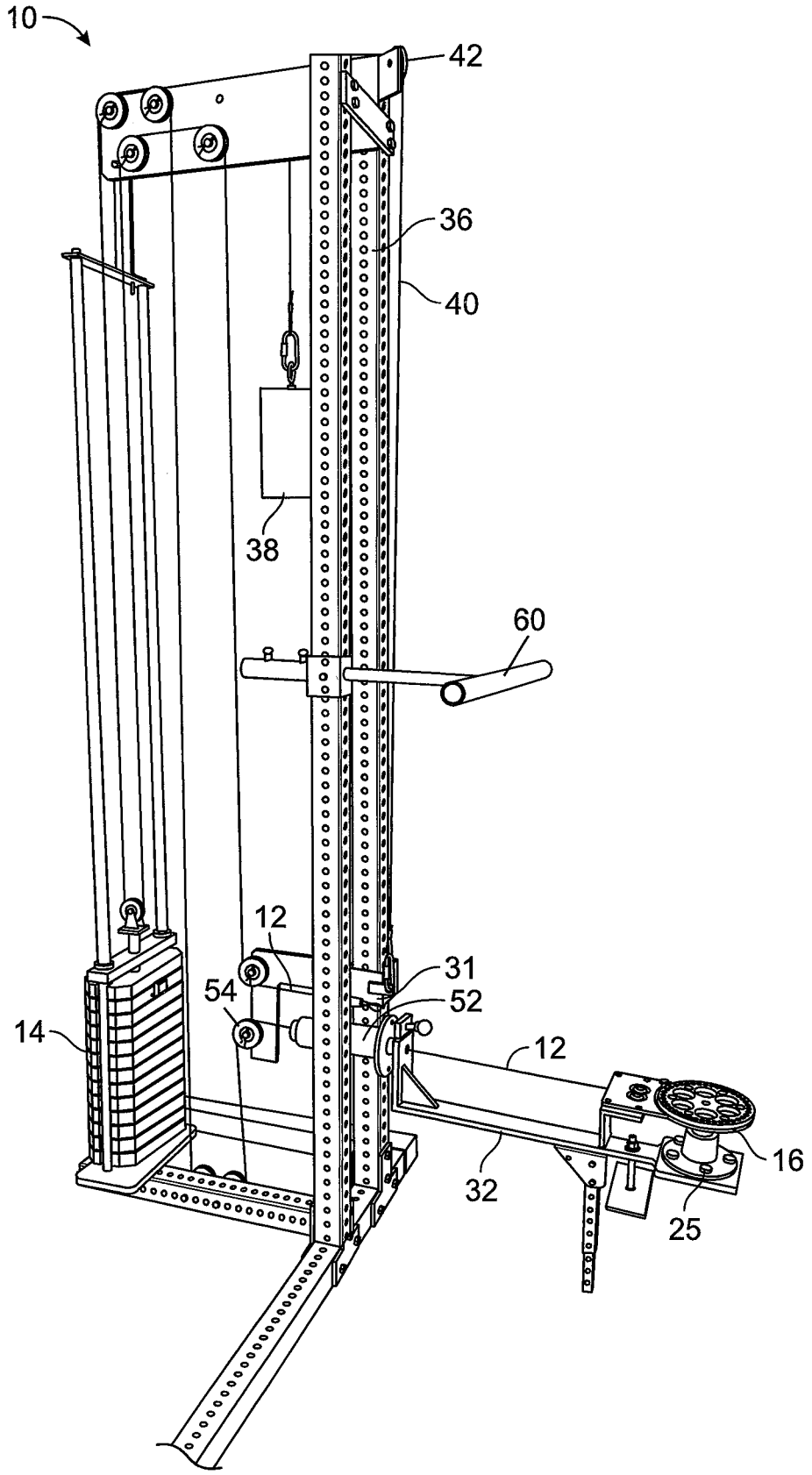
FIG. 1 is a perspective view of an embodiment of the present invention.

In the following detailed description, numerous specific details are set forth in order to provide a thorough understanding of the embodiments of the invention. However, upon studying this application, it will be understood by one of ordinary skill in the art that the embodiments may be practiced without these specific details. For instance, well known operation or techniques may not be shown in detail. Technical and scientific terms used in this description have the same meaning as commonly understood to one of ordinary skill in the art to which this subject matter belongs.

As used throughout this specification and claims the term "rotate" means to turn around a center of rotation in a clockwise, or counterclockwise motion. As used throughout this specification and claims the term "rotating element" means a component to which a force transmitting material is connected to, for example, be wrapped around to provide rotational resistance, and comprises, for example, a circular, elliptical, rectangular, triangular, or the like, shape. As used throughout this specification and claims, the term "force transmitting material" means a component by which force is exerted to provide resistance, including, but not limited to, a cable, rope, chain, belt, rubber band, and the like. Similarly, as used throughout this specification and claims the term "rotational" means to rotate as in, for example, moving in a circular manner, etc. As used throughout this specification and claims, the term "pronation" means to rotate towards the center of the front of the body, while the term "supination" means to rotate away from the center of the front of the body.

Working muscles against resistance in a rotational motion improves the stability of the body part being exercised. The improvements in strength are accompanied by a better understanding of the body, and its range of motion. This new understanding of the body, allows the user of embodiments of the present invention to become more stable and stronger overall. Rehabilitation, injury prevention, and overall strength of certain body parts can be accomplished very quickly when rotational resistance such as the one provided by embodiments of the present invention is utilized as part of an exercise routine.

Generally, rotational motions of the body occur when naturally moving the body while, e.g., walking, running, biking, swimming, throwing, jumping, using tools, and many other motions routinely performed by the body. Strengthening the rotational aspects of the body makes a person's body stronger overall and helps to heal or prevent injuries.

Furthermore, most users of exercise equipment have a limit in the amount of space they can allot to be used by one piece of equipment. A piece of exercise equipment that has multiple functions built into one unit saves real estate space to be used for another purpose.

In one embodiment, a bidirectional force is created by changing the direction of an initially linear force. This is accomplished by changing the linear direction of the original force, for example, a force transferred by a cable, into a force acting upon the tangent of a circumference. When the force acts upon the tangent of the circumference, it gives the user a force to counteract in a rotational fashion. There is no need, in the embodiments of the present invention, for the user to support the perpendicular forces of the exercise motion; the user needs only to rotate around the centerline to counteract the bidirectional opposing force.

In a different embodiment, bidirectional rotational resistances is accomplished through, for example, braking systems, friction, magnetic devices, electric devices, springs, stretching a flexible material, hydraulic devices, pneumatic devices, and the like.

The bidirectional opposing force offered by the various embodiments of the present invention allows the user to exercise clockwise and counterclockwise movements as needed for the various attachments. The bidirectional feature of the present invention is beneficial to the user due to the fact that the body parts rotate in both directions, and those rotations are made possible through muscles which will benefit from resistance exercise.

Embodiments of the present invention have attachments permanently secured to attachment extensions.

In different embodiments of the present invention attachment extensions are permanently attached to the rotational resistance assembly.

In other embodiments of the invention, when the rotational resistance assembly is rotated, a force transferring material such as a cable is wrapped around the periphery of the rotational resistance assembly, and the cable is pulled in an opposite direction by a resistance source such as a weight stack.

Another embodiment of a direct carriage assembly optionally embodies a direct carriage with rollers attached to it. Optionally the rollers contain a frame within the direct carriage, the frame being optionally connectable to another frame. The direct carriage assembly preferably able to be rolled along the frame. Optionally direct carriage has a rotational resistance assembly attached to it.

In one embodiment, the direct carriage assembly moves horizontally along a frame. In another embodiment a direct carriage assembly moves vertically along a frame. In yet another embodiment, a direct carriage assembly moves at an angle along the frame other than horizontally or vertically.

Figure 2:
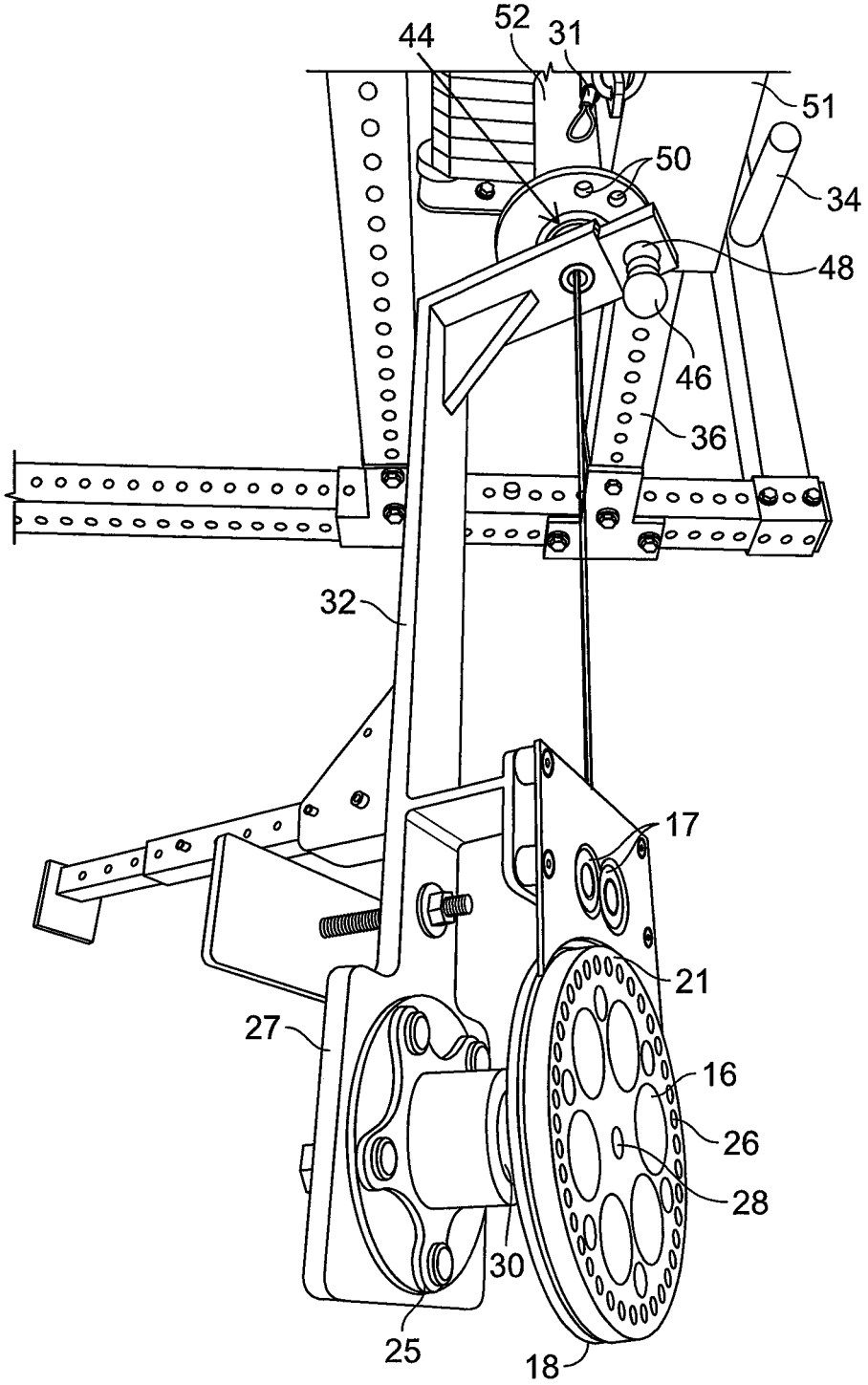
FIG. 2 is a closer view of the adjustable wheel platform arm of the embodiment of FIG. 1.
Figure 3:
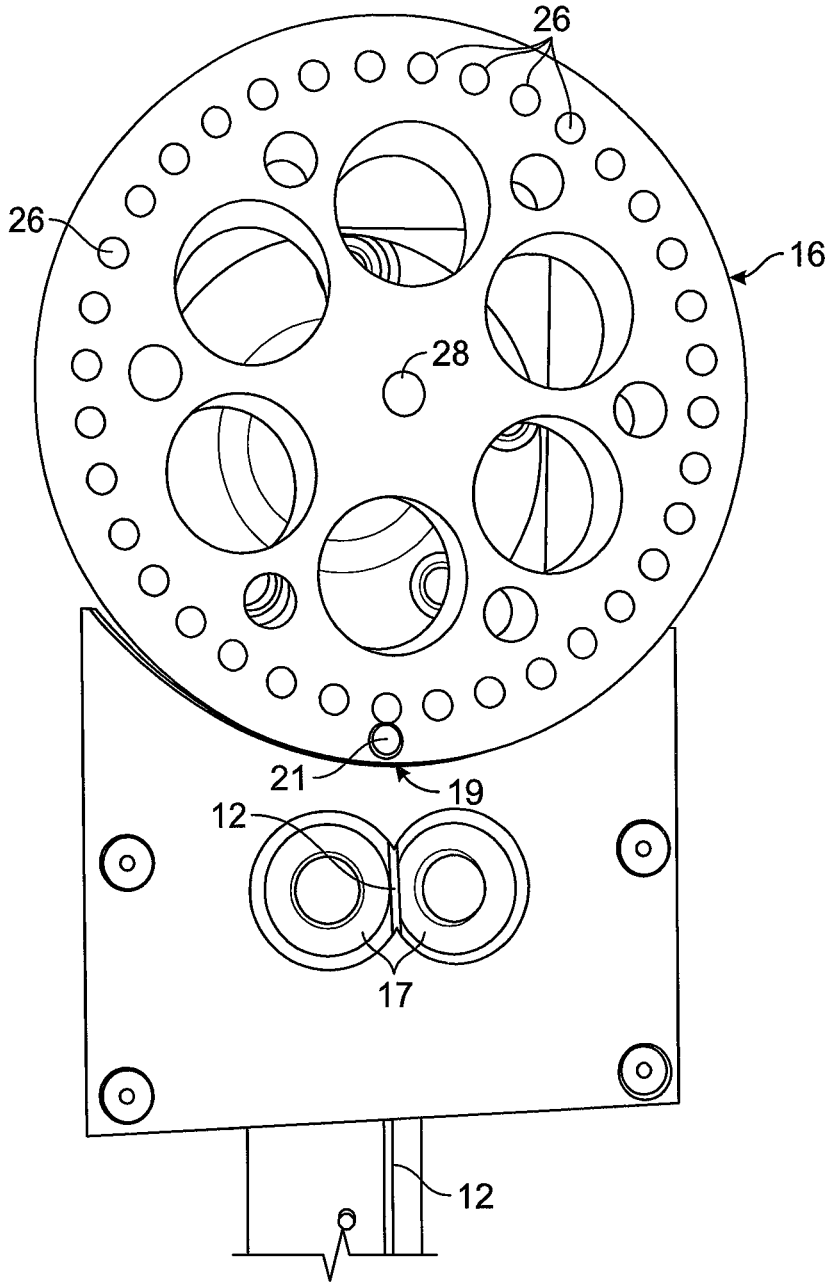
FIG. 3 is a top view of the wheel of the embodiment of FIG. 1.

Referring to FIGS. 1-3, in one embodiment, exercise apparatus 10 comprises original linear force X preferably with a linear direction and preferably being transferred by a force transferring material, such as cable 12. Cable 12 is preferably connected to weights 14 at one end and to wheel 16 at its opposite end. In one embodiment, wheel 16 has a circular shape and comprises groove 18 on its periphery to accommodate cable 12 when turned in either a clockwise or a counterclockwise direction. Optionally, wheel 16 comprises a shape other than circular, for example, elliptical. In one embodiment, a mechanism is provided to guide cable 12 as it wraps around wheel 16, for example, pulleys 17 are preferably disposed on either side of cable 12 relatively near wheel 16 (e.g., most preferably between approximately 0.25 inches and approximately 6 inches), to guide cable 12 into groove 18, thus maximizing transition of force from cable 12 to wheel 16. Preferably, wheel 16 is mounted onto moving axle 20 preferably comprising, for example, bearings (not shown). Preferably wheel 16 is connected to axle 20, e.g., welded, bolted, etc. In one embodiment, axle 20 inserts into hub 25, and nut 27 is then placed on an end opposite to the end where wheel 16 is disposed. Preferably cable 12 is attached to wheel 16 by placing cable ball 21 into cable receiver 19. Bi-directional motions which act upon cable 12 in a motion, which lifts weights 14, are commenced by the user spinning wheel 16, alone, or optionally with an attachment.

In one embodiment, attachments for various exercises are preferably secured onto wheel 16 through, for example, one or more easy insertion/release pins, which optionally pass through center perforation 28, on wheel 16, and/or optionally pass through off center perforations 26. The face of wheel 16 is preferably a substantially flat plane surface of wheel 16, through which easy insertion/release pins pass in a perpendicular plane of motion. Quick release of the attachments allows the user to quickly change the optional attachments if so desired, thus saving time.

In one embodiment, a free end of the force transferring material is made available to the user, with for example, cable attachment 31, in order to provide an attachment point for several different pre-existing attachments. This provides an optional value-added feature. This attachment point offers the user linear force resistance to use to strengthen the body in a linear fashion.

Embodiments for attachments for wheel 16, for instance, a grip handle, are unique from existing similar inventions in the way that they align the center of rotation of, for example, the user's wrist with the center of rotation of the opposing force. Competing devices force the user to move the centerline of their wrist rotation off of the center line of rotation of the opposing force, thus forcing the user to experience a movement which is not naturally aligning with their body.

In a preferred embodiment, exercise apparatus 10 preferably comprises adjustable wheel platform arm 32. Preferably the position of wheel platform arm 32 can be adjusted vertically to various heights to accommodate different users. For example, a user can release lock 34, which preferably holds wheel platform arm 32 in place on center post 36, and raise or lower wheel platform arm 32 to a desired height position. Optionally, counterweight 38 will assist the user in lifting or lowering wheel platform arm 32 which is preferably connected to counterweight cable 40. Preferably counterweight cable 40 is guided through pulleys 42 in order to change the downward force of the gravitational force acting upon counterweight 38, into an upward force acting upon wheel platform arm 32. Preferably friction reduction materials (not shown), such as rollers, brushing, bearings, and the like, are placed between wheel platform arm 32 and center post 36 in housing 51.

Preferably, a user can adjust wheel platform arm 32 to multiple horizontal positions which allow use of various attachments for different exercise routines. For example, the user can insert easy insertion/release pin 46 through wheel platform arm pin hole 48, and through a degree selection hole 50. Preferably friction reduction materials (not shown), such as bearings, rollers, and the like, are placed between wheel platform arm 32, and center post 36. Easy rotation of wheel platform arm 32 is made possible with friction reduction material 44 placed between wheel platform arm 32 and friction material housing 52. Preferably cable 12 follows the center of rotation of wheel platform arm 32, as wheel platform arm 32 is rotated to user's selection of degree selection holes 50. Preferably the first pulley 54 guides cable 12 in a direct path to cable receiver 19, optionally said path is also the center of rotation of wheel platform arm 32. Preferably support handle 60 is disposed on or near center post 36 or other post of the apparatus, and is adjustable to move in/out and up/down, or be folded out of the way while remaining attached to the apparatus. Alternatively, support handle 60 is detachable.

Figure 4:
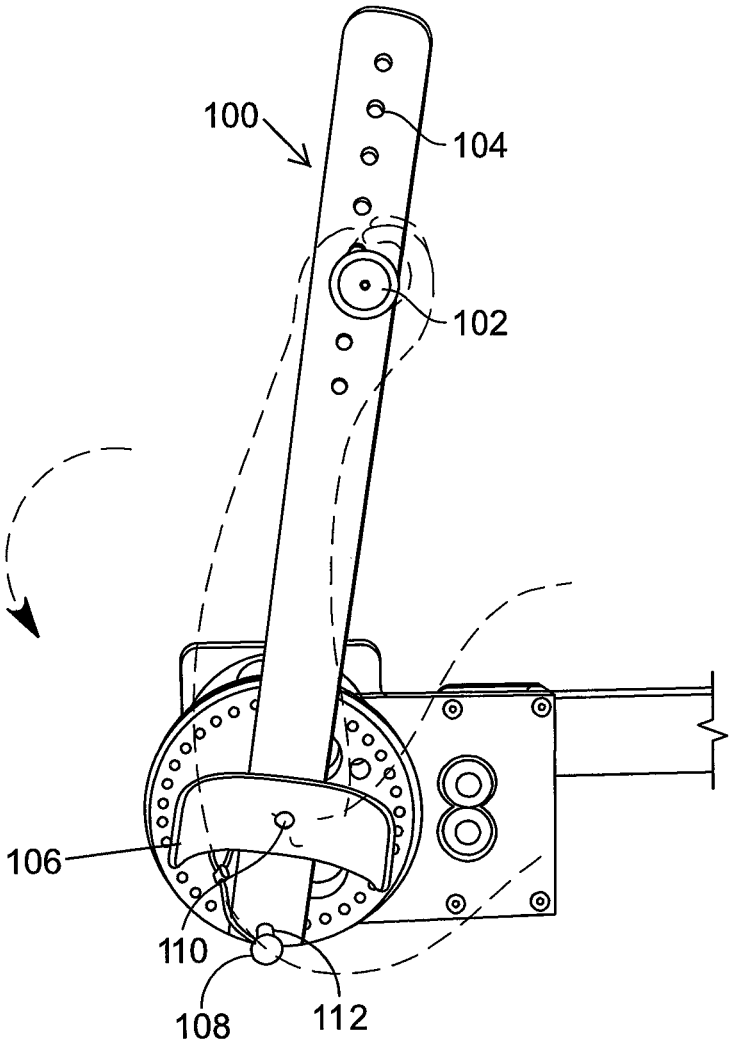
FIG. 4 is a perspective view of an embodiment of an elbow cradle attachment.

Referring to FIG. 4, in one embodiment, shoulder rotation exercises are accomplished by utilizing elbow cradle attachment 100, which is more effective than current exercise equipment when used to strengthen the shoulder joint and muscles in a supination, and/or pronation, and/or rotation motion. In this embodiment, the counteracting force preferably directly opposes the user's supination and pronation forces without any other forces interfering. The user preferably positions the arm in such a way that the supination and pronation of the shoulder is isolated, and exercised when moving through the selected range of motion. Preferably, elbow cradle attachment 100 comprises elbow cradle handle 102, handle mount selection holes 104, elbow positioning bumpers 106, easy insertion/release pin 108, and range of motion pin position hole 112. In one embodiment, easy insertion/release pin 108 is affixed to elbow cradle attachment 100. In a different embodiment, elbow cradle attachment 100 further comprises easy center pin positioning hole 110 through which another easy insertion/release pin (not shown) passes to be inserted into center perforation 28 (not shown). Preferably the user will change position of elbow cradle handle 102 by, for example, unscrewing it from threaded handle mount selection hole 104 and, for example, screwing it into the desired threaded handle mount selection hole 104. Preferably elbow positioning bumpers 106 keep the user's elbow in the position of directly over the center of rotation of wheel 16. Preferably the user can utilize elbow cradle attachment 100 with wheel 16 oriented in a vertical or horizontal plane relative to the wheel face.

Figure 5:
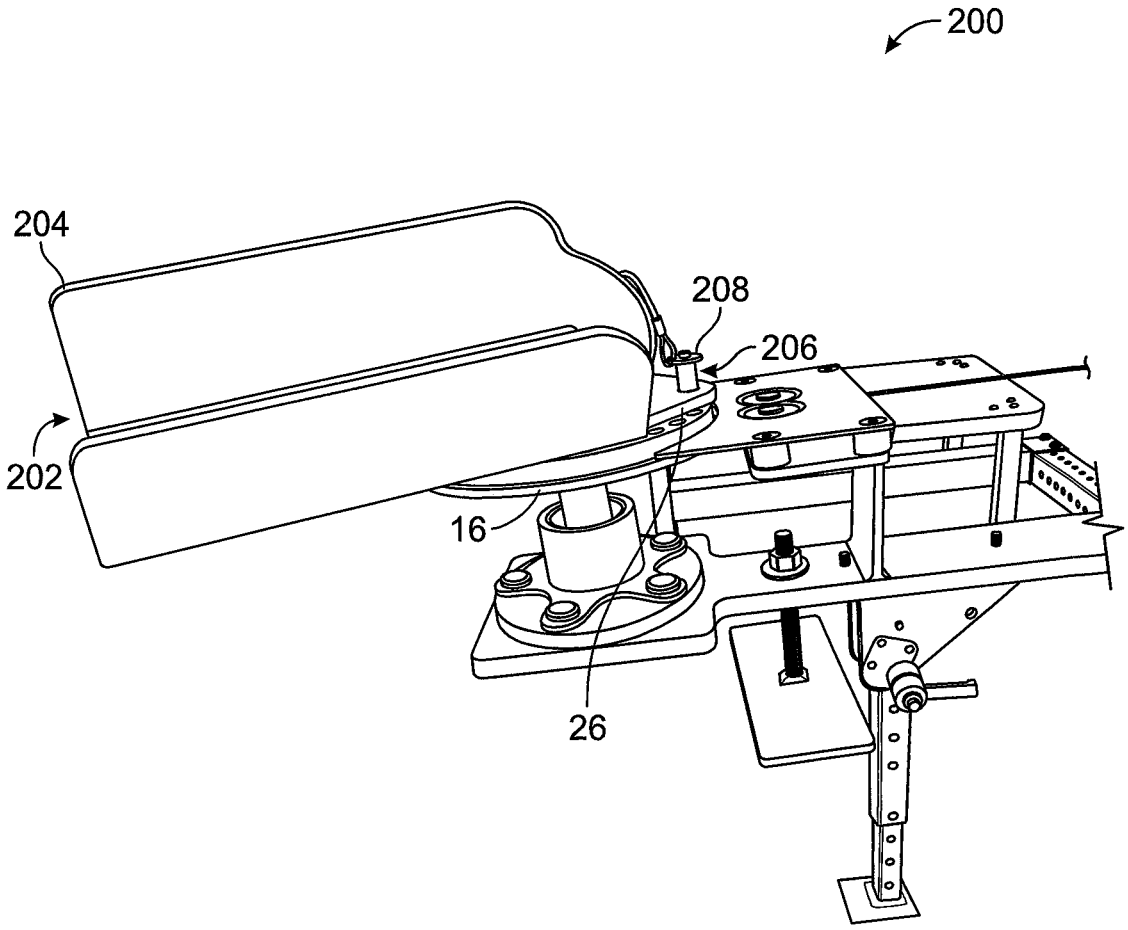
FIG. 5 is a perspective view of an embodiment of a knee cradle attachment.

Referring to FIG. 5, hip rotation exercises are carried out through knee cradle attachment 200 more effectively than that offered by current equipment when used to strengthen the hip joint and related muscles in a supination, and/or pronation motion, and/or rotation motion. The counteracting force from apparatus 10 directly opposes the user's supination, pronation, and/or rotation forces without any other forces interfering. The user positions their leg in such a way that the supination and pronation and rotation of the hip is isolated and exercised when moving through the selected range of motion. Preferably knee cradle attachment 200 comprises knee placement area 202, padding 204, pin position hole 206, and easy insertion/release pin 208. In one embodiment, an easy insertion/release pin (not shown) is affixed to knee cradle attachment 200. In a different embodiment, knee cradle attachment 200 further comprises easy center pin positioning hole (not shown) through which the easy insertion/release pin passes to be inserted into center perforation 28. The user preferably will select the position they wish to begin the motion by moving knee cradle attachment 200 to a position, then securing easy insertion/release pin 208 through range of motion pin positioning hole 206 into any one of off center perforations 26 in wheel 16.

Figure 6:
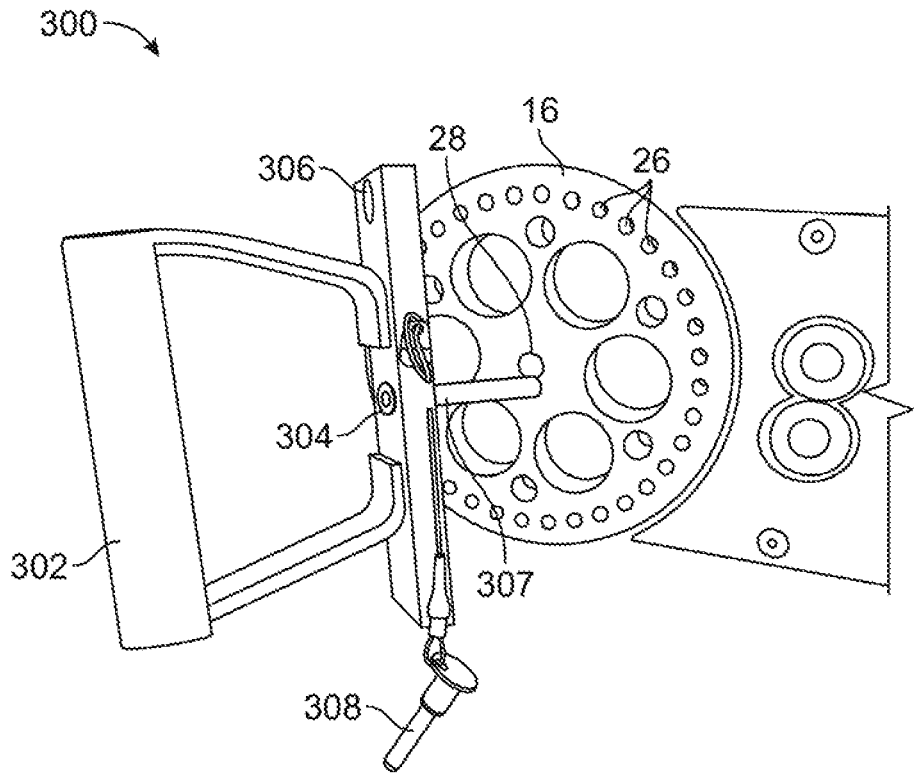
FIG. 6 is a perspective view of an embodiment of a grip handle attachment.

Referring to FIG. 6, arm and/or hand rotation and/or supination, and/or pronation is preferably provided through grip handle attachment 300, which is more effective than current exercise devices when used to strengthen the shoulder joint and related muscles in a supination, and/or pronation and/or rotation motion, and/or the wrist joint and related muscles in a supination, and/or pronation, and/or rotation motion, and/or the elbow joint and related muscles in a supination and/or pronation and/or rotation motion. The counteracting force from embodiments of the present invention directly opposes the user's supination and pronation forces without any other forces interfering. The user positions their arm in such a way that the supination and pronation of the shoulder and/or elbow and/or wrist is isolated and exercised when moving through the selected range of motion. Preferably, grip handle attachment 300 comprises grip surface 302, center pin position hole 304, range of motion pin position hole 306, easy insertion/release pins 307, and easy insertion/release pin 308. In one embodiment, easy insertion/release pin 307 is affixed to grip handle attachment 300. In a different embodiment, grip handle attachment 300 further comprises easy center pin positioning hole (not shown) through which easy insertion/release pin 307 passes to be inserted into center perforation 28, and easy insertion/release pin 308 passes through pin positioning hole 306 to be inserted into off center perforations 26 on wheel 16.

Figure 7:
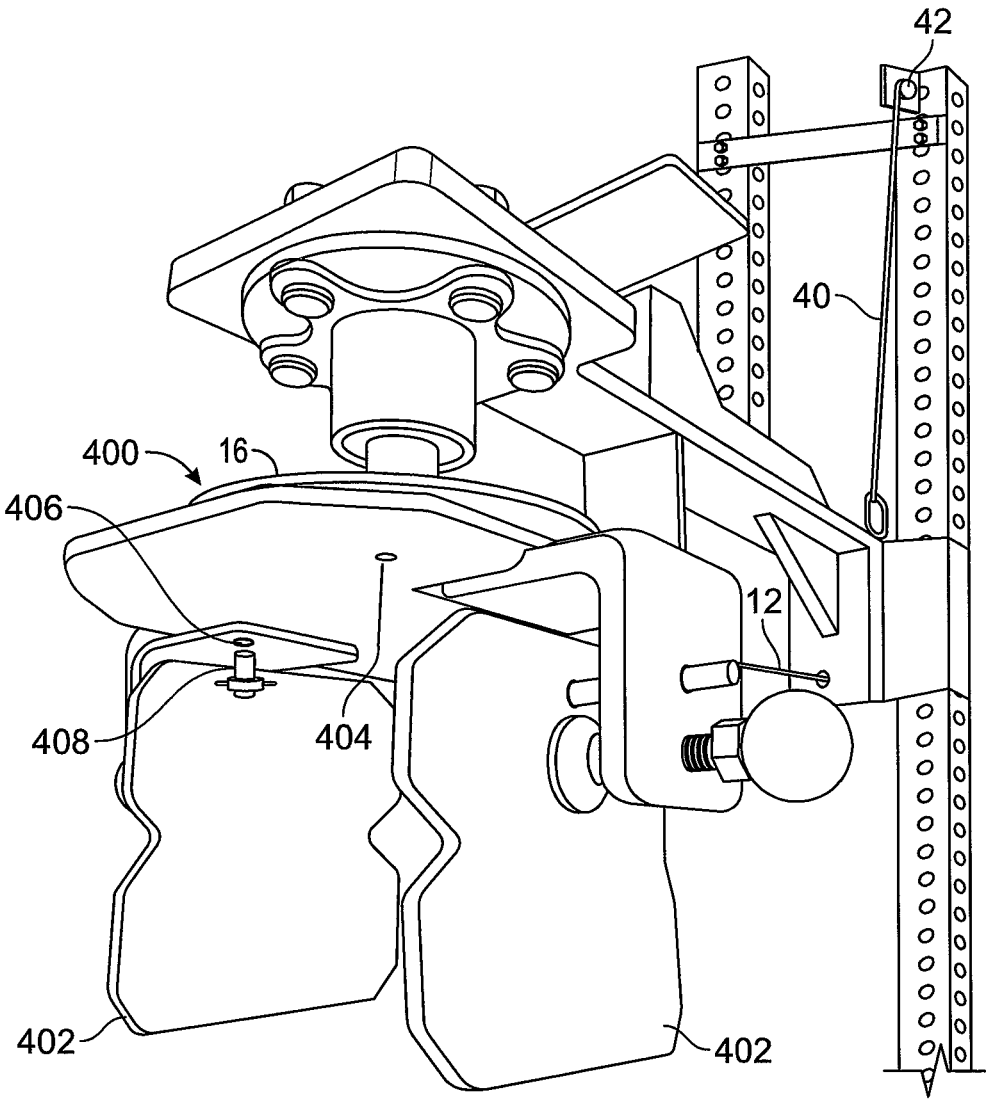
FIG. 7 is a perspective view of an embodiment of a head piece attachment.

Referring to FIG. 7, neck rotation is provided by utilizing head piece attachment 400, which is more effective than the prior art when used to strengthen the neck and/or related muscles in a left and/or right rotating motion. The counteracting force from the machine directly opposes the user's rotating forces without any other forces interfering. The user positions their head in such a way that the left and right rotation of the neck is isolated, and exercised when moving through the selected range of motion. Preferably, head piece attachment 400 comprises head clamps 402, center pin position hole 404, range of motion pin position hole 406, and easy insertion/release pin 408. The user will preferably insert an easy insertion/release pin (not shown) through center pin position hole 404 and into center perforation 28 on wheel 16, and easy insertion/release pin 408 through range of motion pin position hole 406 into off center perforations 26 in wheel 16. In one embodiment, the central easy insertion/release pin is affixed to head piece attachment 400.

Figure 8:
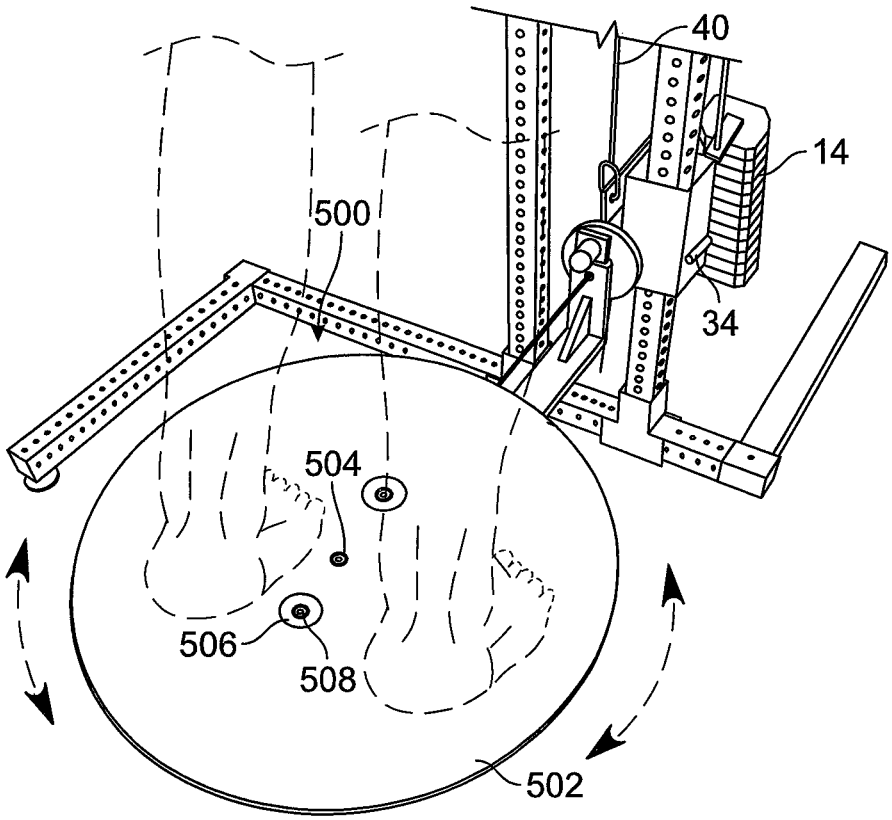
FIG. 8 is a perspective view of an embodiment of a foot plate attachment.

Referring to FIG. 8, hip and/or knee and/or ankle and/or spine rotation and/or pronation and/or supination provided by utilizing the foot plate attachment 500 in the present invention is more effective than the prior art when used to strengthen the hip joint and/or knee joint and/or ankle joint and/or spine and related muscles in a supination, and/or pronation, and/or rotation motion. The counteracting force from the machine directly opposes the user's supination and/or pronation and/or rotation forces without any other forces interfering. The user positions their leg or legs in such a way that the supination and/or pronation and/or rotation of the hip and/or knee and/or ankle and/or foot and/or spine is isolated, and exercised when moving through the selected range of motion. Preferably, foot plate attachment 500 comprises foot placement surface 502, center pin position hole 504, other pin position hole 506, and easy insertion/release pin 508. The user will preferably insert an easy insertion/release pin (not shown) through center pin position hole 504 into center perforation 28 on wheel 16, which is under foot plate attachment 500, and easy insertion/release pin 508 through pin position hole 506 into off center perforations 26 on wheel 16. In one embodiment, the central easy insertion/release pin is affixed to foot plate attachment 500.

Figure 9:
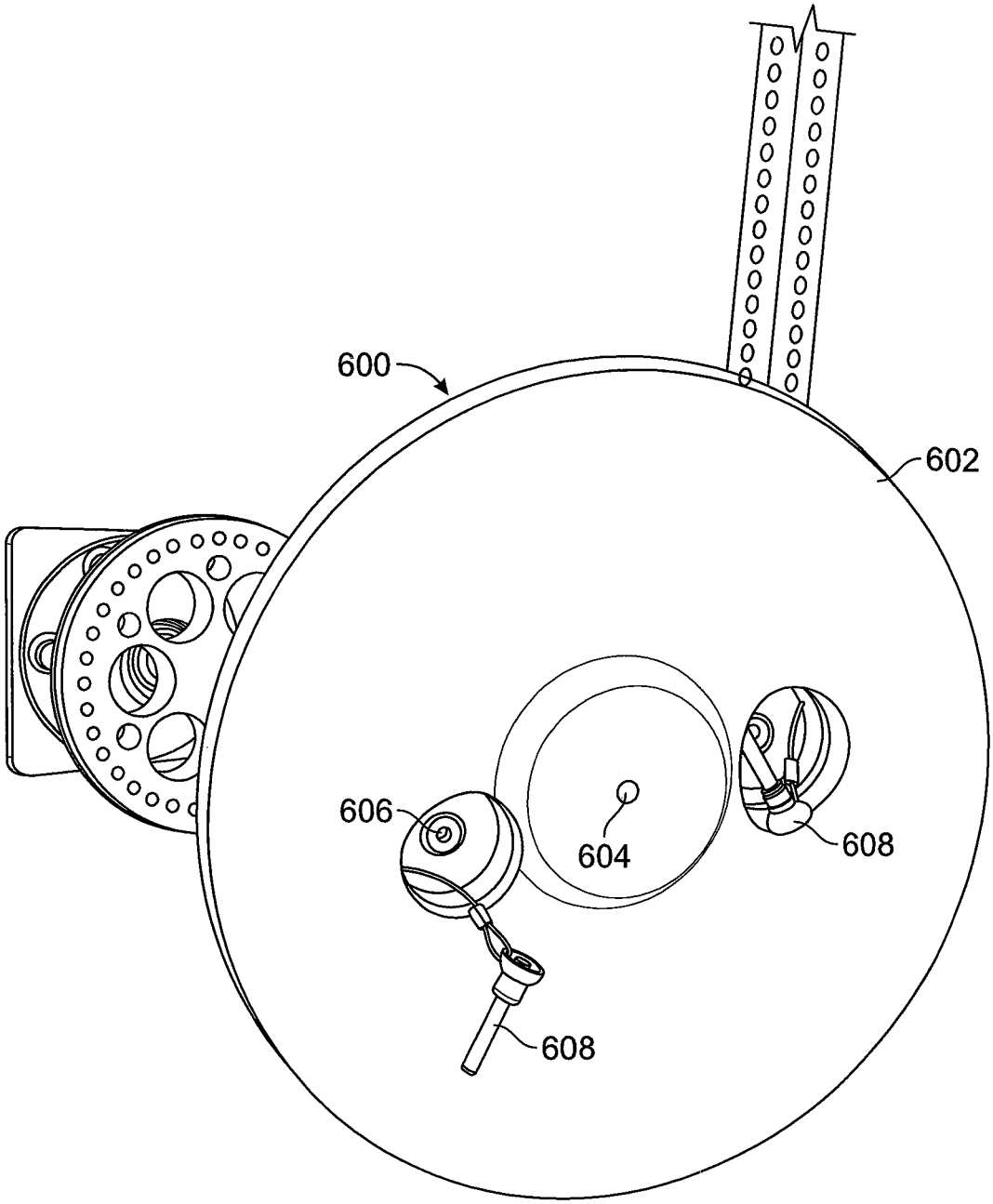
FIG. 9 is a perspective view of an embodiment of a hand plate attachment.

Referring to FIG. 9, shoulder rotation and/or wrist rotation and/or elbow rotation and/or hand provided by utilizing the hand plate attachment 600 in the current invention is more effective than the prior art when used to strengthen the shoulder joint and/or elbow joint and/or wrist joint and related muscles in a supination, and/or pronation and/or rotation motion. The counteracting force from the machine directly opposes the user's supination and pronation forces without any other forces interfering. The user positions their arm in such a way that the supination and pronation of the shoulder and/or elbow and/or wrist and/or hand are isolated, and exercised when moving through the selected range of motion. Preferably, hand plate attachment 600 comprises hand placement surface 602, center pin position hole 604, other pin position hole 606, and easy insertion/release pins 608. The user will preferably insert an easy insertion/release pin (not shown) through center pin position hole 604 into center perforation 28 on wheel 16, and easy insertion/release pins 608 into off center perforations 26 on wheel 16. In one embodiment, the central easy insertion/release pin is affixed to hand plate attachment 600.

Figure 10:
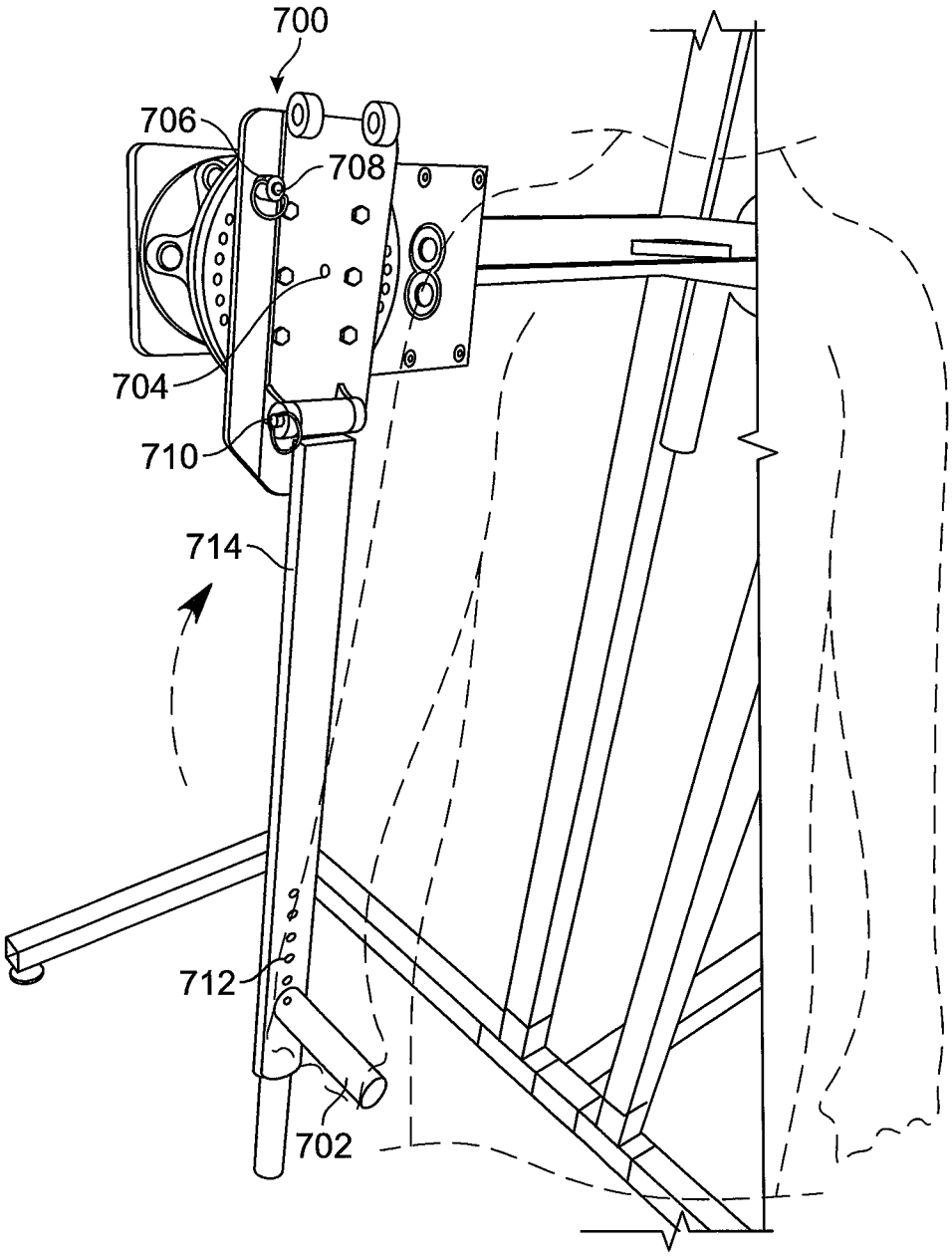
FIG. 10 is a perspective view of an embodiment of a long shoulder handle.

Referring to FIG. 10, shoulder rotation provided by utilizing long shoulder handle attachment 700 in the present invention is more effective than the prior art when used to strengthen the shoulder joint and related muscles in a supination, and/or pronation and/or rotation motion. The counteracting force from the machine directly opposes the user's supination and/or pronation and/or rotation forces without any other forces interfering. The user positions their arm in such a way that the supination and/or pronation and/or rotation of the shoulder is isolated, and exercised when moving through the selected range of motion. Preferably, long shoulder handle attachment 700 comprises removable handle 702, center pin position hole 704, range of motion pin position hole 706, and easy insertion/release pin 708. The user will preferably insert an easy insertion/release pin (not shown) through center pin positioning hole 704 into center perforation 28 on wheel 16, and easy insertion/release pin 708 through range of motion pin position hole 706 into off center perforations 26 on wheel 16. Preferably user will remove removable handle 702 and place it into removable handle insertion points 712 of their choice. Optionally, user can remove long arm 714 by releasing easy release hinge 710. In one embodiment, the central easy insertion/release pin is affixed to long shoulder handle attachment 700.

Figure 11:
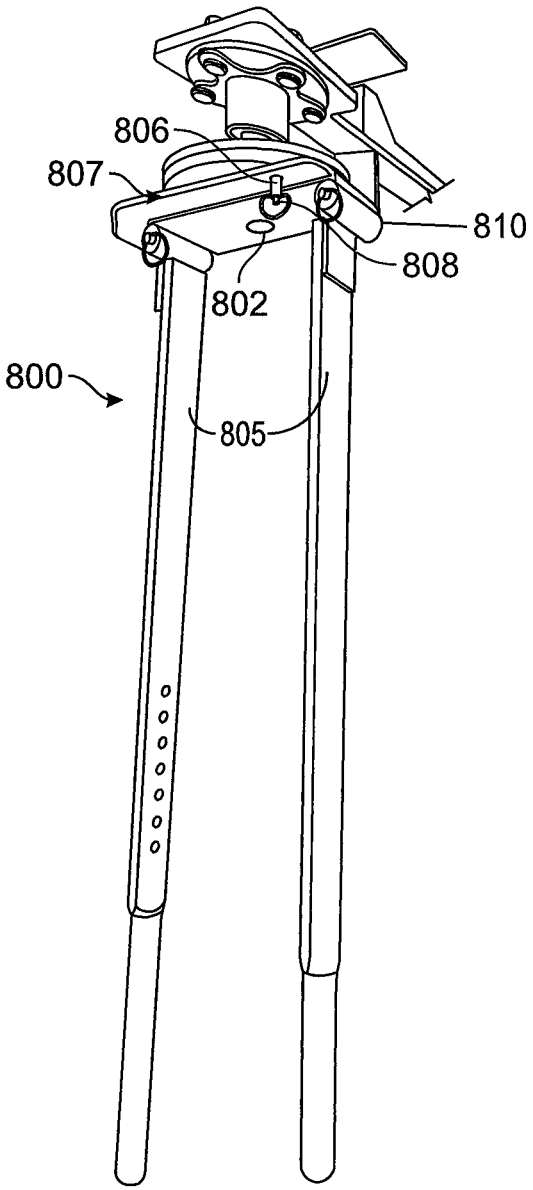
FIG. 11 is a perspective view of an embodiment of a long over-head handles attachment.

Referring to FIG. 11, spine rotation and/or hip rotation and/or knee rotation and/or ankle rotation provided by utilizing long overhead handles attachment 800 is more effective than the prior art when used to strengthen the spine and/or hip and/or knee and/or ankle joints and related muscles in a rotating motion. The counteracting force from the machine directly opposes the user's rotation forces without any other forces interfering. The user positions their body in such a way that the rotation and/or supination and/or pronation of the spine and/or hip and/or knee and/or ankle and/or foot and related muscles are isolated, and exercised when moving through the selected range of motion. Preferably, long overhead handles attachment 800 comprises center pin position hole 802, range of motion pin position hole 806, long arms 805, and one or more easy release hinges 810. The user will preferably insert an easy insertion/release pin (not shown) through center pin positioning hole 802 into center perforation 28 on wheel 16, and pin 808 through range of motion pin position hole 806 into off center perforations 26 on wheel 16. Optionally user can remove long arms 808 by removing easy release hinge(s) 810. In one embodiment, the central easy insertion/release pin is affixed to long overhead handles attachment 800.

Figure 12:
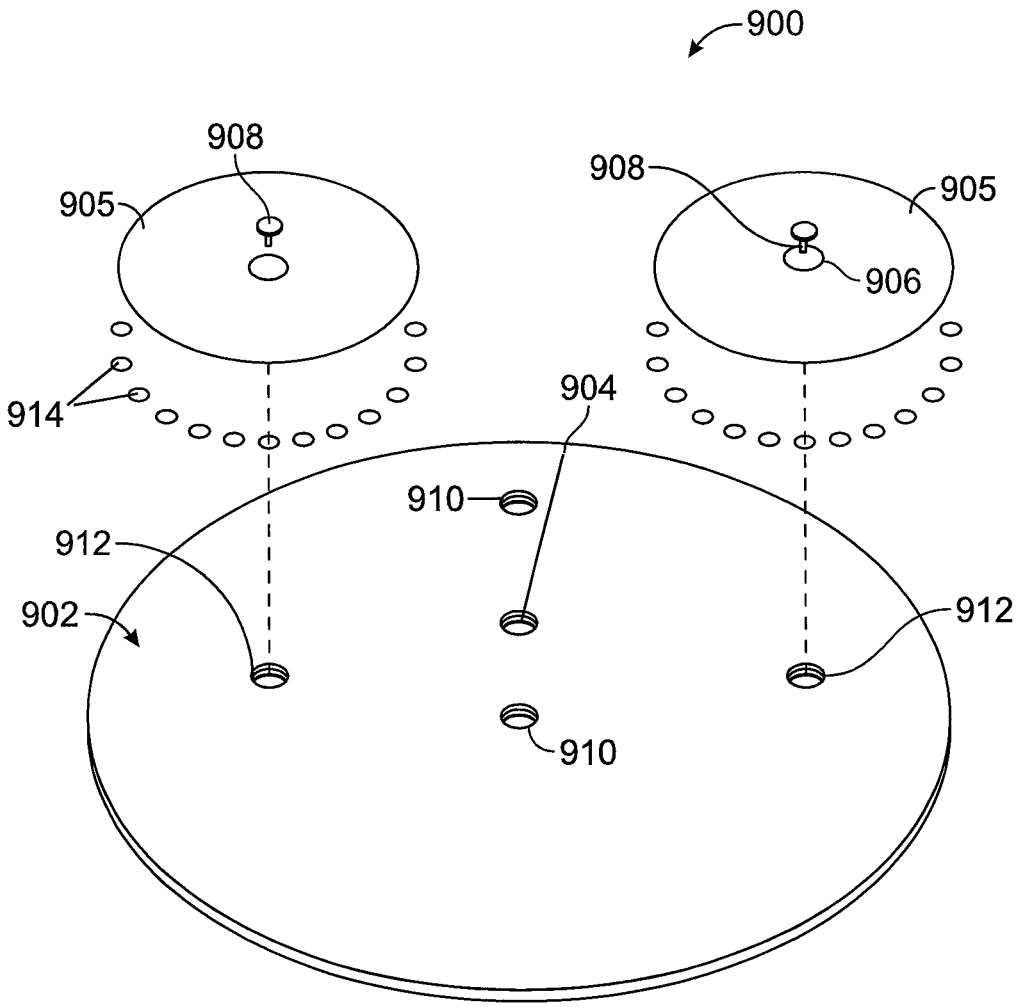
FIG. 12 is a perspective view of an embodiment of a twin free foot spin foot plate attachment.

Referring FIG. 12, hip and/or knee and/or ankle and/or spine rotation and/or supination and/or pronation provided by utilizing twin free spin foot plate attachment 900 is more effective than the prior art when used to strengthen the spine and/or hip and/or knee and/or ankle joints and related muscles in a supination, and/or pronation and/or rotation motion. The counteracting force from the machine directly opposes the user's supination and/or pronation and/or rotation forces without any other forces interfering. Preferably, twin free spin foot plate attachment 900 comprises support surface 902, center pin position hole 904, range of motion pin position holes 910, easy insertion/release pin 908, foot pads 905, pin holes 912, and bearings 914. The user will preferably insert an easy insertion/release pin (not shown) through center pin positioning hole 904 into center perforation 28 on wheel 16, which is underneath support surface 902, and easy insertion/release pins (not shown) through range of motion pin position holes 910 into off center perforations 26 on wheel 16. In one embodiment, the easy insertion/release pins are affixed to twin free spin foot plate attachment 900.

Figure 13:
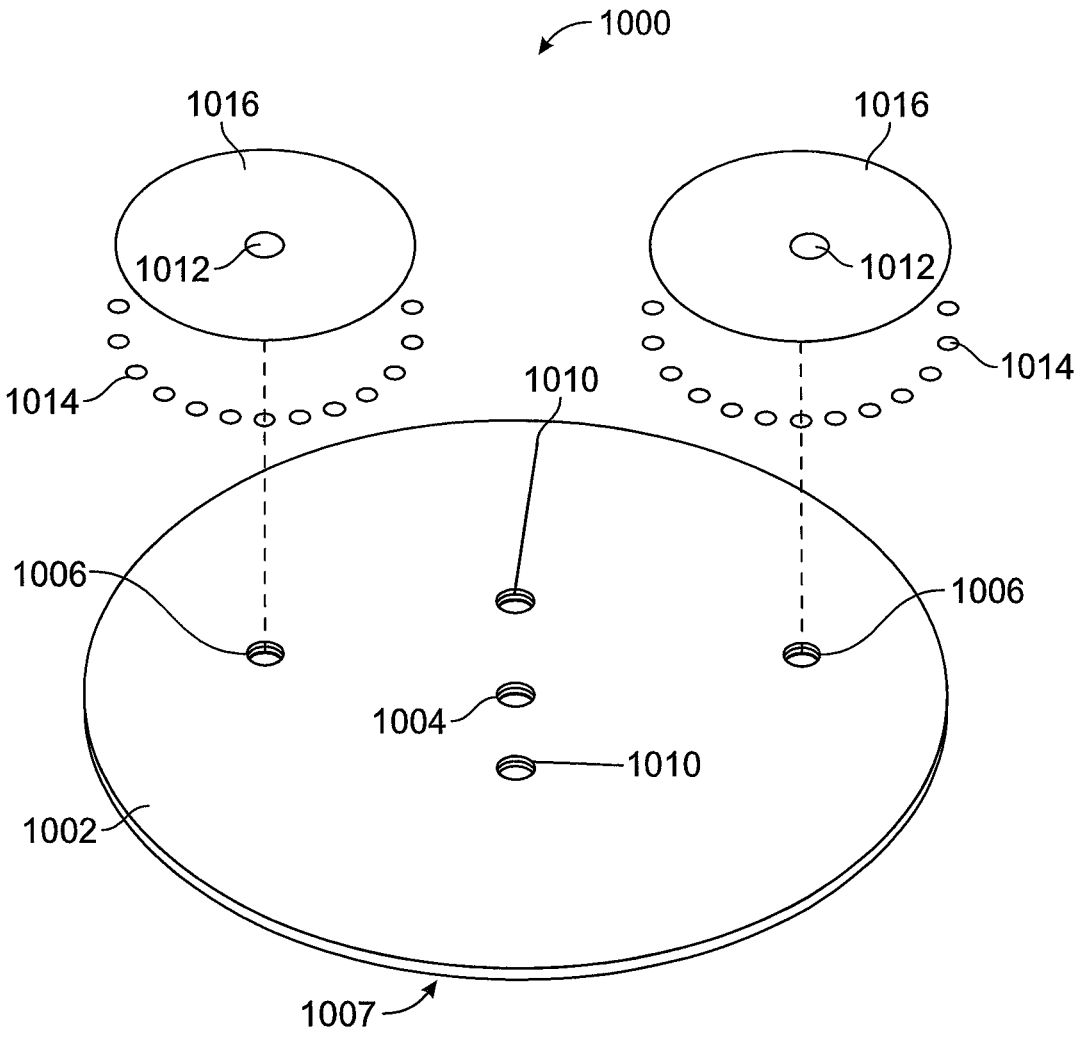
FIG. 13 is a perspective view of an embodiment of a twin free hand spin foot plate attachment.

Referring to FIG. 13, in one embodiment, shoulder and/or elbow and/or wrist supination and/or pronation and/or rotation provided by utilizing the twin free spin hand plate 1000 attachment in the present invention is more effective than the prior art when used to strengthen the shoulder and/or elbow and/or hands and/or wrist joints and related muscles in a supination, and/or pronation and/or rotation motion. The counteracting force from the machine directly opposes the user's supination and/or pronation and/or rotation forces without any other forces interfering. The user positions their arms in such a way that the supination and/or pronation and/or rotation of the shoulder and/or elbow, and/or wrist and/or hands are isolated, and exercised when moving through the selected range of motion. Preferably, twin free spin hand plate attachment 1000 comprises support surface 1002, center pin position hole 1004, range of motion pin position holes 1010, hand pads 1016, pin hole 1012, which aligns with support surface pin holes 1006, and bearings 1014. The user will preferably insert an easy insertion/release pin (not shown) through center pin positioning hole 1004 and into center perforation 28 on wheel 16, which is under support surface 1002, and insert easy insertion/release pins (not shown) through range of motion pin position holes 1010 into off center perforations in wheel 26 on wheel 16. In one embodiment, the easy insertion/release pins are affixed to twin free spin hand plate 1000.

Figure 14:
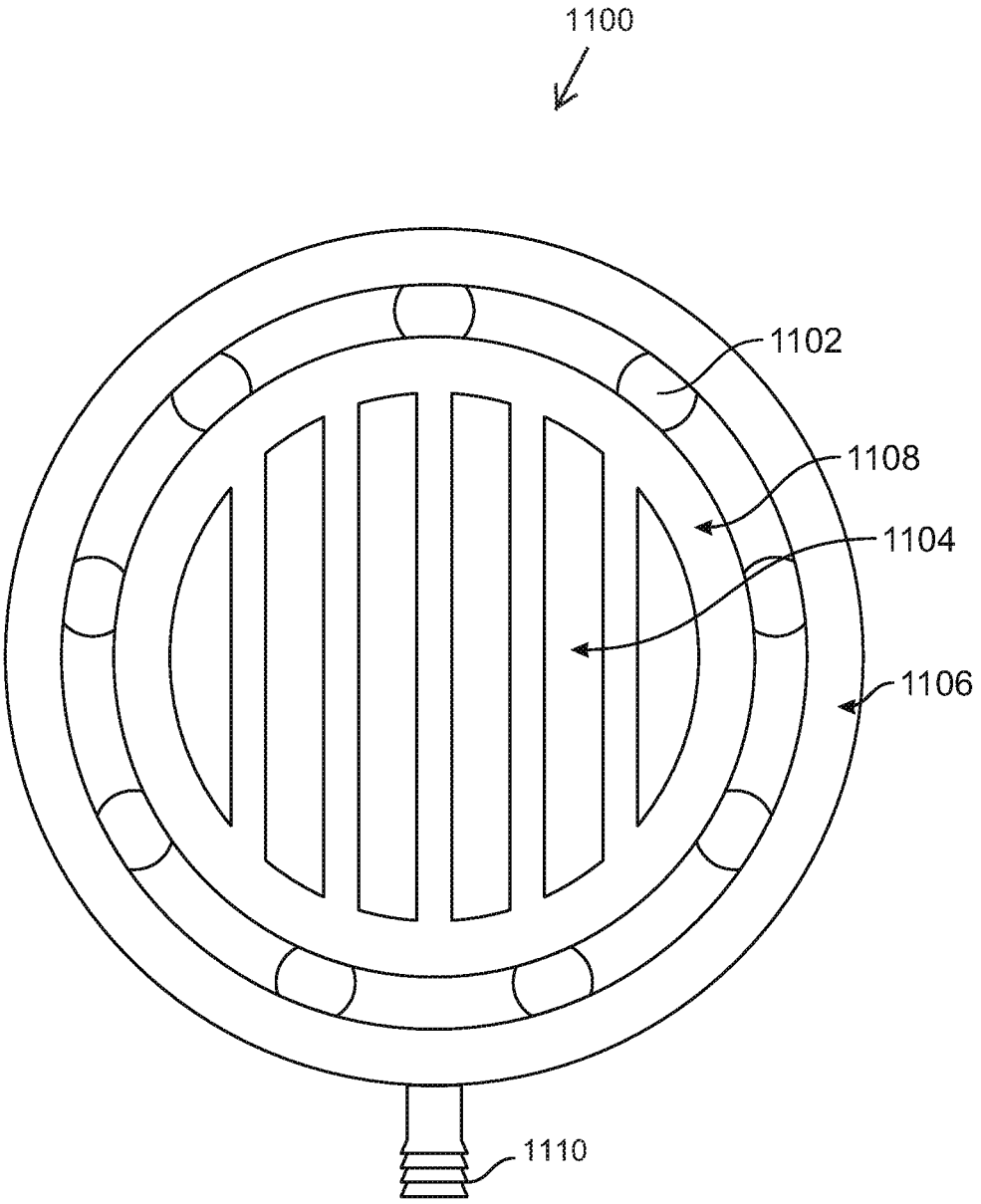
FIG. 14 is a perspective view of an embodiment of a free spinning finger cradle attachment.

Referring to FIG. 14, shoulder rotation and/or elbow rotation and/or wrist rotation and/or spine rotation provided by utilizing free spinning finger cradle attachment 1100 in the current invention is more effective than the prior art when used to strengthen the shoulder joint and/or elbow joint and/or wrist joint and/or the spine and related muscles in a supination, and/or pronation and/or rotational motion. The counteracting force from the machine directly opposes the user's supination, pronation, and rotational forces without any other forces interfering. The free spinning finger cradle attachment allows the user to supinate or pronate their hand freely, without an opposing force applied to that particular supination or pronation, while pronating and/or supinating and/or rotating another body part. Preferably free spinning finger cradle attachment 1100 comprises bearings 1102, finger placement slots 1104, outer housing 1106, inner housing 1108, and threaded insertion 1110. Preferably free spinning finger cradle attachment 1100 is attached to elbow cradle attachment 100 in place of the elbow cradle handle 102 (shown in fig. 4), or to long shoulder handle attachment 700, in place of removable handle 702 (shown in Fig. 10).

Referring to FIGS. 15-20, in one embodiment, multi-function rotational resistance exercise apparatus 1200 comprises force transferring material such as cable 12, which is preferably connected at one end to rotational resistance assembly 1300, and optionally connected to functional assembly 1201 at the other end. Cable 12 passes through a series of pulleys 42 (some of which are not shown), and first pulley 54, preferably in such a way that the weights 14, are lifted when either end of the cable is drawn out from its resting position. Preferably main arm 1202, is secured to main arm carriage 1208, by main arm pins 1209. Main arm carriage 1208, is vertically adjustable on vertical frame post 1203, and lockable into position of choice by means of, for example, lock cog (not shown). Preferably when main arm carriage 1208, is adjusted vertically, main arm 1202, adjusts vertically as well because they are preferably secured to one another by main arm pins 1209. Optionally articulating safety handle 1205, is adjustable in position by safety handle lock 1206. Optionally safety handles 1205 are adjustable in length. Optionally stationary platform 1207, is attachable to a part of multi-function rotational resistance exercise apparatus 1200, providing a place for a user to stand or sit.

Figure 15:
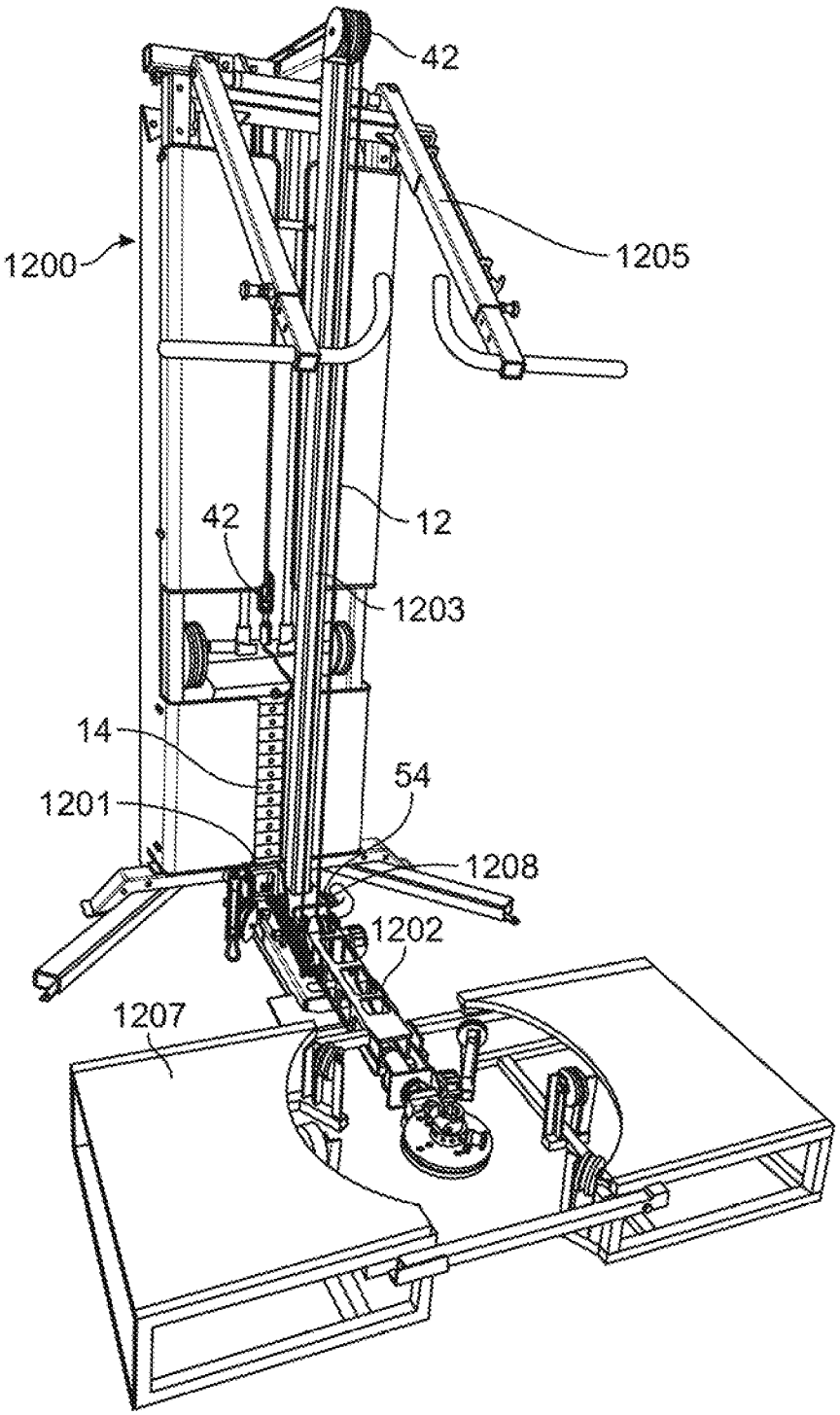
FIG. 15 is a perspective view of one embodiment of the present invention.
Figure 16:
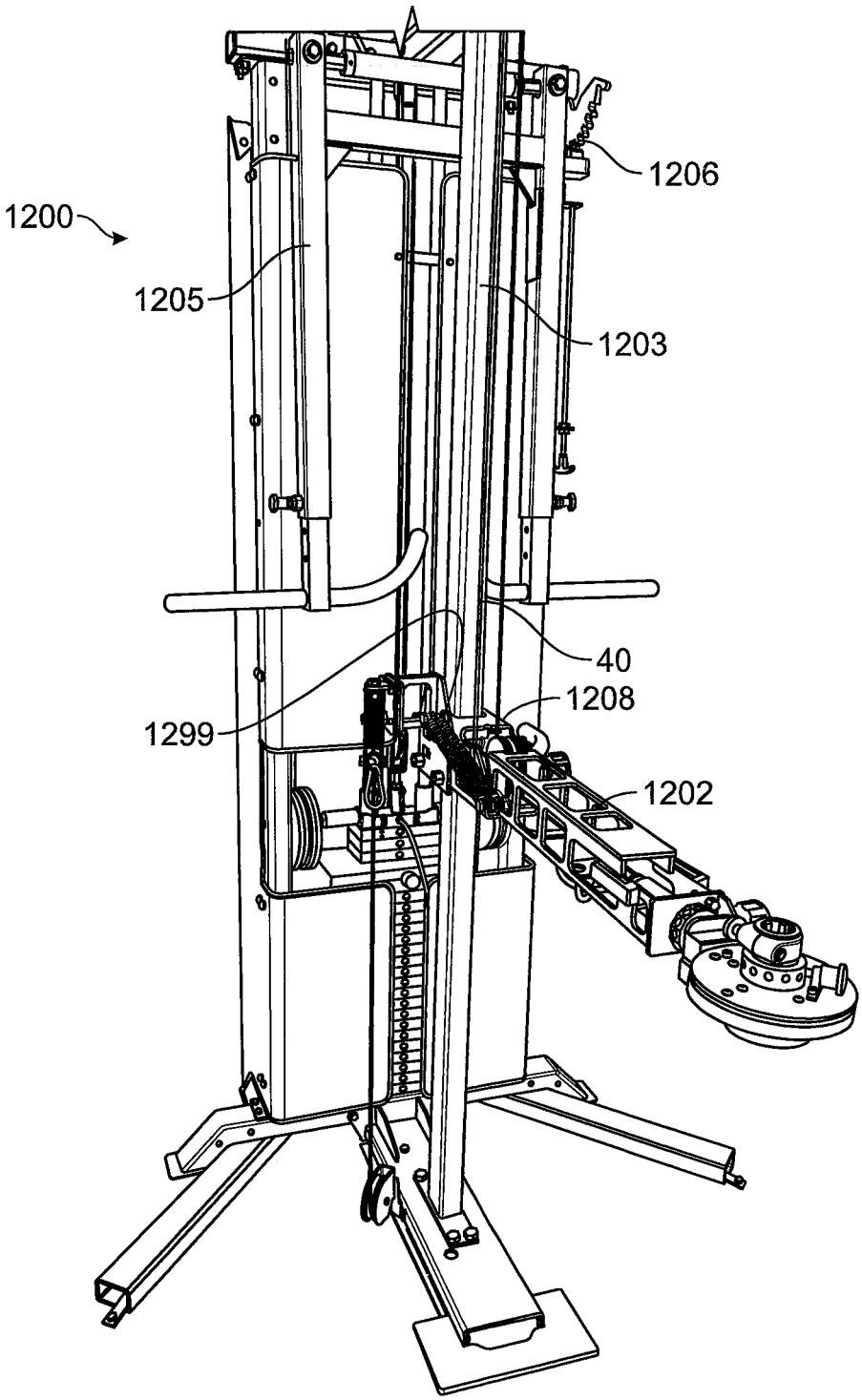
FIG. 16 is a perspective view of one embodiment of the present invention.

Referring more particularly to FIG. 16, in one embodiment, multi-function rotational resistance exercise apparatus 1200 is shown with a different vertical setting of main arm carriage 1208 on vertical frame post 1203, when compared to FIG. 15. One embodiment comprises counterweight cable 40, which is preferably connected at one end to counterweight 38, and connected to main arm carriage 1208, at the other end. Preferably when the main arm carriage 1208 is moved to a different vertical position by a user, counterweight 38, assists the user's efforts. Preferably main arm lift assist 1299, is connected at one end to main arm 1202, and connected at the other end to main arm carriage 1208, and preferably main arm lift assist 1299 provides lifting assistance when a user is articulating main arm 1202, into a new position around main arm pins 1209. Articulating safety handle 1205 is shown in a different position when compared to FIG. 15, and locked into position with safety handle lock 1206.

Figure 17:
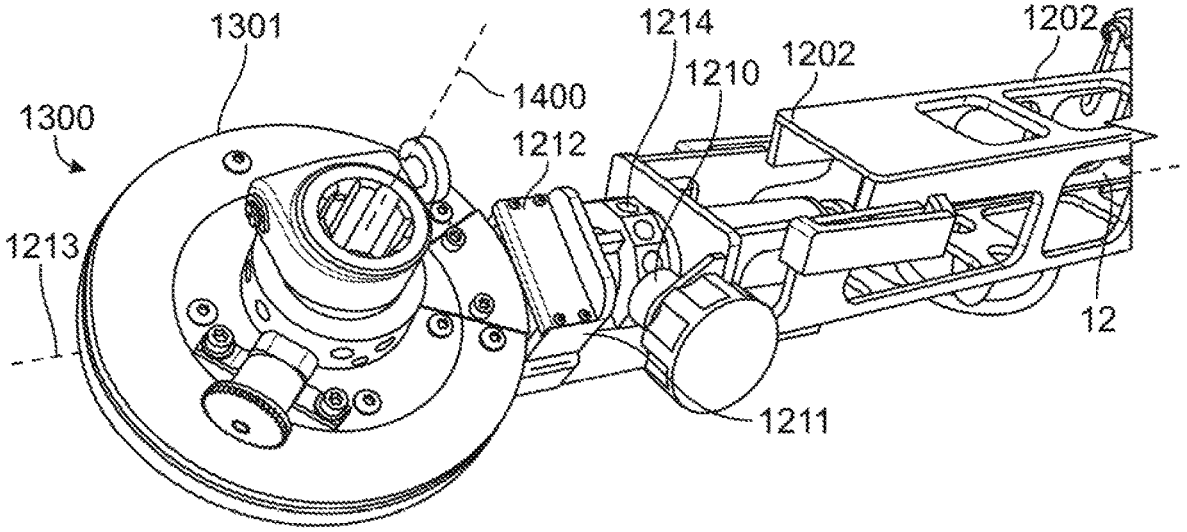
FIG. 17 is a closer view of an embodiment of a rotational resistance assembly with axis of rotation adjusted off vertical.

Referring more particularly to FIG. 17, in one embodiment main arm 1202 comprises tilt lock 1210 mounted on it. Preferably main arm 1202 comprises tilting hub 1211 rotatably mounted on its end. Preferably tilting hub 1211 has rotational resistance assembly 1300 rotatably mounted on its surface. Preferably tilt lock 1210 secures tilting hub 1211 into position around tilting hub axis of rotation 1213 by inserting into tilt lock holes 1214. Preferably adjusting the position of the tilting hub 1211 results in a change in the angle for the attachment extension port axis of rotation 1400 of rotational resistance assembly 1300. Preferably a user can unlock tilt lock 1210, and rotate tilting hub 1211 to any desired angle around tilting hub axis of rotation 1213. Preferably tilting hub axis of rotation 1213 of tilting hub 1211 is coincidental with cable 12, as cable 12 approaches and secures into rotational resistance assembly 1300. Beneath pulley cover 1212, are preferably two pulleys mounted to tilting hub 1211 (not shown in FIG. 17) that guide cable 12 around the perimeter of resistance force translator 1301 when rotational resistance assembly 1300 is rotated. Pulleys 17, which are located under pulley cover 1212 are preferably mounted to tilting hub 1211. Preferably when a user rotates rotational resistance assembly 1300 in clockwise and/or counterclockwise direction, cable 12 will lift weights 14 (not shown in FIG. 17), thus causing weights 14 to give resistance to the rotating motion of rotational resistance assembly 1300.

Figure 18:
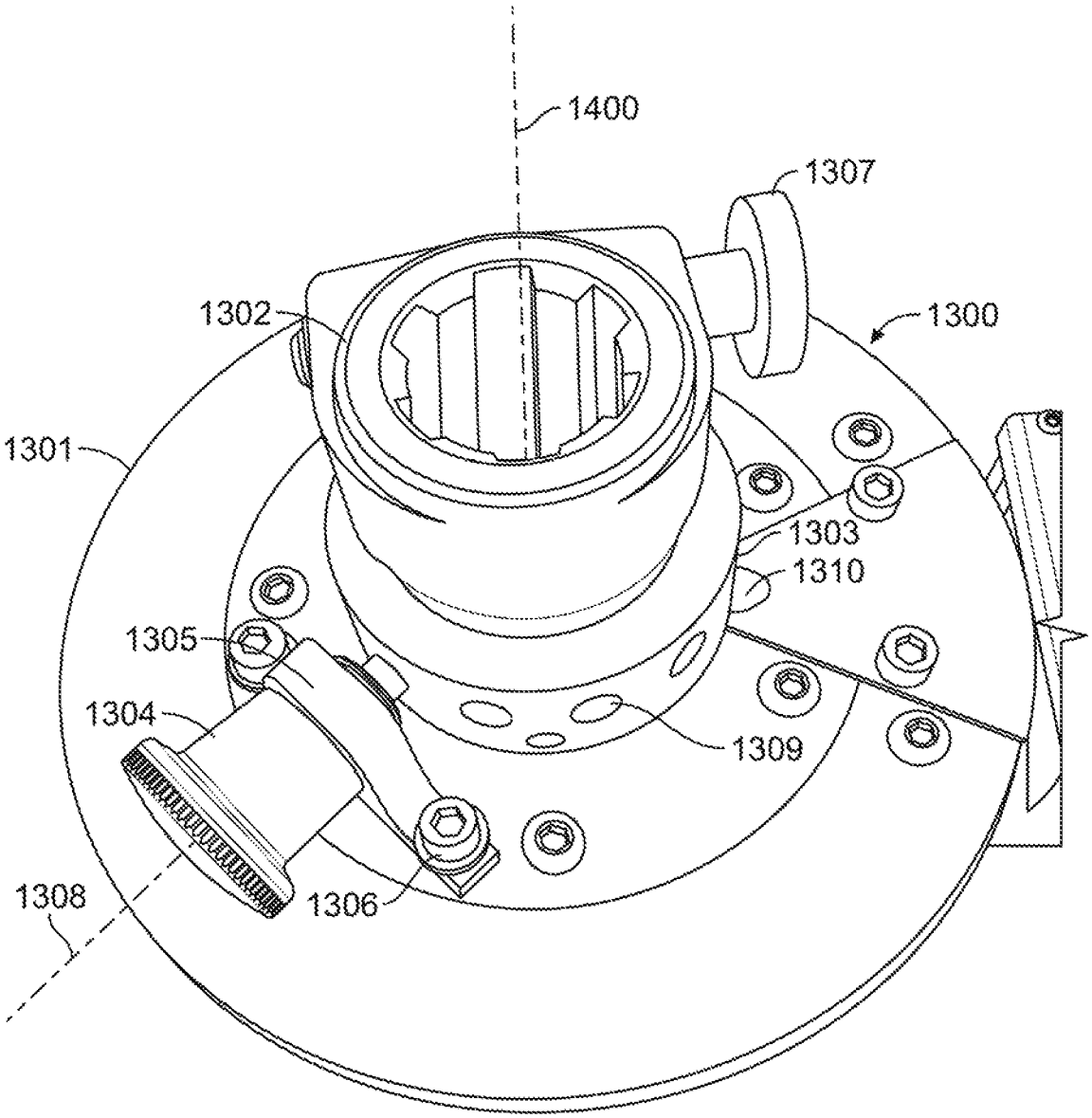
FIG. 18 is a closer view of an embodiment of a rotational resistance assembly.

Referring in more detail to FIG. 18, in one embodiment rotational resistance assembly 1300 preferably comprises attachment extension port 1302 which is rotatably mounted within tilting hub 1211 (not shown in FIG. 18) and optionally rotates around attachment extension port axis of rotation 1400. In one embodiment, attachment extension port 1302 is preferably the location for attaching attachment extension 2100 (not shown in FIG. 18), or other devices which are attachable to attachment extension port 1302. Preferably, attachment extension orientation ring 1303 is secured to attachment extension port 1302 with, for example, a bolt. Optionally attachment extension orientation ring lock 1304 is secured within attachment extension port lock housing 1305, and comprises attachment extension orientation ring lock axis of rotation 1308. Preferably attachment extension port lock housing 1305, is secured to the resistance force translator 1301 with 2, for example, bolts 1306. Optionally attachment extension orientation lock 1304 moves into attachment extension orientation ring hole 1309 which is optionally located on the perimeter of attachment extension orientation ring 1303. Preferably, by a user retracting attachment extension port lock 1304 along attachment extension orientation ring lock axis of translation 1308, then turning the attachment extension port 1302, results in the ability to turn attachment extension port 1302 around attachment extension port axis of rotation 1400, without turning resistance force translator 1301. Preferably, when attachment extension orientation ring lock 1304 is inserted into attachment extension orientation ring hole 1309 and a person rotates attachment extension port 1302, resistance force translator 1301 will rotate as well. In one embodiment, cable ball capture 1310 is a feature within the body of resistance force translator 1301, and secures the end of the cable 12

(not shown in FIG. 18) onto the perimeter of resistance force translator 1301. Preferably when resistance force translator 1301 rotates, cable ball capture 1310 rotates also, causing cable 12 (not shown in FIG. 18) to lift the weights 14, preferably causing the user to experience rotational resistance to their effort. Optionally, attachment extension port 1302 comprises attachment extension port lock 1307 which when engaged by a user, locks an attachment extension 2100 (not shown in FIG. 18), or attachment of choice into attachment extension port 1302, thus making it possible to rotate the attachment extension port 1302 by rotating the attachment extension 2100, or the attachment which is secured to the attachment extension port 1302.

Figure 19:
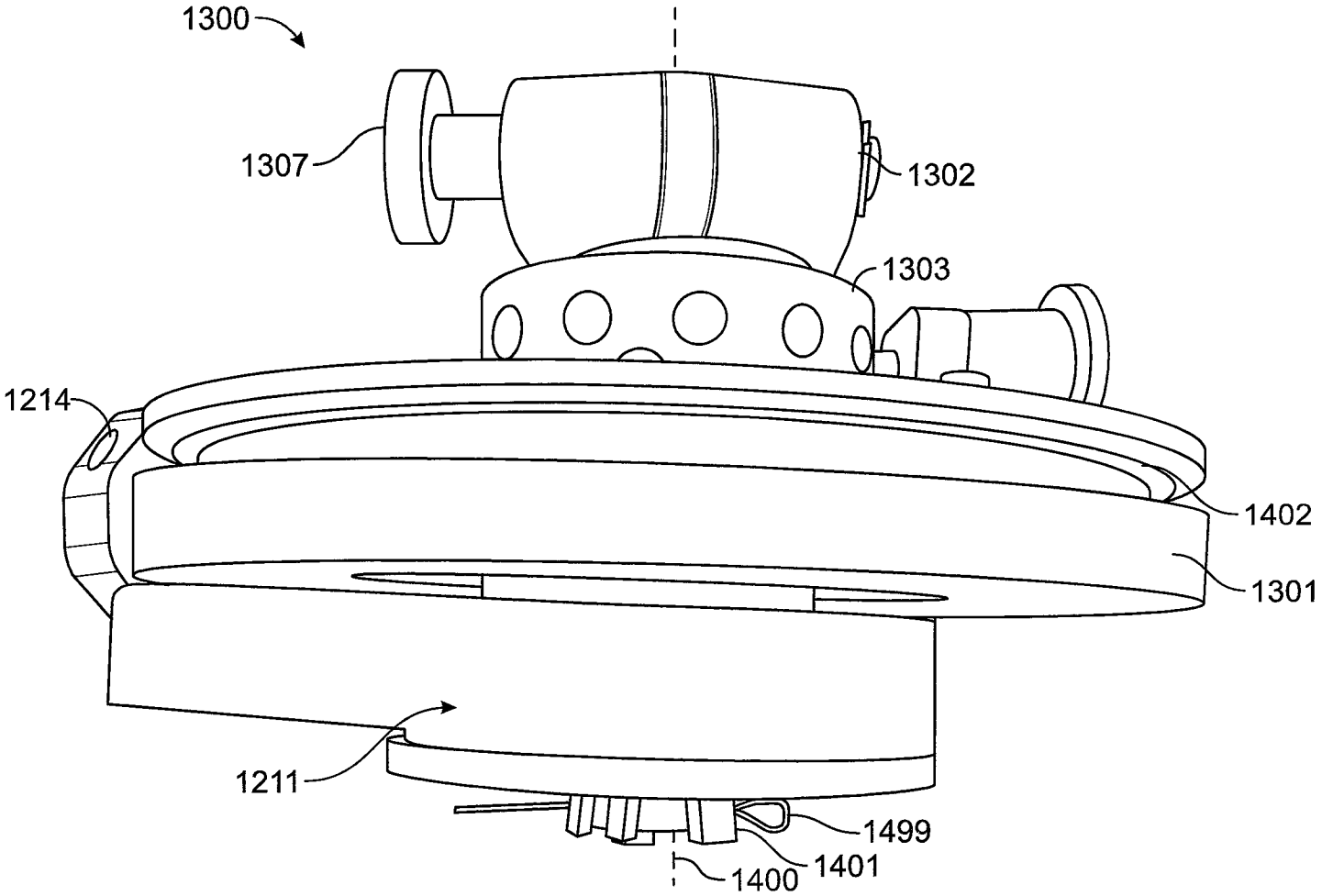
FIG. 19 is a side view of an embodiment of a rotational resistance assembly.

Referring in more detail to FIG. 19, in one embodiment, rotational resistance assembly 1300 comprises tilting hub 1211 which houses bearings (not shown), and preferably the bearings have the same axis of rotation as the attachment extension port axis of rotation 1400. Attachment extension port 1302 passes through the center of attachment extension orientation ring 1303, and through the center of resistance force translator 1301, and through a passage in tilting hub 1211, and through the center of the bearings (not shown) to be secured to tilting hub 1211 by, for example, a nut 1401 and cotter pin 1499 on the underside of tilting hub 1211. Preferably, between tilting hub 1211 and resistance force translator 1301, there is friction reduction material (not shown). Optionally, resistance force translator 1301 comprises resistance force translator groove 1402 on its periphery for capturing cable 12 when it is rotated.

Figure 20:
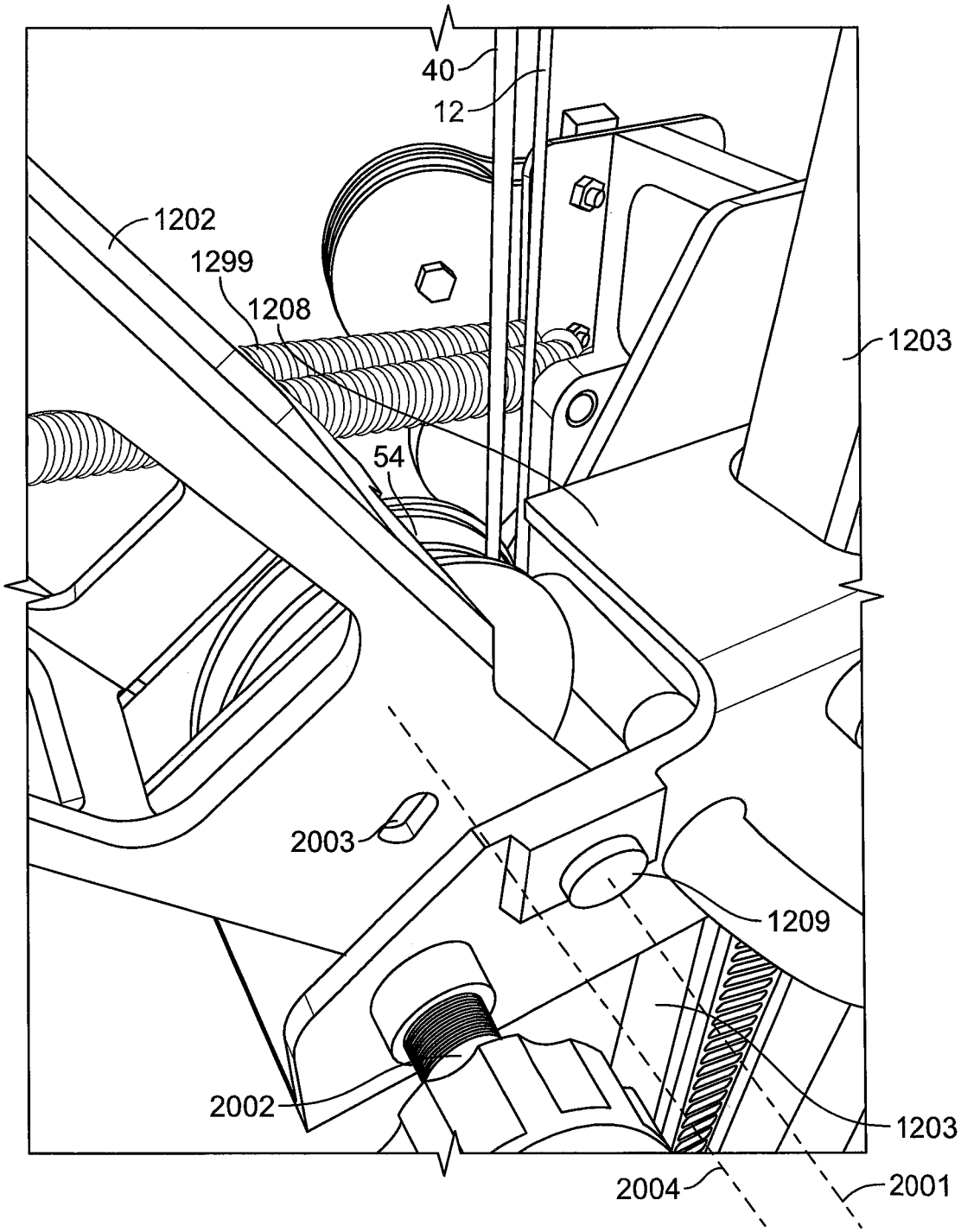
FIG. 20 is a view of an embodiment of a main arm with first pulley.

Referring in more detail to FIG. 20, in one embodiment, main arm 1202 is mounted to main arm carriage 1208 with main arm pins 1209, and main arm 1202 is optionally rotatable about the axis of rotation of main arm pins 2001. Optionally main arm 1202 can be locked into a plurality of positions by engagement of main arm lock 2002 into main arm lock position holes 2003. Preferably, first pulley 54 is mounted onto main arm 1202, and has a first pulley axis of rotation 2004 which is not coincidental with the axis of rotation of main arm pins 2001.

Figure 21:
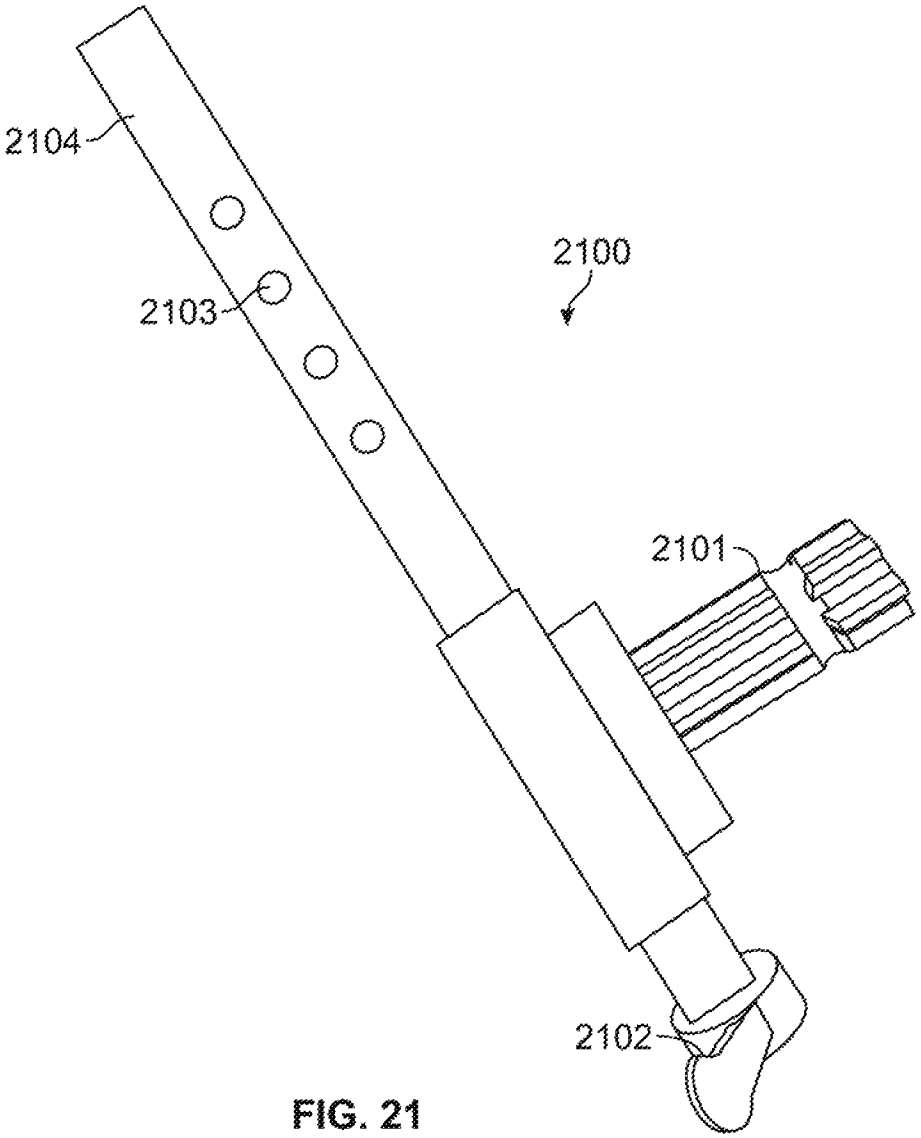
FIG. 21 is a perspective view of an embodiment of an attachment extension.

Referring to FIG. 21, in one embodiment attachment extension 2100, comprises attachment extension port plug 2101, which is optionally attachable to attachment extension port 1302 (not shown in FIG. 21), and optionally further comprises attachment counterweight lock 2102, which optionally secures an attachment counterweight 2601 (not shown in FIG. 21) onto attachment extension 2100, and optionally further comprises attachment securing holes 2103, which allow for the insert of attachment lock pin 2202 (not shown in FIG. 21) onto the attachment extension 2100, and optionally further comprises attachment extension shaft 2104, which inserts into attachment extension shaft receiver 2201 (not shown in FIG. 21).

Figure 22:
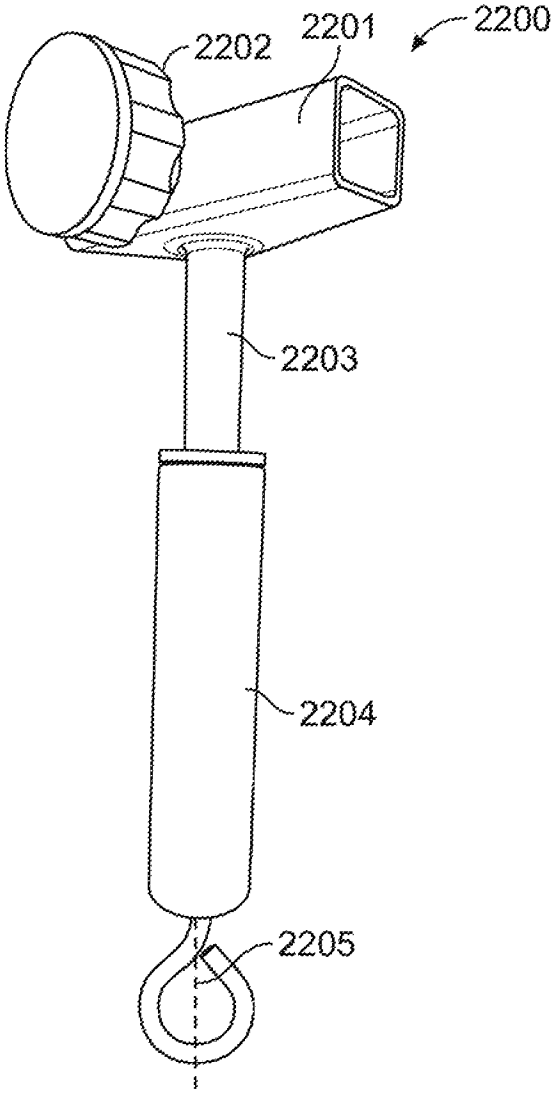
FIG. 22 is a perspective view of an embodiment of a free spinning grip attachment.

Referring to FIG. 22, in one embodiment, free spinning grip attachment 2200, optionally comprises attachment extension shaft receiver 2201, which optionally slides over attachment extension shaft 2104 (not shown in FIG. 22), and optionally comprises attachment lock pin 2202, which inserts into attachment securing holes 2103 (not shown in FIG. 22), and optionally comprises attachment axle 2203, which is optionally secured to attachment extension shaft receiver 2201, and optionally further comprising free spinning grip 2204, which has bearings (not shown) positioned in between free spinning grip 2204, and attachment axle 2203, causing free spinning grip 2204, to spin freely on free spinning grip axis of rotation 2205. Optionally, securing free spinning grip attachment 2200 onto attachment extension 2100, preferably results in free spinning grip axis of rotation 2205, to be parallel to attachment extension port axis of rotation 1400 (not shown in FIG. 22).

In different embodiments of the present invention when the free spinning grip attachment 2200 is installed onto rotational resistance exercise device (not shown), free spinning grip axis of rotation 2205 is not parallel to attachment extension port axis of rotation 1400.

Figure 23:
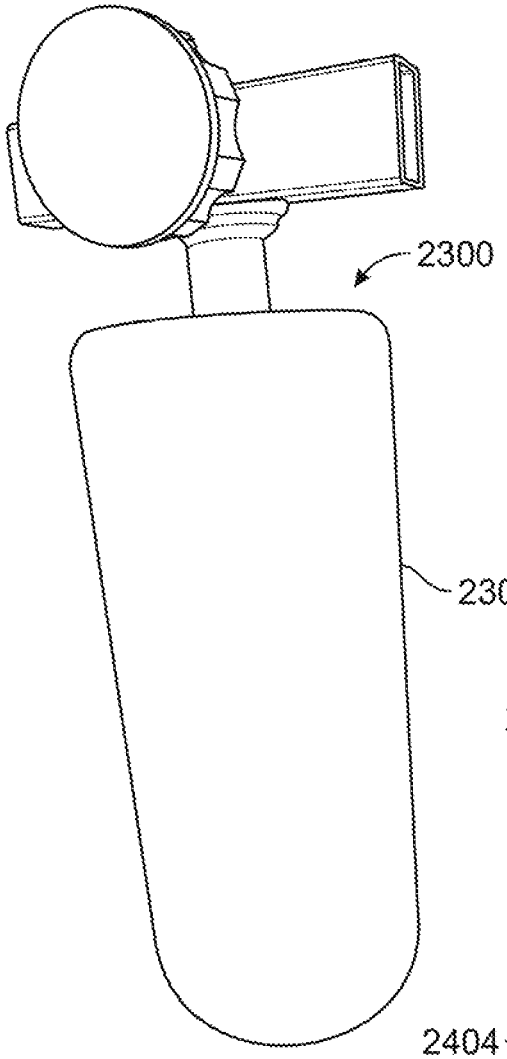
FIG. 23 is a perspective view of an embodiment of a free spinning pad attachment.

Referring to FIG. 23, in one embodiment, free spinning pad attachment 2300, optionally comprises a construction similar to free spinning grip attachment 2200, with the optional exception that free spinning pad 2301 is used in place of free spinning grip 2204 (not shown in FIG. 23).

Figure 24:
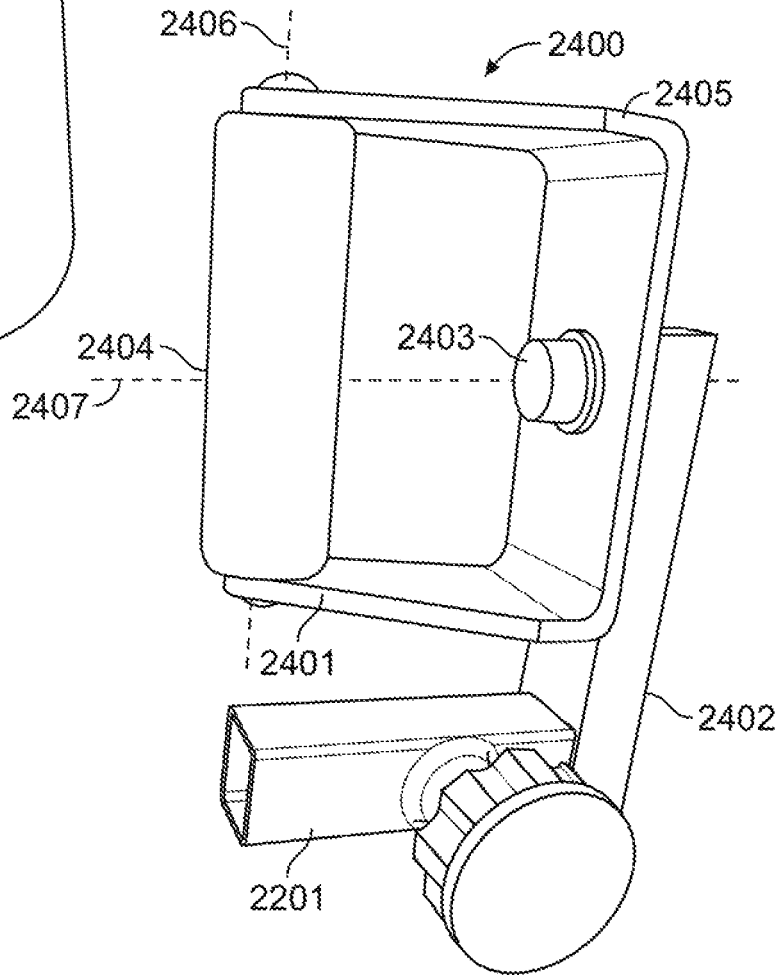
FIG. 24 is a perspective view of an embodiment of a free spinning pad attachment.

Referring to FIG. 24, in one embodiment, free spinning grip attachment 2400 optionally comprises offset grip twist assembly 2401 which is rotatably mounted with axle 2403 passing through attachment extension shaft receiver flange 2402. Offset grip twist assembly 2401 preferably comprises attachment extension shaft receiver flange 2402 mounted in a rigid fashion to its surface at an angle. Offset grip twist assembly 2401 optionally comprises grip 2404, mounted onto offset bracket 2405, and optionally offset bracket 2405 secures grip 2404 into a position such that grip axis of rotation 2406, does not pass through axle axis of rotation 2407.

Figure 25:
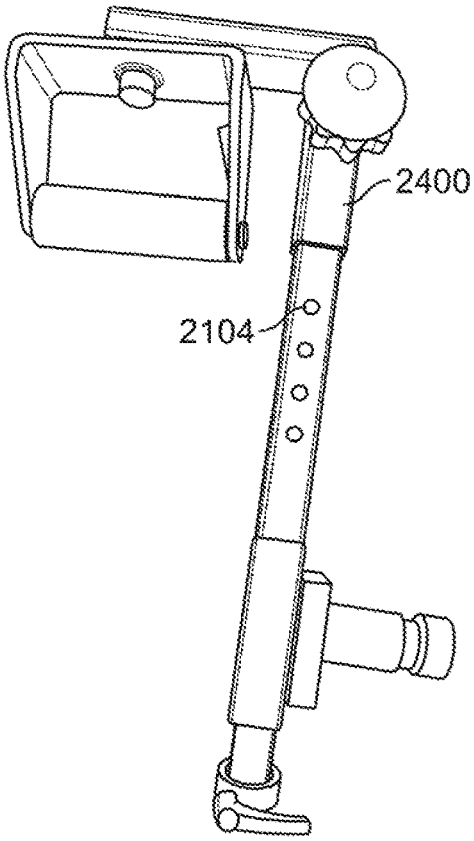
FIG. 25 is a perspective view of an embodiment of a free spinning attachment mounted on an attachment extension shaft.

Referring to FIG. 25, in another embodiment, free spinning grip attachment 2400, is attached to attachment extension shaft 2104.

Figure 26:
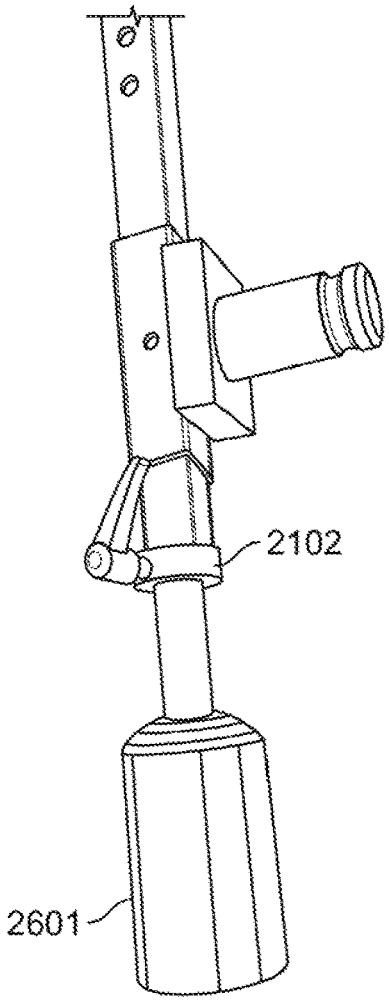
FIG. 26 is a perspective view of an embodiment of an attachment extension and an attachment extension counterweight.

Referring to FIG. 26, in one embodiment, attachment extension counterweight 2601 is installed into attachment extension counterweight lock 2102.

Figure 27:
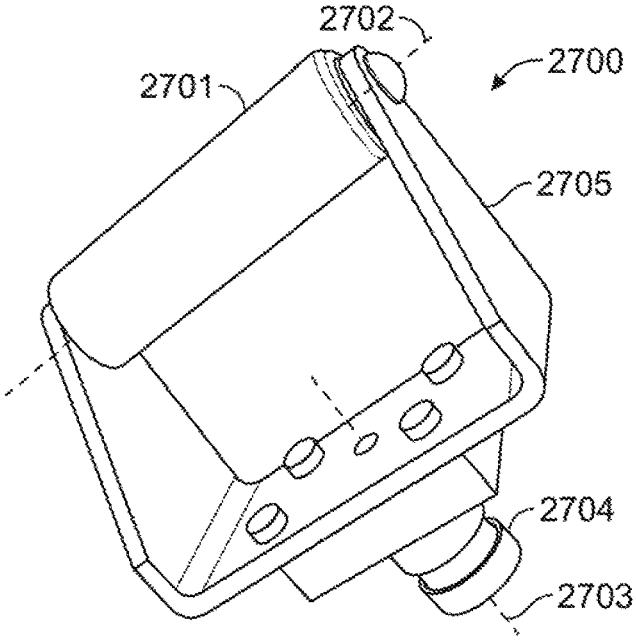
FIG. 27 is a perspective view of an embodiment of a grip twist attachment.

Referring to FIG. 27, in one embodiment, grip twist attachment 2700 optionally comprises grip area 2701 which has a grip area axis of rotation 2702. Grip area 2701 is held in a position by offset flange 2705, such that attachment extension port plug axis of rotation 2703 does not intersect grip area axis of rotation 2702. Optionally attachment extension port plug 2704 is attachable to attachment extension port 1302 (not shown), such that preferably when a person rotates grip twist attachment 2700, they receive exercise from the rotational resistance.

In another embodiment of a grip twist attachment, the attachment extension port plug axis of rotation 2703, does intersect the grip area axis of rotation 2702.

Figure 28:
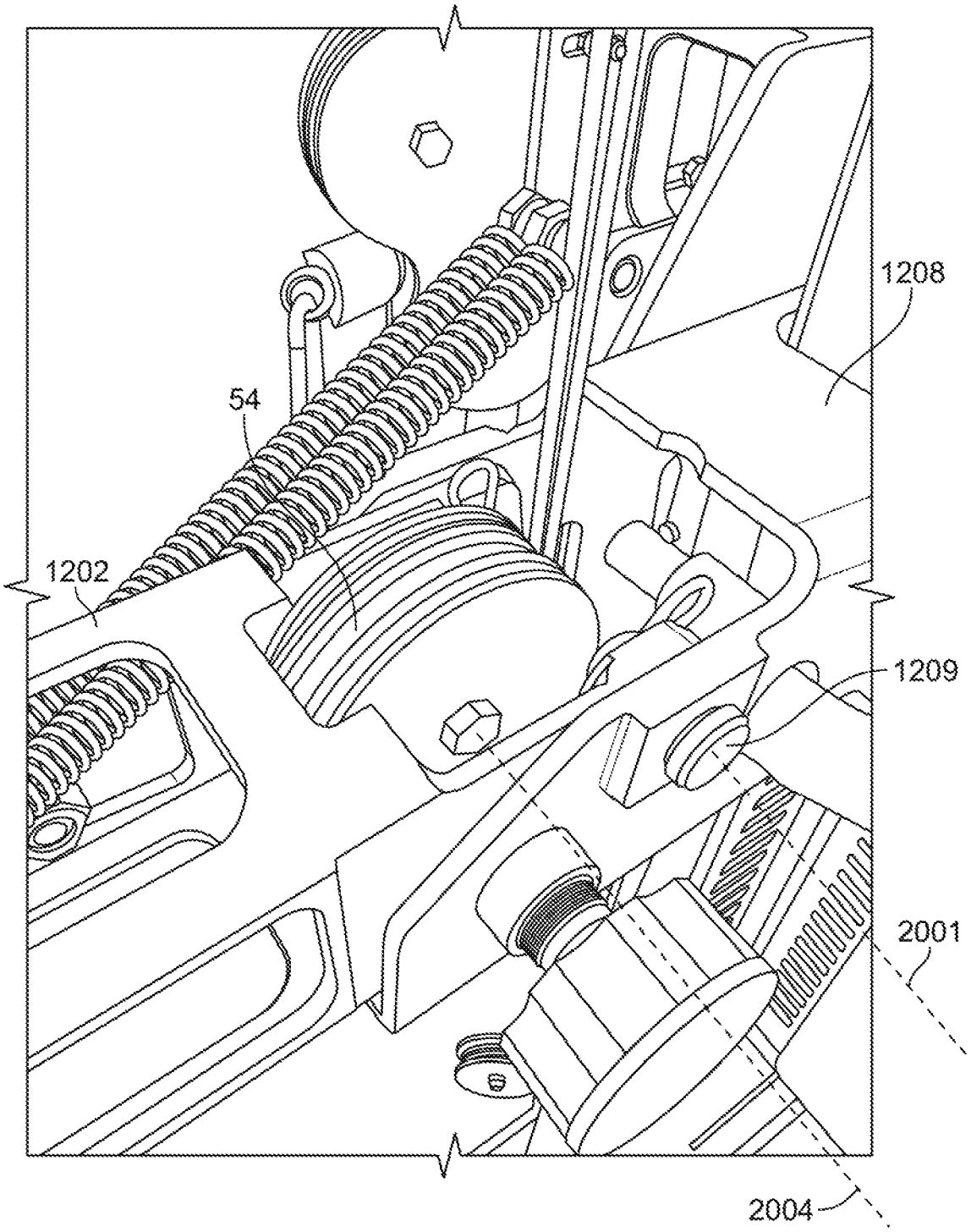
FIG. 28 is a closer view of an embodiment of the main arm and first pulley.

Referring to FIG. 28, in one embodiment, main arm 1202 is rotatably mounted to main arm carriage 1208 with main arm pins 1209. First pulley 54 has first pulley axis of rotation 2004, and main arm pins 1209 have axis of rotation of main arm pins 2001 and the two axes of rotation are not coincidental. First pulley 54 is preferably mounted to main arm 1202 such that when main arm 1202 rotates around the axis of rotation of main arm pins 2001 first pulley 54 will be moved in circular path around the axis of rotation of main arm pins 2001. In another embodiment, the two axes of rotation are coincidental.

Figure 29:
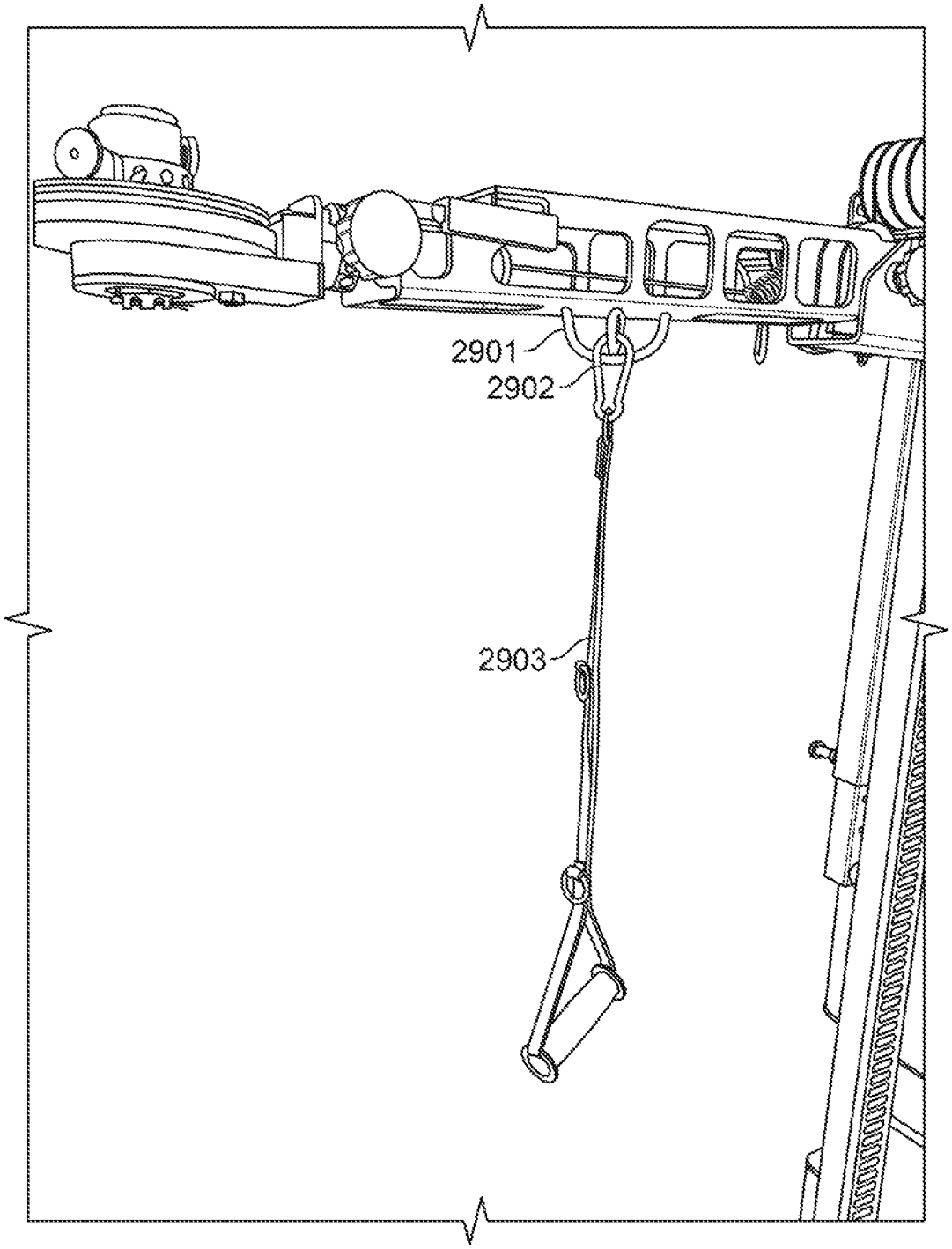
FIG. 29 is a perspective view of an embodiment of an attachment point.

Referring to FIG. 29, in one embodiment, attachment point 2901 is secured to main arm 1202 preferably providing a location for a person to safely secure, for example, carabiner 2902, and/or a rope 2903. In another embodiment, attachment point 2901 is secured to a different part of the invention.

Figure 30:
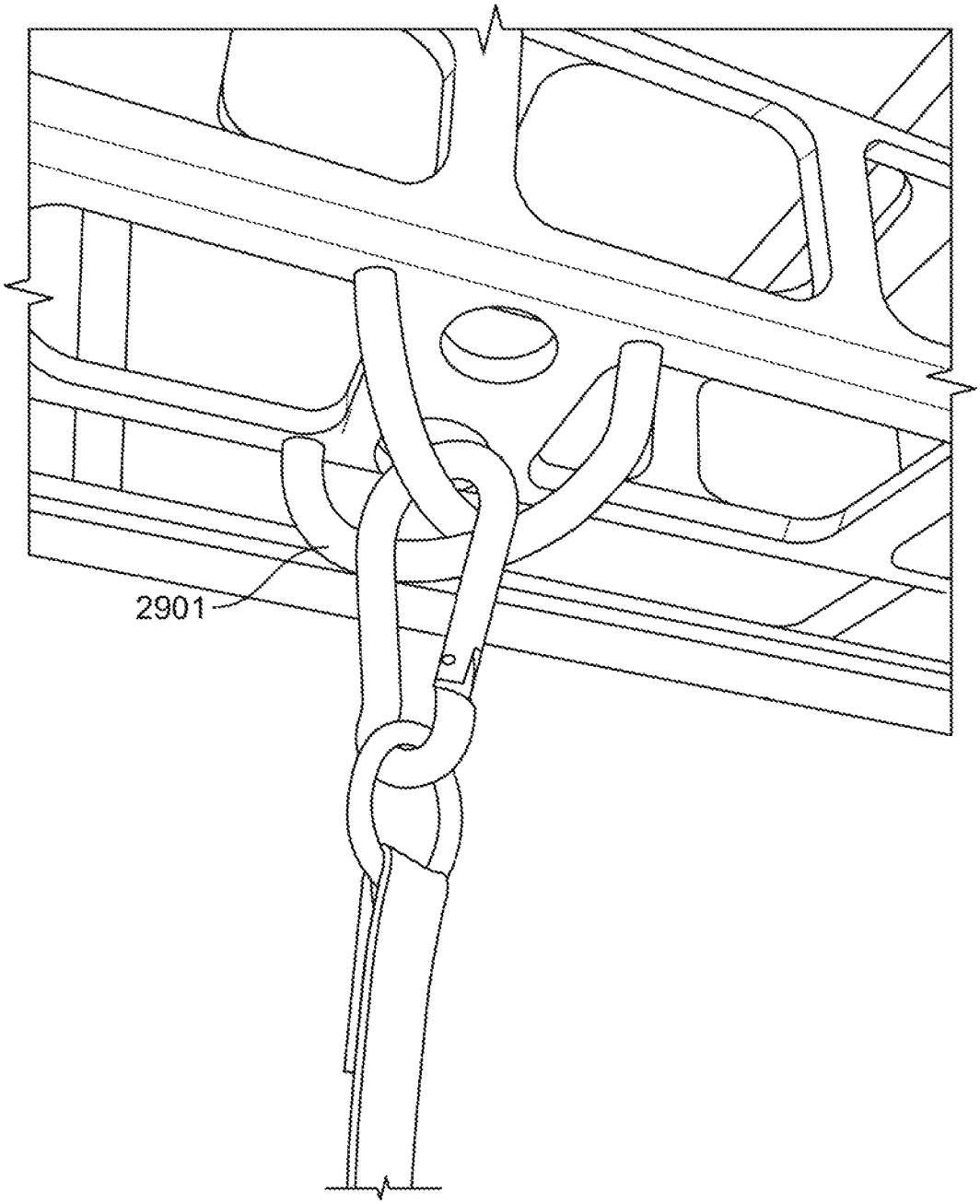
FIG. 30 is a closer vie of an embodiment of an attachment point.

Referring to FIG. 30, attachment point 2901 provides multiple features for a person to utilize.

Figure 31:
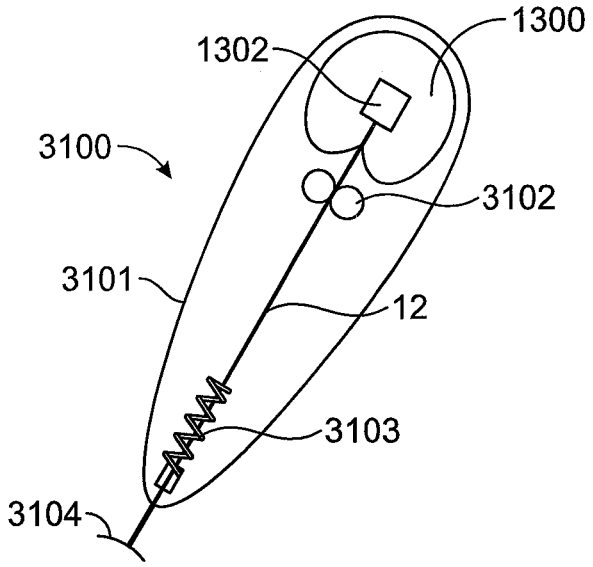
FIG. 31 is a top view of an embodiment of a rotational resistance exercise apparatus within a housing.

Referring to FIG. 31, in one embodiment, a rotational resistance exercise apparatus 3100 comprises housing 3101. Contained within housing 3101 are features such as pulleys 3102, which are rotatably mounted to housing 3101, and optionally also within housing 3101 a rotational resistance assembly 1300, which is rotatably mounted to the housing. Preferably contained within the housing is cable 12, which preferably attaches to spring 3103 at one end and attaches to rotational resistance assembly 1300 at the other end. Spring 3103 attaches at one end to spring tension adjuster 3104, such that when spring tension adjuster 3104 it rotated, it will tighten or loosen the tension on spring 3103. Attachment extension port 1302 extends outside housing 3101, preferably providing access for a user to attach a type of attachment for exercise. Preferably when attachment extension port 1302 is rotated by a user, cable 12 will be wrapped around the perimeter of rotational resistance assembly 1300, and spring 3103 will be stretched by the movement of cable 12, thus giving the user resistance for exercise.

In another embodiment, the spring 3103 is mounted directly to housing 3101 and optionally spring tension adjuster 3104 is not present.

In another embodiment spring 3103 is interchangeable.

Figure 32:
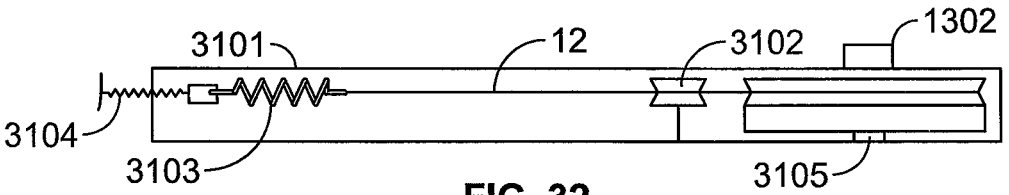
FIG. 32 is a side view of an embodiment of a rotational resistance exercise apparatus within a housing.

Referring to FIG. 32, a side view of FIG. 31 is shown with spring tension adjuster 3104 threaded into the side of the housing 3101 such that when it is rotated, it extends or retracts spring 3103. Bearings 3105 secure the rotational resistance assembly 1300 rotatably to housing 3101.

Figure 33:
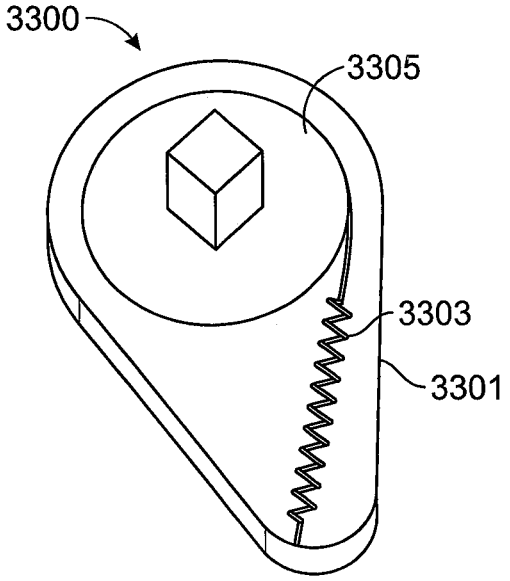
FIG. 33 is a perspective view of an embodiment of a rotational resistance exercise apparatus within a housing.

Referring to FIG. 33, in one embodiment, preferably a rotational resistance exercise apparatus 3300 within a housing 3301 comprises spring 3303, mounted at one end to housing 3301, and to the rotational resistance assembly 3305 at the other end.

In another embodiment, optionally spring 3303 is mounted to rotational resistance assembly 3305 at one end, and to a spring tension adjuster (not shown) at the other end.

Figure 34:
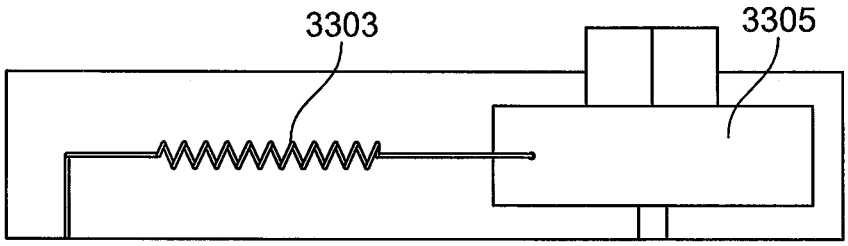
FIG. 34 is a side view of an embodiment of a rotational resistance exercise apparatus within a housing.

Referring to FIG. 34, spring 3303 wraps around the perimeter of rotational resistance assembly 3305 when rotational resistance assembly 3305 is rotated by a user.

In another embodiment, flexible material (not shown) used in place of spring 3103.

Figure 35:
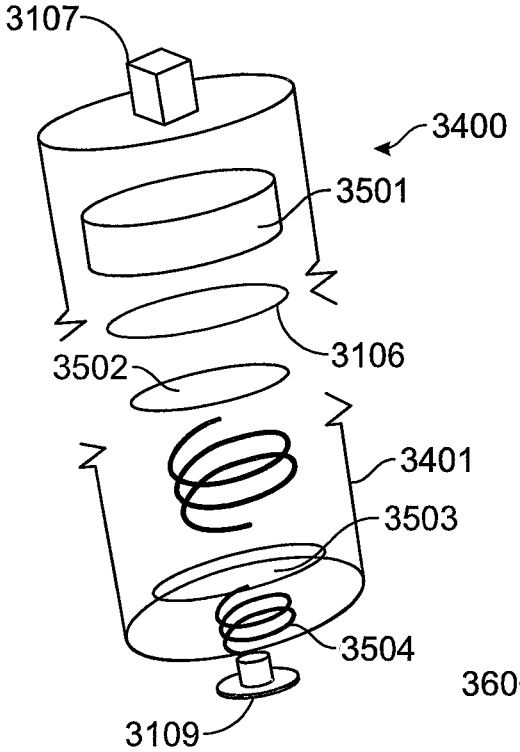
FIG. 35 is an exploded view of an embodiment of a rotational resistance exercise apparatus within a housing.

Referring to FIG. 35, optionally an embodiment of rotational resistance exercise apparatus 3400 comprises housing 3401, and friction material 3106, which provides resistance for a user when they rotate resistance output shaft 3107. Resistance output shaft 3107 is where a person can attach an attachment of their choice (not shown). Optionally tension adjuster 3109, when rotated, will press the friction material 3106 sandwiched between friction components 3501, 3502, and 3503 via springs 3504 against resistance output shaft 3107 thus causing resistance to the rotation of resistance output shaft 3107. Optionally, tension adjuster 3109 is threaded into housing 3101, and resistance output shaft 3107 is rotatably mounted to housing 3101 with a portion of resistance output shaft 3107 extending outside housing 3101.

Figure 36:
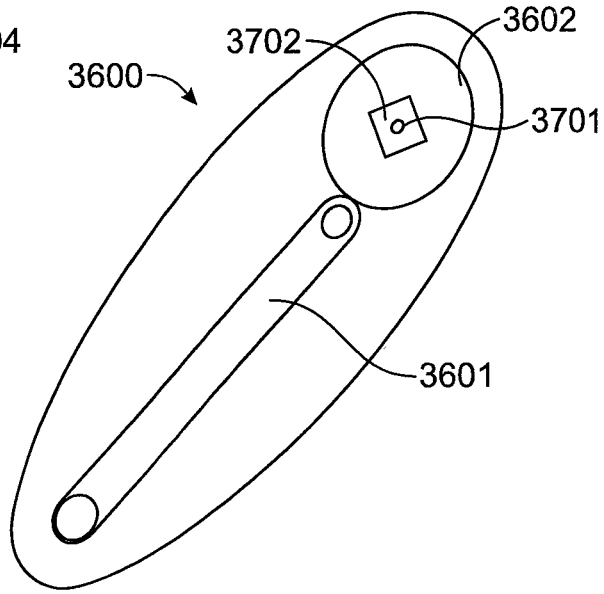
FIG. 36 is a top view of an embodiment of a rotational resistance exercise apparatus within a housing.

Referring to FIG. 36, optionally an embodiment of a rotational resistance exercise apparatus 3600 comprises a housing and a flexible material 3601 which is attached to the housing at one end, and attached to wheel 3602 at the other end. When wheel 3602 is rotated about the wheel axis of rotation 3701, flexible material 3601 is wrapped around the perimeter of wheel 3602. Wheel 3602 is rotatable mounted to the housing. Wheel 3602 optionally comprises protrusion 3702 which extends outside the housing.

Optionally protrusion 3702 provides a place a person can secure an attachment (not shown) to the wheel.

Figure 37:
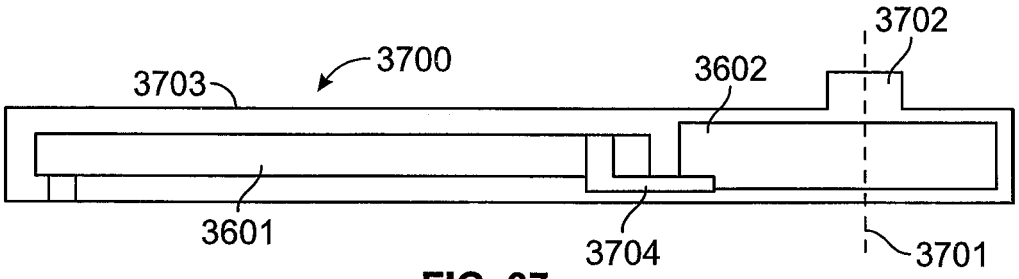
FIG. 37 is a top view of an embodiment of a rotational resistance exercise apparatus within a housing.

Referring to FIG. 37, optionally an embodiment of a rotational resistance exercise apparatus 3700 comprising housing 3703 comprises wheel axis of rotation 3701. Connecting an attachment (not shown) to protrusion 3702 will allow a user to rotate wheel 3602. Wheel 3602 is preferably connected to flexible material 3601 with connecting link 3704. Flexible material 3601 is connected to housing 3101 at an opposite end. When a person rotates the attachment (not shown) the rotational resistance experienced will be around the wheel axis of rotation 3701. In one embodiment, an attachment is attachment extension 2100 (shown in Fig. 21).

Figure 38:
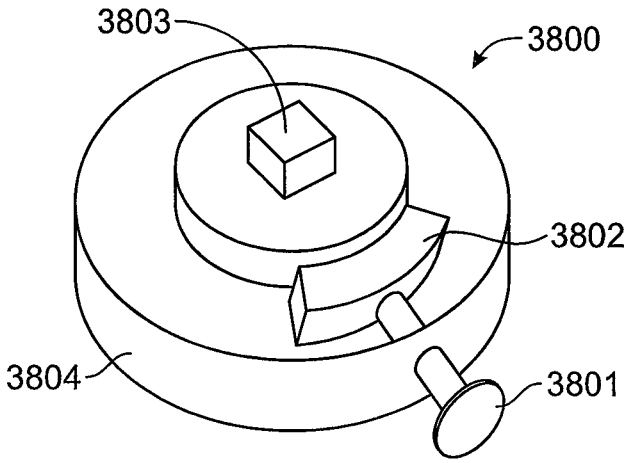
FIG. 38 is a perspective view of an embodiment of a rotational resistance exercise apparatus within a housing.

Referring to FIG. 38, in one embodiment, a rotational resistance exercise apparatus 3800 inside housing 3804 comprises tension adjustment screw 3801 threaded into housing 3101. Preferably friction material 3802 is pressed into rotational resistance output 3803 by a user rotating tension adjustment screw 3801. Rotational resistance output 3803 is rotatably mounted to housing 3804. When a user rotates the rotational resistance output 3803, they will work against the friction of the apparatus. Rotational resistance output 3803 preferably allows a person to attach a choice or exercise attachments.

Figure 39:
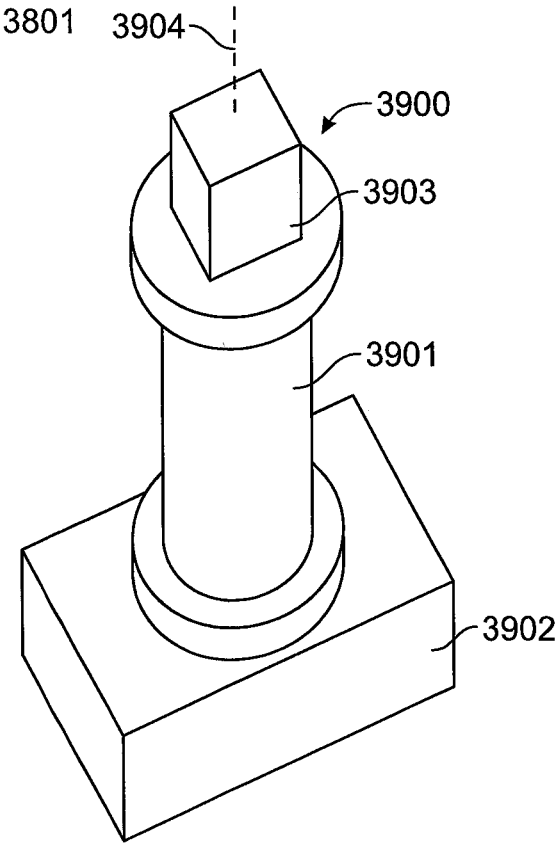
FIG. 39 is a perspective view of an embodiment of a rotational resistance exercise apparatus in a resting state.

Referring to FIG. 39, in one embodiment, a rotational resistance exercise apparatus 3900 comprises flexible material 3901, which is attached at one end to a base 3902 and optionally attached at the other end to attachment connecting point 3903. Optionally, flexible material axis of rotation 3904 is the axis around which a person could rotate attachment connecting point 3903 and cause a twisting effect upon flexible material 3901. The twisting effect preferably gives the user rotational resistance to work against. In one embodiment, base 3902 is held stationary by a frame (not shown). In another embodiment, the frame (not shown) is adjustable to secure it to a fixed object.

Figure 40:
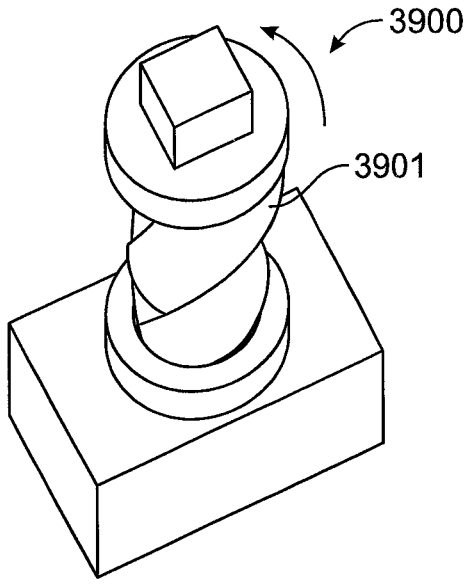
FIG. 40 is a perspective view of an embodiment of a rotational resistance exercise apparatus within a housing in a rotated position.

Referring to FIG. 40, in one embodiment, rotational resistance exercise apparatus 3900 optionally comprises flexible material 3901 which becomes deformed when it is rotated counterclockwise as depicted by the directional arrow.

Figure 41:
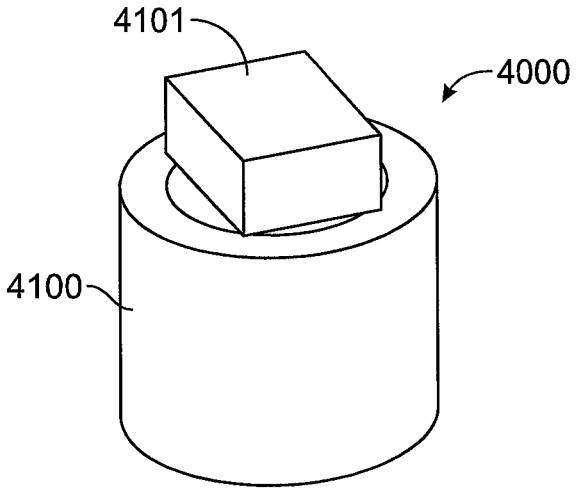
FIG. 41 is a perspective view of an embodiment of a rotational resistance exercise apparatus within a housing.

Referring to FIG. 41, in one embodiment, rotational resistance exercise apparatus 4000 optionally comprises housing 4100, which comprises resistance output 4101 rotatably mounted on it. Optionally, within the housing is an electrically operated rotational resistance source (not shown). The electrically operated rotational resistance source (not shown) is mounted within housing 4100. The electrically operated rotational resistance source (not shown) resists the rotation of resistance output 4101. When a person tries to rotate resistance output 4101, the electrically operated rotational resistance source (not shown) will resist their rotational effort in an opposing direction. Preferably, the result of attempting to rotate resistance output 4101 results in a beneficial exercise for the user. Preferably, an attachment can be mounted onto resistance output 4101.

Figure 42:
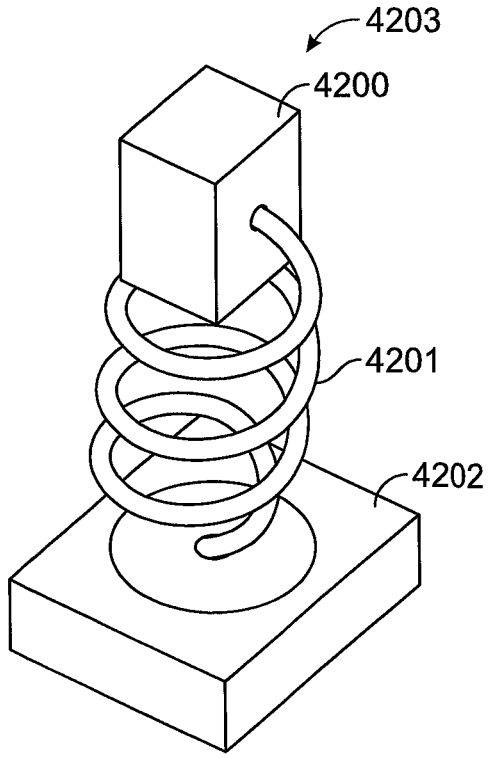
FIG. 42 is a perspective view of an embodiment of a rotational resistance exercise apparatus within a housing.

Referring to FIG. 42, in one embodiment, rotational resistance exercise apparatus 4203 optionally comprises attachment location 4200 connected to one end of torsion spring 4201, and optionally torsion spring 4201 is connected at the other end to base 4202. Rotating attachment location 4200 preferably results in torsion spring 4201 being stressed. Optionally, base 4202 will be held stationary. Optionally, attachment location 4200 secures to an attachment (not shown). Optionally, base 4202 secures to a stationary object by, for example, a clamp (not shown), etc.

Figure 43:
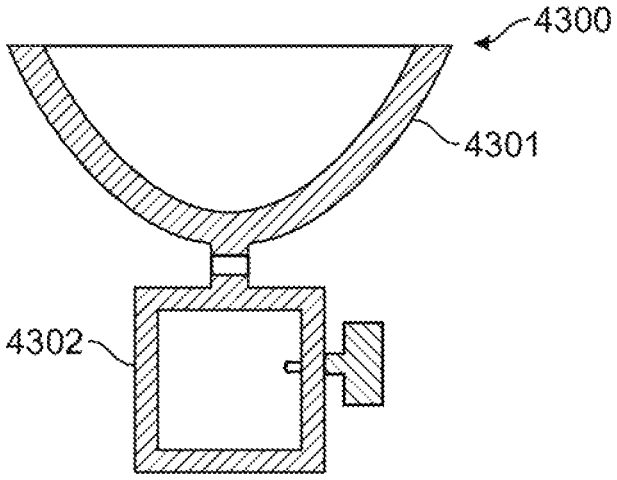
FIG. 43 is a sectional view of an embodiment of a free spinning dish attachment.

Referring to FIG. 43, in one embodiment, free spinning dish attachment 4300 comprises dish 4301 which is optionally rotatably mounted onto attachment extension receiver 4302. Optionally, attachment extension receiver 4302 is secured to an attachment extension (not shown). In another embodiment, free spinning dish attachment 4300 is mounted to attachment extension receiver 4302 in a non-rotatable fashion.

Figure 44:
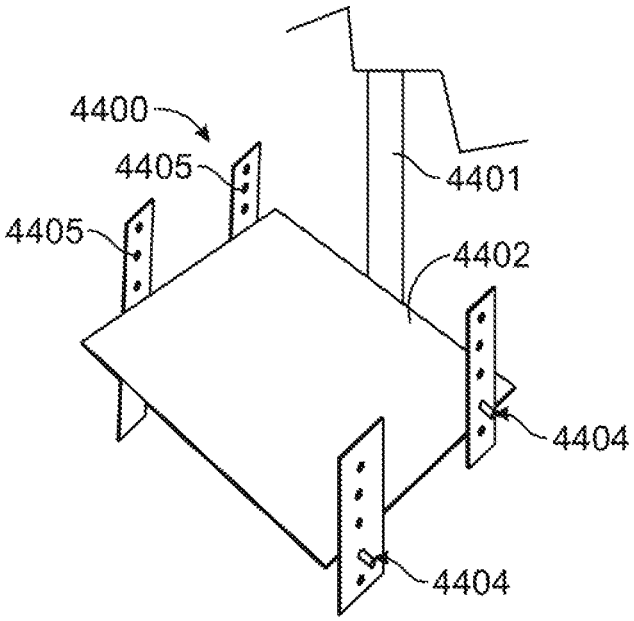
FIG. 44 is a perspective view of an embodiment of an adjustable standing platform.

Referring to FIG. 44, in one embodiment, adjustable standing platform 4400 preferably comprises frame 4401 which is connectable to a frame (not shown). Preferably, adjustable standing platform 4400 further comprises standing platform 4402, which is held at an elevation of choice by pins 4404, with the pins being held up by selection holes 4405. Standing platform 4400 optionally provides a place for a person to stand, sit or lay down upon at choice of elevation.

Figure 45:
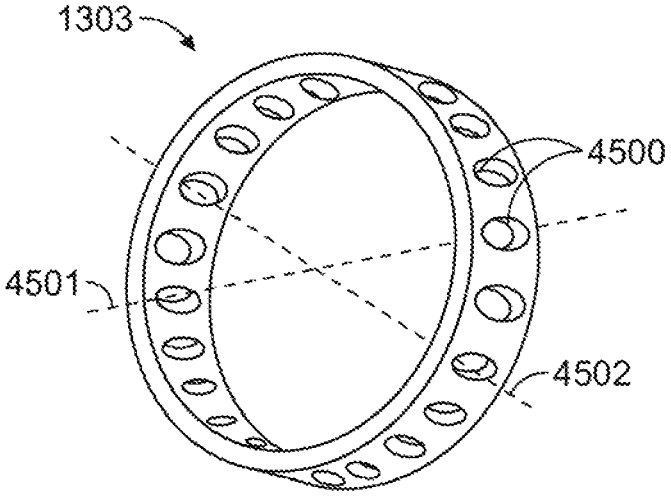
FIG. 45 is a perspective view of an embodiment of an attachment extension orientation ring.

Referring to FIG. 45, in one embodiment, attachment extension orientation ring 1303, optionally comprises attachment extension orientation ring holes 4500 which are oriented with the hole axis of rotation 4502, intersecting attachment extension orientation ring axis of rotation 4501.

Figure 46:
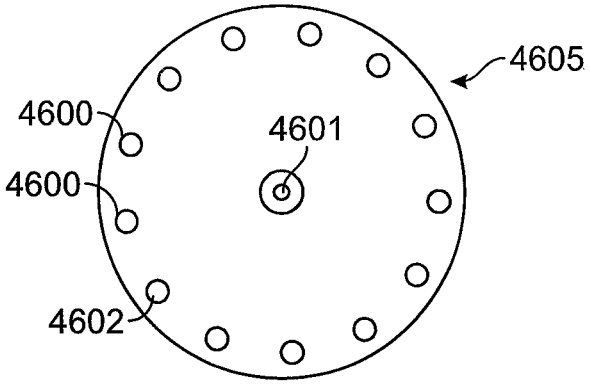
FIG. 46 is a front view of an embodiment of an attachment extension orientation ring.

Referring to FIG. 46, in one embodiment, attachment extension orientation ring 4605, similar to attachment extension orientation ring 1303 previously described, optionally comprises attachment extension orientation ring holes 4600, which are oriented with hole axis of rotation 4602 not intersecting attachment extension orientation ring axis of rotation 4601.

Figure 47:
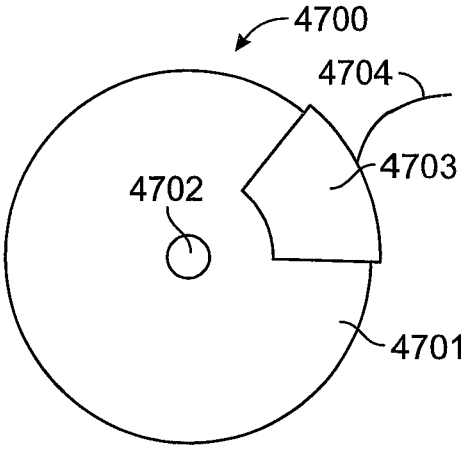
FIG. 47 is a front view of an embodiment of rotational resistance with friction.

Referring to FIG. 47, in one embodiment, rotational resistance with friction 4700 optionally comprises wheel 4701 which is rotatably mountable around center of rotation 4702, and further comprises friction material 4703 which presses against wheel 4701. Friction adjuster 4704 optionally adjusts the amount of force friction material 4703 places upon the wheel 4701. Wheel 4701 is preferably connectable to an attachment (not shown). When an attachment (not shown) rotates wheel 4701 the attachment will work against the friction produced by the pressure of friction material 4703 against wheel 4701.

Figure 48:
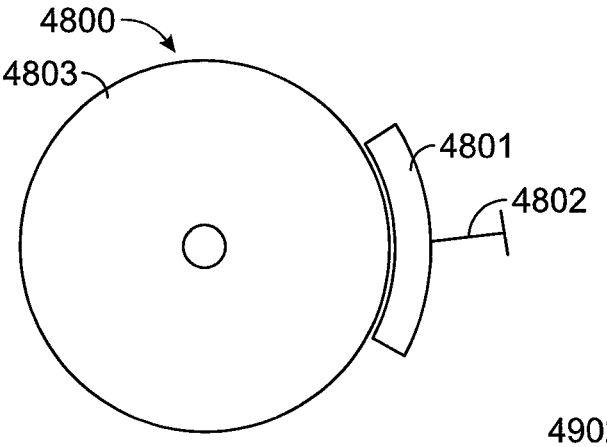
FIG. 48 is a front view of an embodiment of rotational resistance with friction.

Referring to FIG. 48, in one embodiment, rotational resistance with friction 4800 optionally comprises friction material 4801 which presses against the periphery of wheel 4803. The amount of pressure friction material 4801 places upon wheel 4803 is adjustable by friction pressure knob 4802.

Figure 49:
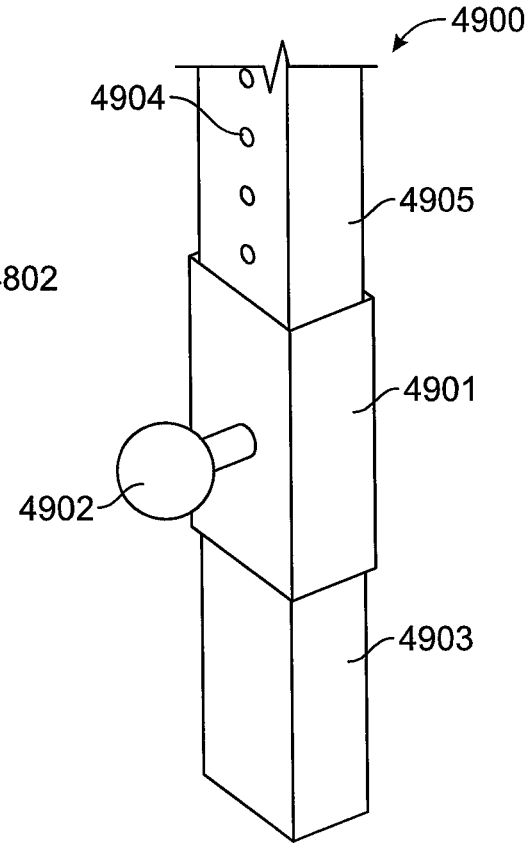
FIG. 49 is a perspective view of an embodiment of an attachment extension port extension.

Referring to FIG. 49, in one embodiment, attachment extension port extension 4900 optionally comprises attachment extension port plug 4903, which optionally inserts into an attachment extension port (not shown), and optionally is secured to attachment extension sleeve 4901. Attachment extension port extension 4900 further comprises extension arm 4905 which slides in and out of extension arm sleeve 4901, and further optionally comprises attachment extension lock 4902, which is secured to the extension arm sleeve 4901, and further optionally embodies extension arm selector holes 4904. Preferably by engaging attachment extension lock 4902 into extension arm selector hole 4904, extension arm 4905 will be supported in an extended position. Extension arm 4905 is optionally attachable to an attachment (not shown).

Figure 50:
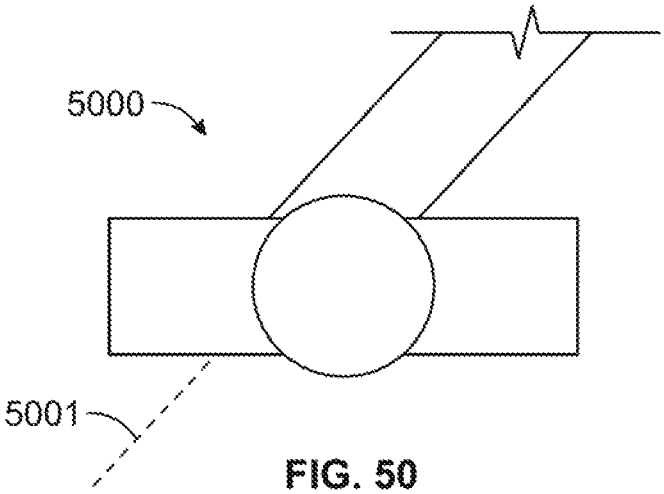
FIG. 50 is a front view of an embodiment of an off parallel axis attachment.

Referring to FIG. 50, in one embodiment, off parallel axis attachment 5000 preferably comprises an attachment which optionally attaches to an attachment extension such as extension 2100 previously described (not shown). Preferably, axis of rotation 5001 is in a direction not parallel to the axis of rotation of the rotational resistance (not shown).

Figure 51:
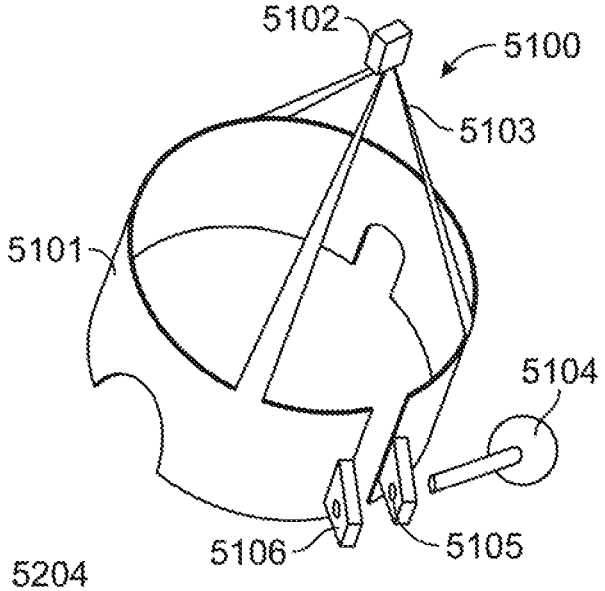
FIG. 51 is a perspective view of an embodiment of a head clamp attachment.

Referring to FIG. 51, in one embodiment, head clamp attachment 5100 optionally comprises head ring 5101, which preferably encompasses a person's head (not shown). Furthermore, head clamp attachment 5100 optionally comprises attachment extension port plug 5102 which is connected to head ring 5101 by, for example, head ring rails 5103, and is connectable to rotational resistance exercise apparatus. Head clamp attachment 5100 optionally comprises size adjustment knob 5104 which passes through tab 5105 which is mounted on one side of head ring 5101, and threads into weld nut 5106 on the other side of head ring 5101. Preferably, when a person places their head into head ring 5101 and turns size adjustment knob 5104, they can tighten head ring 5101 onto their head.

Figure 52:
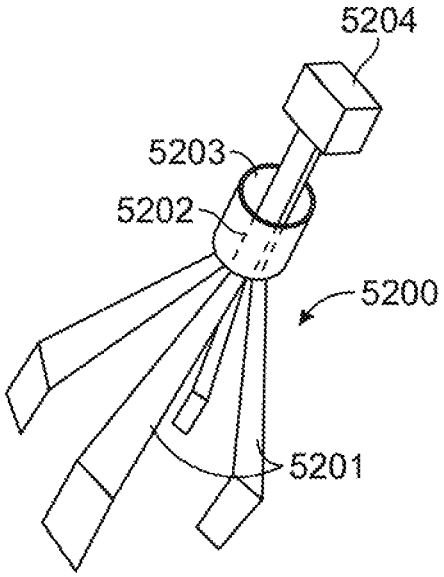
FIG. 52 is a perspective view of an embodiment of a head clamp attachment.

Referring to FIG. 52, in one embodiment, head clamp attachment 5200 optionally comprises attachment extension port plug 5204 which is mounted to head clamp rod 5203, and head clamp rod 5203 is optionally mounted to head clamp fingers 5201. Head clamp rod 5203 optionally has threads (not shown) around its exterior. Head clamp adjustment ring 5202 rotates around head clamp rod 5203 and threads along the threads of head clamp rod 5203. Preferably, when head clamp adjustment ring 5202 comes into contact with head clamp fingers 5201, head clamp fingers 5201 will come closer together or farther apart. Head clamp fingers 5201 preferably close against a person's head. When a person wearing the head clamp attachment upon their head rotates their head, head clamp attachment 5200 will rotate.

Figure 53:
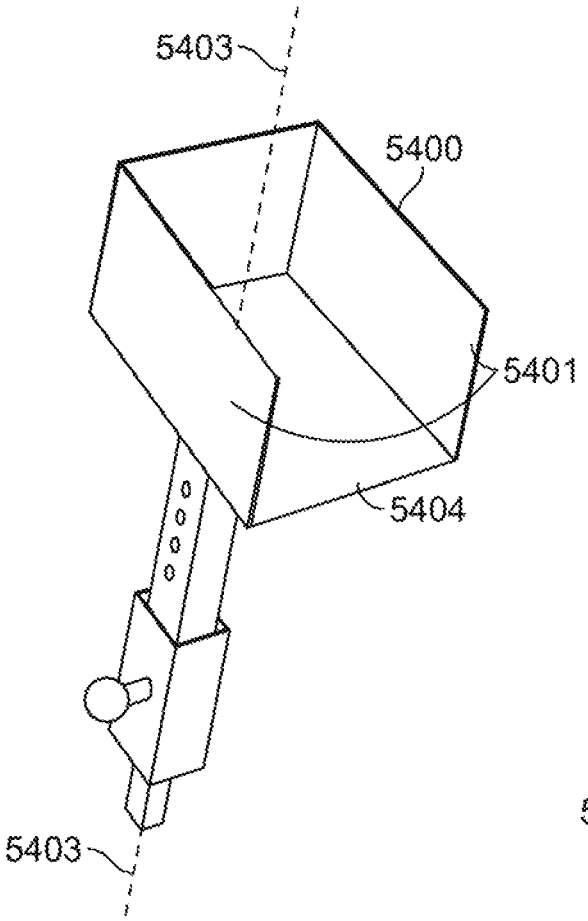
FIG. 53 is a perspective view of an embodiment of a femur rotation attachment combined with an attachment extension port extension.

Referring to FIG. 53, in one embodiment, femur rotation attachment 5400 is optionally attached to attachment an extension port, such as extension 4900 previously described. Preferably, the height of femur rotation attachment 5400 is adjustable when the height of attachment extension port extension 4900 is adjusted. Femur rotation attachment 5400 preferably comprises pressure surface 5401, which a person can press their body against causing rotation of femur rotation attachment 5400 about the femur rotation attachment axis of rotation 5403. Optionally, resting surface 5404 comprises a surface upon which a person can rest a part of their body.

Figure 54:
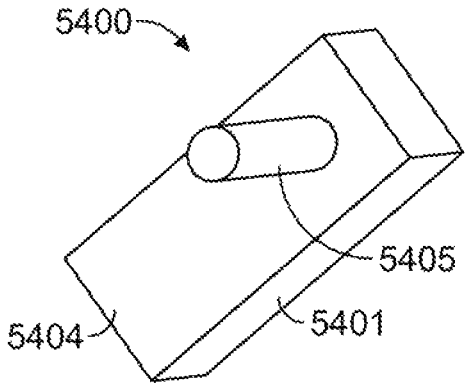
FIG. 54 is a perspective view of an embodiment of the underside of a femur rotation attachment.

Referring to FIG. 54, in one embodiment, femur rotation attachment 5400 optionally comprises attachment extension port plug 5405, which is optionally connectable to an attachment extension port (not shown).

Figure 55:
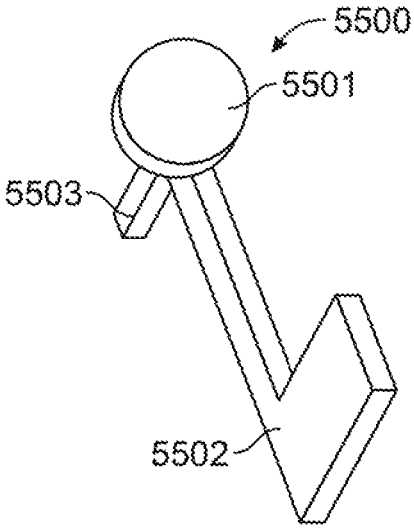
FIG. 55 is a perspective view of an embodiment of a paddle rotation attachment.

Referring to FIG. 55, in one embodiment, paddle rotation attachment 5500 optionally comprises resting pad 5501, pressing paddle 5502, and attachment extension port plug 5503. Attachment extension port plug 5503 is preferably connectable to an attachment extension port (not shown). Attachment extension port plug 5503 is preferably connected to resting pad 5501, and resting pad 5501, is connected to pressing paddle 5502. Preferably, when a person presses against pressing paddle 5502, attachment extension port plug 5503 rotates.

Figure 56:
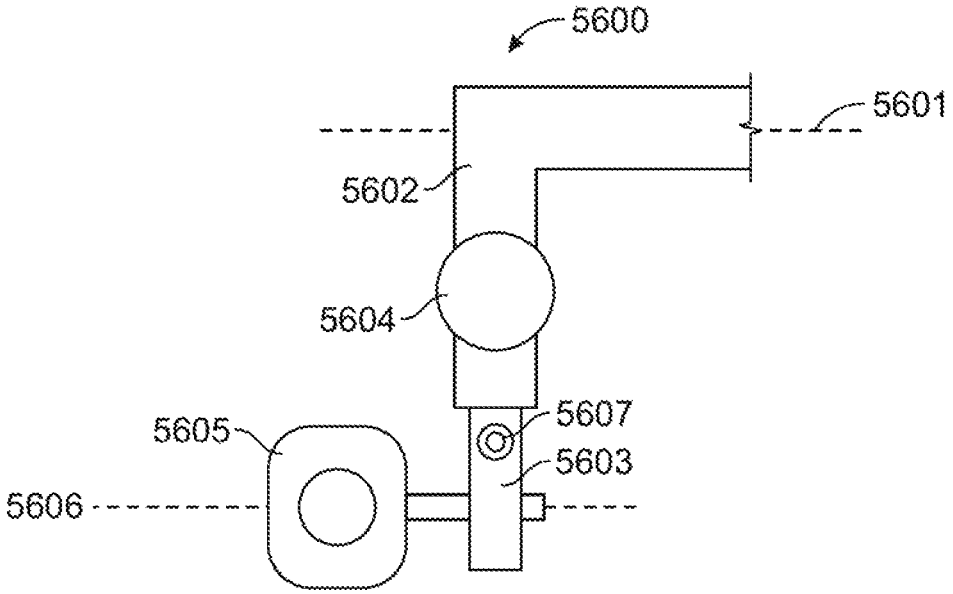
FIG. 56 is a front view of an embodiment of a pedal attachment.

Referring to FIG. 56, in one embodiment, pedal attachment 5600 optionally comprises crank 5602, which is optionally mounted at one end to an attachment extension port (not shown), and optionally connectable at the other end to pedal extension 5603. Pedal extension 5603, optionally telescopes into and out of crank 5602. The crank preferably rotates around crank axis of rotation 5601. Pedal 5605 optionally attaches rotatably to pedal extension 5603, and rotates around pedal axis of rotation 5606. Preferably, a user can rotate pedal 5605 around crank axis of rotation 5601. Pedal extension lock 5604 optionally inserts into crank 5602 and pedal extension hole 5607 thereby locking pedal extension 5603 and crank 5602 together.

Figure 57:
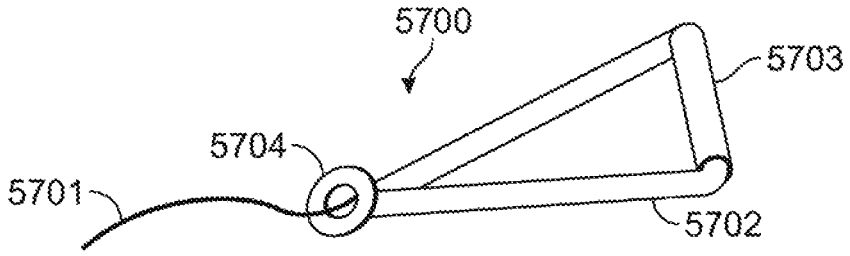
FIG. 57 is a perspective view of an embodiment of a connectable handle.

Referring to FIG. 57, in one embodiment, connectable handle 5700 optionally comprises cable 5701, connected to ring 5704. Optionally, ring 5704 is connected to strap 5702, and optionally, strap 5702 has grip 5703 attached to it. The other end of cable 5701 optionally connects to an attachment (not shown).

Figure 58:
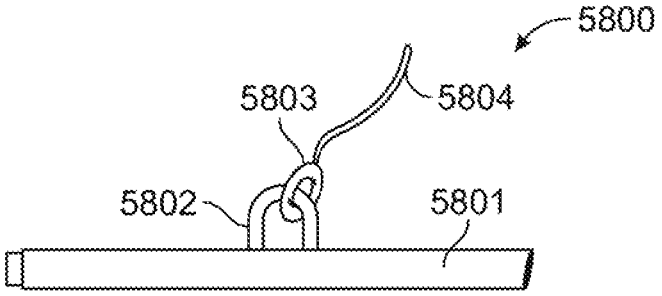
FIG. 58 is a front view of an embodiment of a connectable handle.

Referring to FIG. 58, in one embodiment, connectable handle 5800 optionally comprises handle 5801 that optionally has connecting point 5802 on its periphery. Optionally, cable 5804 attaches to ring 5803, and optionally ring 5803 attaches to connecting point 5802. The other end of cable 5804 optionally connects to an attachment (not shown).

Figure 59:
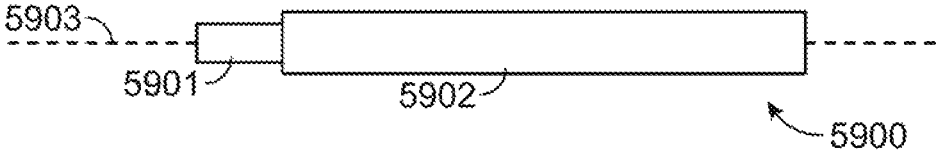
FIG. 59 is a front view of an embodiment of a direct attachment extension port attachment.

Referring to FIG. 59, in one embodiment, connectable handle 5900 optionally comprises grip surface 5902 which is connected to attachment extension port plug 5901. Preferably a person can rotate grip surface 5900 around axis of rotation 5903 thereby causing attachment extension port plug 5901 to rotate around axis of rotation 5903. Attachment extension port plug 5901 is optionally attachable to an attachment extension port (not shown).

Figure 60:
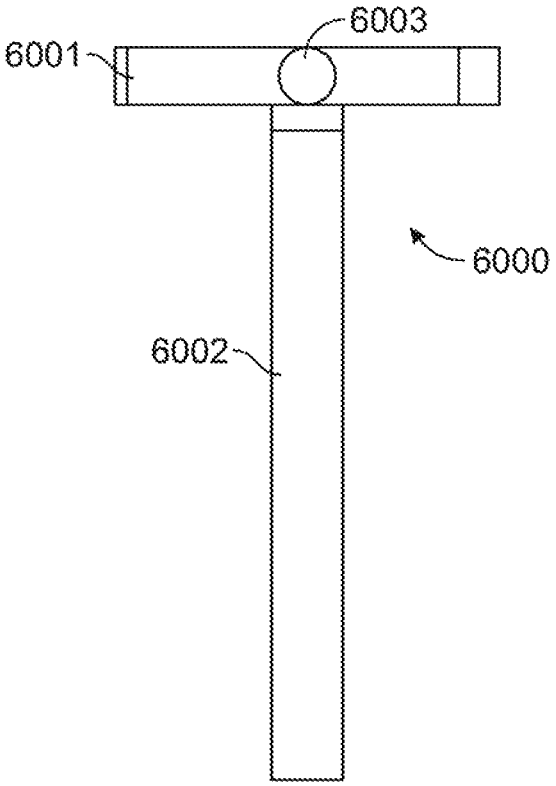
FIG. 60 is a front view of an embodiment of a perpendicular attachment.

Referring to FIG. 60, in one embodiment, perpendicular attachment 6000 optionally comprises attachment extension shaft receiver 6001, which is optionally attachable to an attachment extension (not shown). Furthermore, perpendicular attachment 6000 optionally comprises grip area 6002, and attachment extension lock 6003. Optionally, grip area 6002 is positioned perpendicular to attachment extension shaft receiver 6001.

Figure 61:
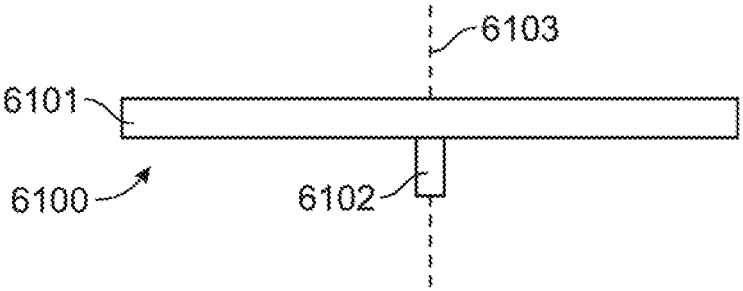
FIG. 61 is a side view of an embodiment of a standing platform attachment.

Referring to FIG. 61, in one embodiment, standing platform attachment 6100 optionally comprises platform 6101, and optionally attachment extension port plug 6102 mounted to platform 6101. Axis of rotation 6103 is optionally the position that standing platform attachment 6100 rotates around. Preferably, a person rotating platform 6101 around axis of rotation 6103 will also rotate port plug 6102 around axis of rotation 6103.

Figure 62:
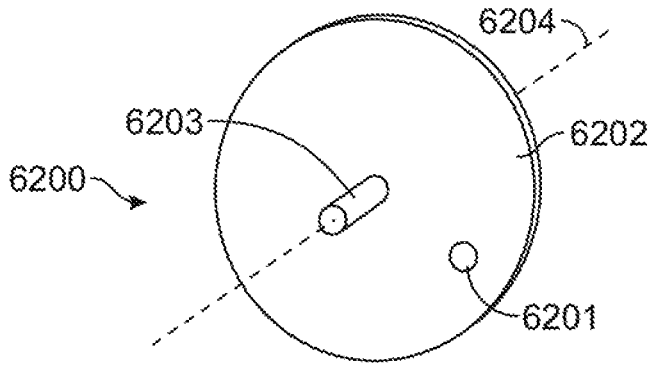
FIG. 62 is a perspective view an embodiment of the underside of a standing platform attachment.

Referring to FIG. 62, an embodiment of standing platform attachment 6200 optionally comprises pass through hole 6201 going through platform 6202. Attachment extension port plug 6203 and platform 6202 are optionally secured together and optionally both rotate around axis of rotation 6204.

Figure 63:
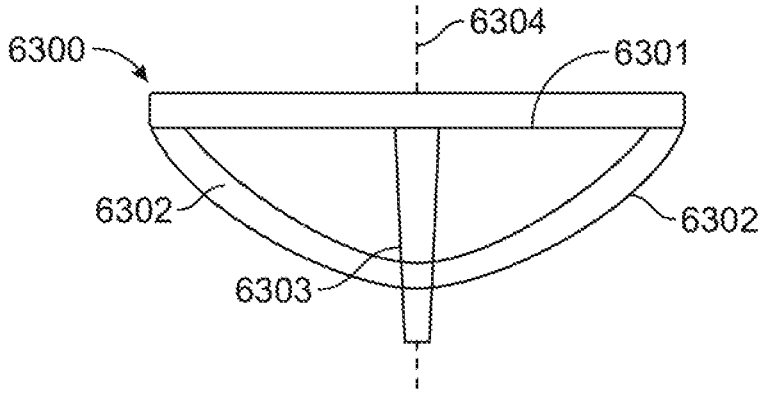
FIG. 63 is a side view of an embodiment of a steering wheel attachment.

Referring to FIG. 63, in one embodiment, steering wheel attachment 6300 optionally comprises grip surface 6301 which is optionally mounted to spokes 6302, and spokes 6302 are optionally mounted to attachment extension port plug 6303. Optionally steering wheel attachment 6300 rotates around axis of rotation 6304. Preferably when a person rotates grip surface 6301, attachment extension port plug 6303 will also rotate.

Figure 64:
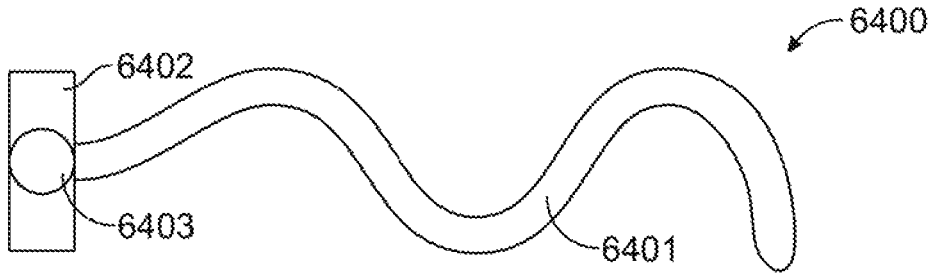
FIG. 64 is a front view of an embodiment of a long curved attachment.

Referring to FIG. 64, in one embodiment, long curved attachment 6400 optionally comprises grip surface 6401 optionally connected to attachment extension shaft receiver 6402. Attachment extension shaft receiver 6402 is optionally connectable to an attachment extension (not shown). Attachment extension lock 6403 is preferably secured to the surface of attachment extension shaft receiver 6402.

Figure 65:
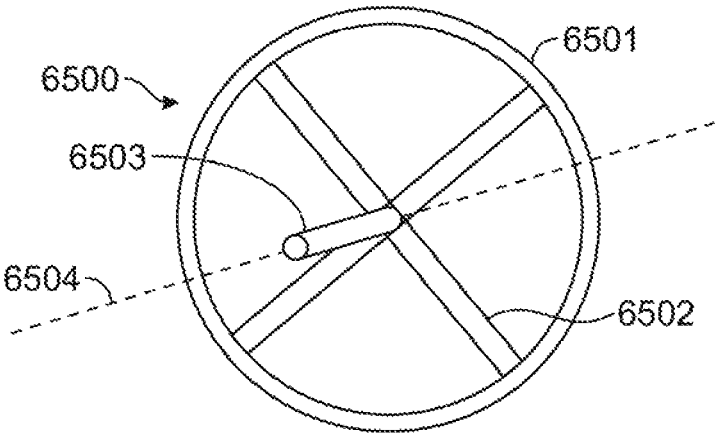
FIG. 65 is a perspective view of an embodiment of a steering wheel attachment.

Referring to FIG. 65, in one embodiment, steering wheel attachment 6500 optionally comprises grip surface 6501 which is connected to spokes 6502 and spokes 6502 are optionally connected to attachment extension port plug 6503. Preferably, rotating steering wheel attachment 6500 around axis of rotation 6504 will cause attachment extension port plug 6503 to rotate.

Figure 66:
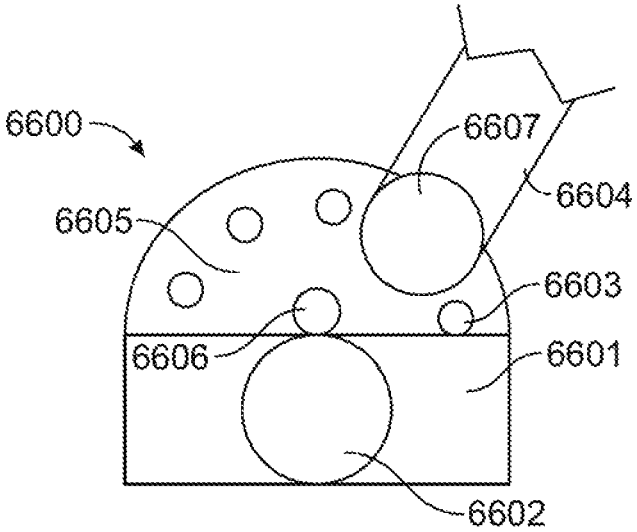
FIG. 66 is a side view of an embodiment of an attachment with adjustable angles.

Referring to FIG. 66, in one embodiment, attachment with adjustable angles 6600, optionally comprises attachment extension shaft receiver 6601 which is connectable to an attachment extension (not shown). Attachment extension shaft receiver 6601 optionally has mounted upon its surface attachment extension lock 6602 which secures the attachment extension shaft receiver onto an attachment extension (not shown). Attachment part 6604 is rotatably mounted to selector plate 6605 by means of wrist pin 6606. Optionally, selector plate 6605 is attached to attachment extension shaft receiver 6601. Attachment part angle lock 6607 optionally passes through selector plate 6605 and attachment part 6604. By optionally removing attachment part angle lock 6607 then rotating attachment part 6604 around wrist pin 6606 a user can select the angle attachment part 6604 is in relation to attachment extension shaft receiver 6601. Optionally, attachment part angle lock 6607 will pass through angle selection hole 6603 which is optionally passing through the surface of selector plate 6605.

Figure 67:
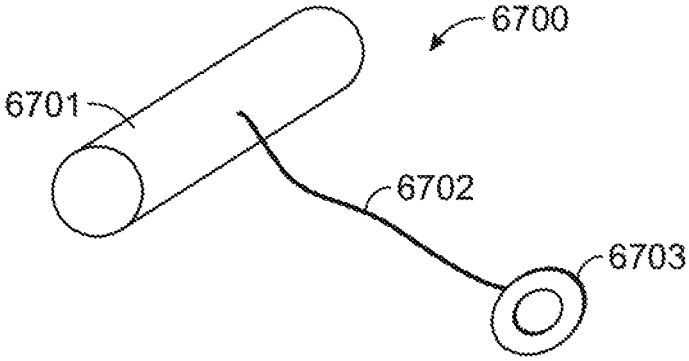
FIG. 67 is a perspective view of an embodiment of a connectable handle.

Referring to FIG. 67, in one embodiment, connectable handle 6700 optionally comprises grip 6701 which is optionally connected to cable 6702. Optionally, cable 6702 is connected to ring 6703.

Figure 68:
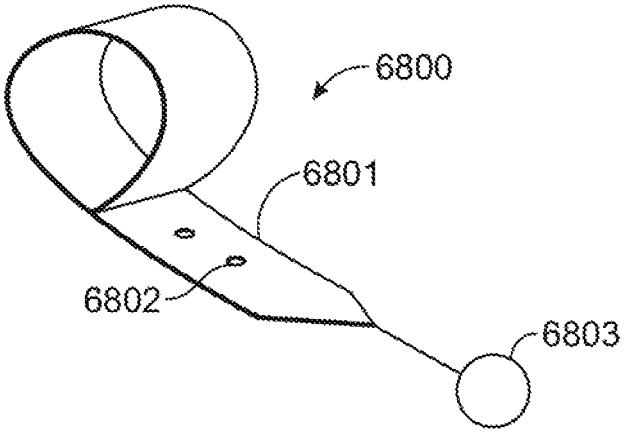
FIG. 68 is a perspective view of an embodiment of a connectable handle.

Referring to FIG. 68, in one embodiment, connectable handle 6800 optionally comprises flexible material 6801 which is optionally looped around itself and secured by placing a pin (not shown) through adjustment holes 6802. Flexible material 6801 is optionally connected to ring 6803.

Figure 69:
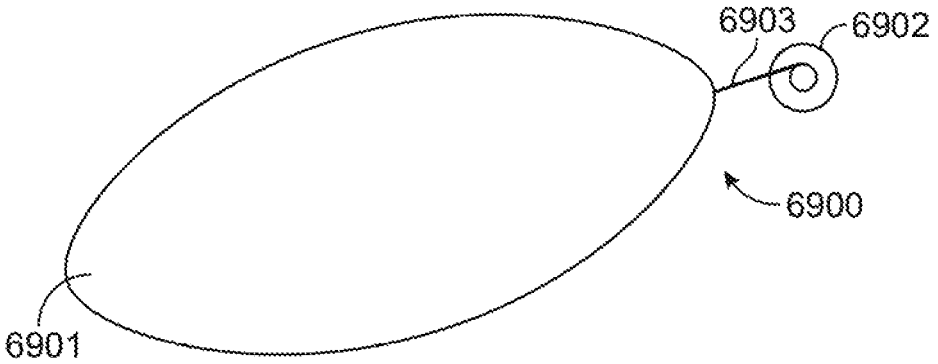
FIG. 69 is a perspective vie of an embodiment of a connectable handle.

Referring to FIG. 69, in one embodiment, connectable handle 6900 optionally comprises curved surface 6901 shaped similar to a football. Optionally the curved surface is connected to link 6903 and link 6903 is connected to ring 6902.

Figure 70:
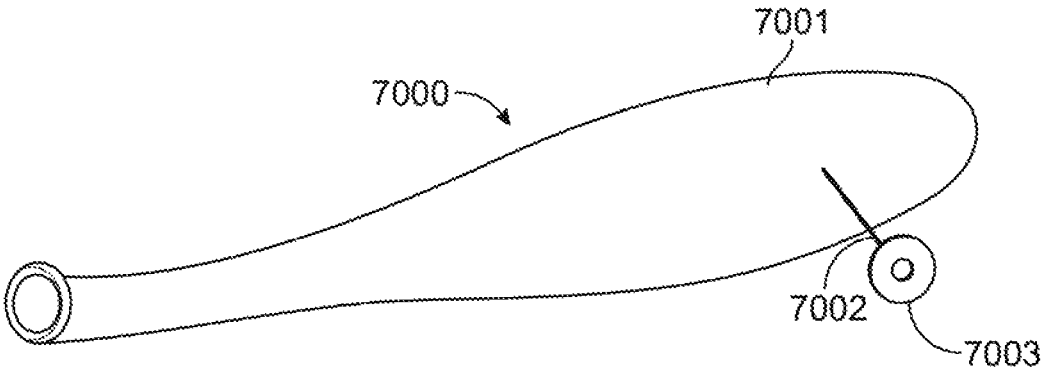
FIG. 70 is a perspective view of an embodiment of a connectable handle.

Referring to FIG. 70, in one embodiment, connectable handle 7000 optionally comprises grip surface 7001 shaped similarly to a baseball bat. Grip surface 7001 is optionally connected to strap 7002 and strap 7002 is optionally connected to carabiner 7003.

Figure 71:
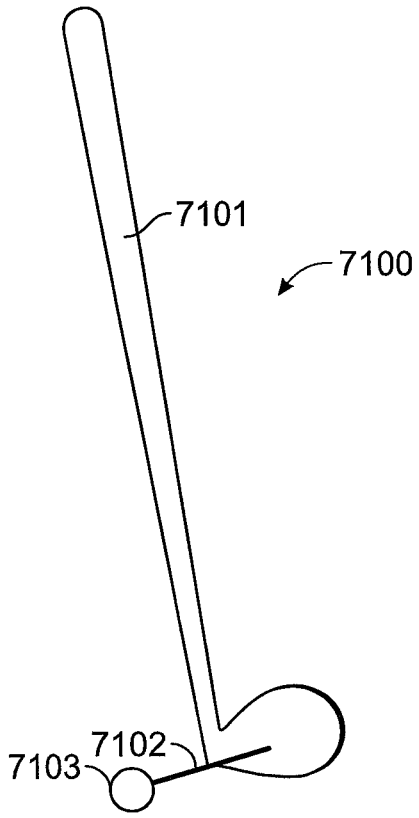
FIG. 71 is a perspective view of an embodiment of a connectable handle.

Referring to FIG. 71, in one embodiment, connectable handle 7100 optionally comprises grip surface 7101 shaped similarly to a golf club. Grip surface 7101 is optionally connectable to cable 7102 and cable 7102 is optionally connectable to eye 7103.

Figure 72:
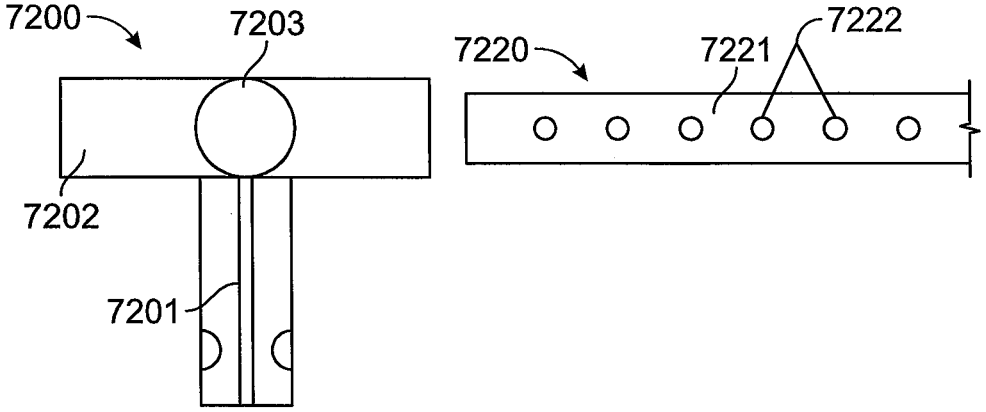
FIG. 72 is a side view of an embodiment of an attachment extension and attachment.

Referring to FIG. 72, in one embodiment, attachment extension 7200 optionally comprises attachment extension port plug 7201 which is connectable to an attachment extension port (not shown). Attachment extension port plug 7201 is optionally connected to attachment extension body 7202. Attachment extension body 7202 optionally has attachment lock 7203 attached to it. Optionally, attachment lock 7203 secures together the attachment extension 7200 and attachment 7220, when attachment 7220 is attached to attachment extension 7200. Optionally, attachment 7220 comprises surface 7221 which inserts into attachment extension 7200. Optionally, upon surface 7221 attachment 7220 has holes 7222 which are engaged by attachment lock 7203.

Figure 73:
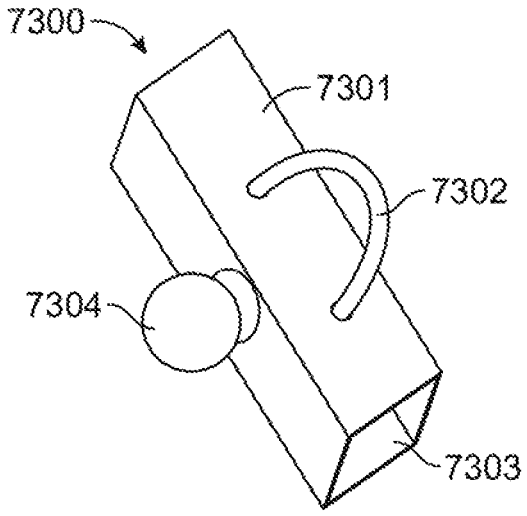
FIG. 73 is a perspective view of an embodiment of a generic attaching point attachment.

Referring to FIG. 73, in one embodiment, adjustable attachment slide 7300 optionally comprises body 7301 with optional loop 7302 attached to it. Optionally, body 7301 comprises opening 7303 located on at least one end. Opening 7303 preferably allows for the installation of an attachment extension (not shown). Optionally, extension lock 7304 is mounted on the surface of body 7301. Optionally, the extension lock will secure adjustable attachment slide 7300 onto an attachment extension (not shown). Preferably, a person can install an attachment of choice (not shown) to loop 7302.

Figure 74:
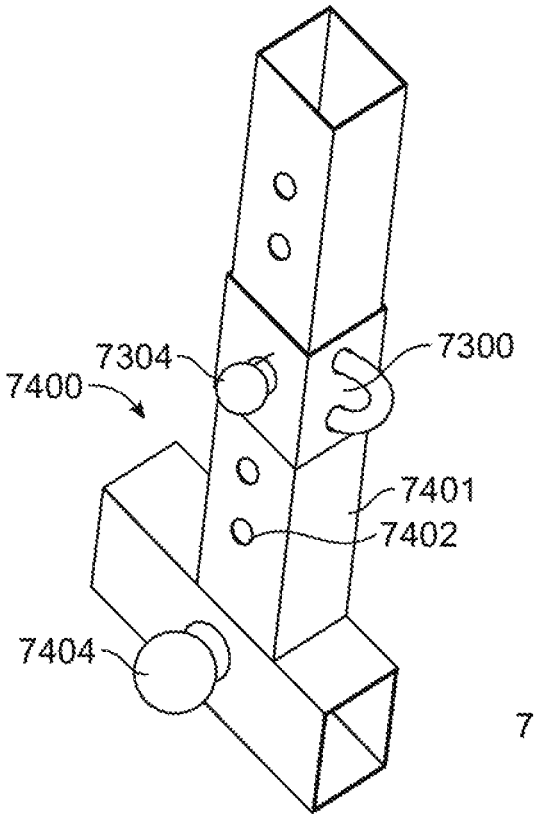
FIG. 74 is a perspective view of an embodiment of an adjustable generic attaching point attachment.

Referring to FIG. 74, in one embodiment, adjustable generic attaching point attachment 7400 optionally comprises adjustable attachment slide 7300, adjustably attached to frame rail 7401. Frame rail 7401 optionally has holes 7402 for extension lock 7404 to engage. Disengaging extension lock 7404 preferably allows a person to slide adjustable attachment slide 7300 to a new hole 7402 and re-engage extension lock 7304.

Figure 75:
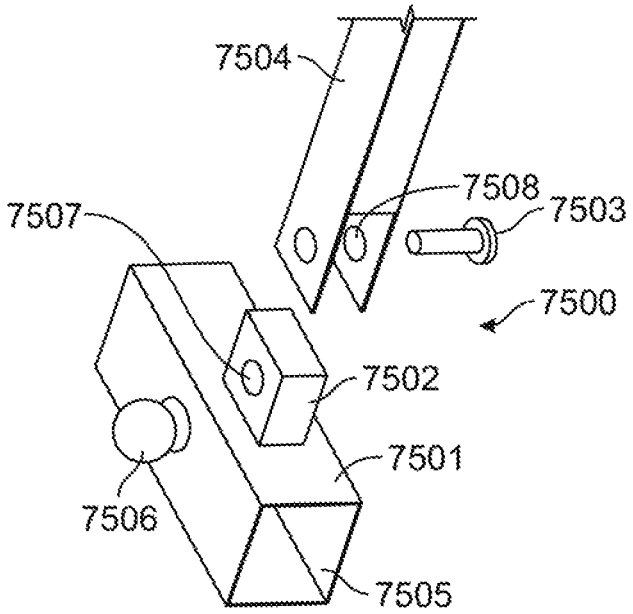
FIG. 75 is a perspective view of an embodiment of an articulating attachment joint.

Referring to FIG. 75, in one embodiment, articulating attachment joint 7500 optionally comprises attachment extension shaft receiver 7501 which optionally has on its surface pin base 7502 with hole 7507. Attachment arm 7504 is optionally able to articulate freely around pin 7503 when pin 7503 is inserted into hole 7508 and hole 7507. Attachment arm 7504 is installed onto attachment extension shaft receiver 7501 rotatably around pin 7503. Preferably, lock pin 7506 secures articulating attachment joint 7500 onto an attachment extension (not shown). The attachment extension inserts into opening 7505.

Figure 76:
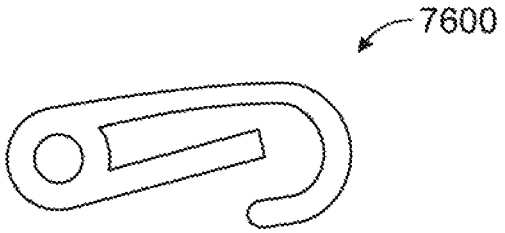
FIG. 76 is a side view of an embodiment of a carabiner.

Referring to FIG. 76, in one embodiment, carabiner 7600 preferably attaches one piece of equipment (not shown) to another.

Figure 77:
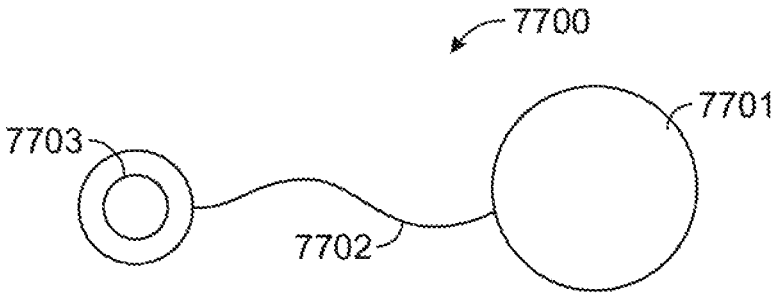
FIG. 77 is a side view of an embodiment of a connectable handle.

Referring to FIG. 77, in one embodiment, connectable handle 7700 optionally comprises grip surface 7701 generally shaped like a spherical ball. Grip surface 7701 optionally attaches to rope 7702 and rope 7702 is optionally attached to washer 7703.

Figure 78:
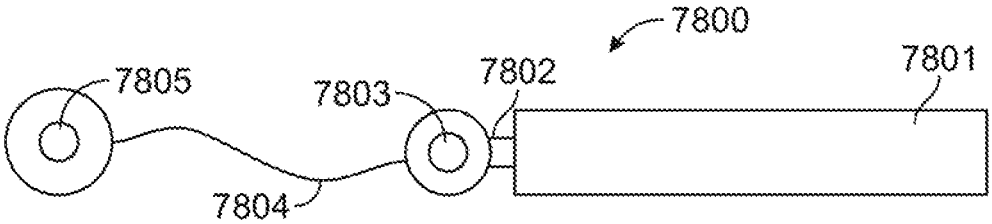
FIG. 78 is a side view of an embodiment of a connectable handle.

Referring to FIG. 78, in one embodiment, connectable handle 7800 optionally comprises grip area 7801 optionally rotatably mounted on shaft 7802 and preferably shaft 7802 is connected to ring 7803. Ring 7803 is preferably connected to chain 7804 and chain 7804 is optionally connected at the other end to ring 7805.

Figure 79:
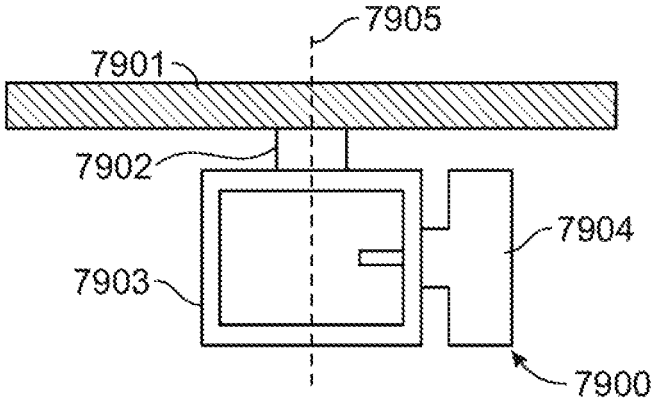
FIG. 79 is a sectional view of an embodiment of a free spinning plate attachment.

Referring to FIG. 79, in one embodiment, free spinning plate attachment 7900 comprises attachment extension shaft receiver 7903 which optionally has attachment lock 7904 attached to its surface. Attachment lock 7904 optionally secures free spinning plate attachment 7900 onto an attachment extension (not shown). Axle 7902 is optionally attached to attachment exstension shaft receiver 7903. Preferably, free spinning plate 7901 is optionally rotatably attached to the axle 7902. Preferably, when a person rotates free spinning plate 7901 on the axis of rotation 7905, free spinning plate 7901 will rotate freely. Preferably, when a person presses on free spinning plate 7901 in a motion perpendicular in direction to the axis of rotation 7905, free spinning plate attachment 7900 will transfer that force into the optionally connected attachment extension (not shown).

Figure 80:
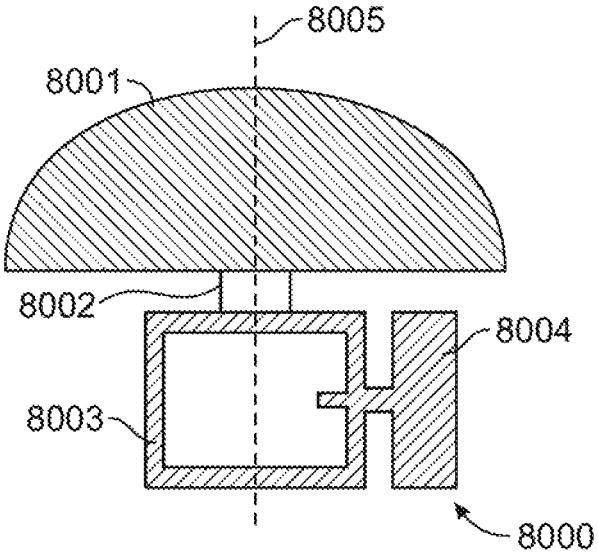
FIG. 80 is a sectional view of an embodiment of a free spinning dome attachment.

Referring to FIG. 80, in one embodiment, free spinning dome attachment 8000 preferably comprises attachment extension shaft receiver 8003 which optionally has attachment lock 8004 attached to its surface. Attachment lock 8004 optionally secures free spinning dome attachment 8000 onto an attachment extension (not shown). Axle 8002 is optionally attached to attachment extension shaft receiver 8003. Free spinning dome 8001 is optionally rotatably attached to the axle 8002. Preferably, when a person rotates free spinning dome 8001 on the axis of rotation 8005, free spinning dome 8001 will rotate freely. Preferably, when a person presses on free spinning dome 8001 in a motion perpendicular in direction to axis of rotation 8005, free spinning dome attachment 8000 will transfer that force into the optionally connected attachment extension (not shown).

Figure 81:
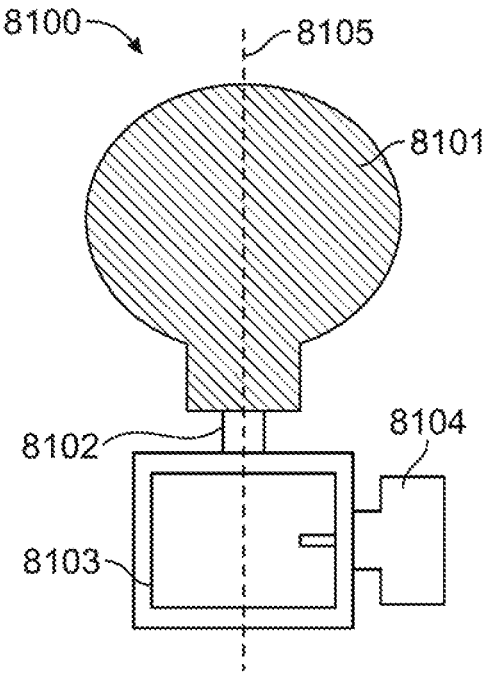
FIG. 81 is a sectional view of an embodiment of a free spinning knob attachment.

Referring to FIG. 81, in one embodiment, free spinning knob attachment 8100 preferably comprises attachment extension shaft receiver 8103 which optionally has attachment lock 8104 attached to its surface. Attachment lock 8104 optionally secures free spinning knob attachment 8100 onto an attachment extension (not shown). Axle 8102 is optionally attached to attachment extension shaft receiver 8103. Free spinning knob 8101 is optionally rotatably attached to axle 8102. Preferably, when a person rotates free spinning knob 8101 on axis of rotation 8105, free spinning knob 8101 will rotate freely. Preferably, when a person presses on free spinning knob 8101 in a motion perpendicular in direction to axis of rotation 8105, free spinning knob attachment 8100 will transfer that force into the optionally connected attachment extension (not shown).

Figure 82:
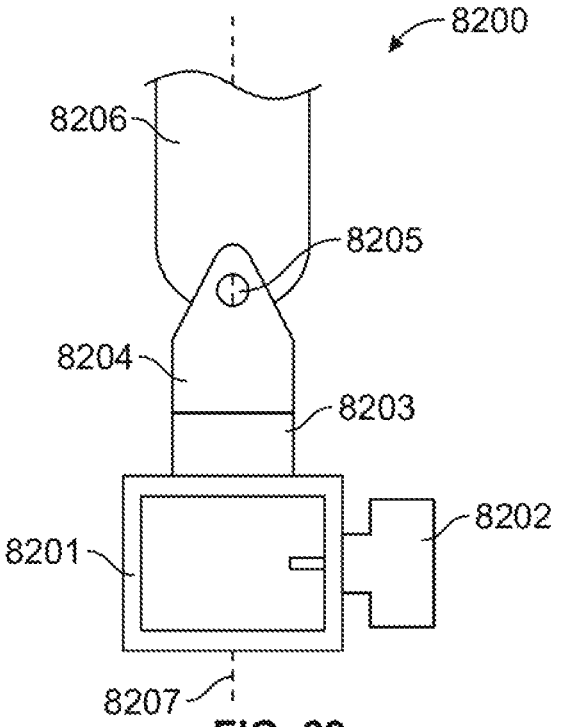
FIG. 82 is a side view of an embodiment of a free spinning articulating joint attachment.

Referring to FIG. 82, in one embodiment, free spinning articulating joint attachment 8200 preferably comprises attachment extension shaft receiver 8201 which optionally has connected to it attachment extension lock 8202. Optionally, an attachment extension (not shown) attaches to free spinning articulating joint attachment 8200. Optionally, attachment extension shaft receiver 8201 also has connected to it joint base 8203. Joint base 8203 is preferably rotatably connected to joint flange 8204. Optionally, joint flange 8204 is able to freely rotate around axis of rotation 8207. Joint Flange 8204 is preferably rotatably connected to wrist pin 8205. Optionally, wrist pin 8205 rotatably connects joint flange 8204 to attachment arm 8206. Preferably, attachment arm 8206 will optionally be free to rotate around axis of rotation 8207 and optionally be able to rotate around wrist pin 8205 in a different axis of rotation (not shown) from axis of rotation 8207.

Figure 83:
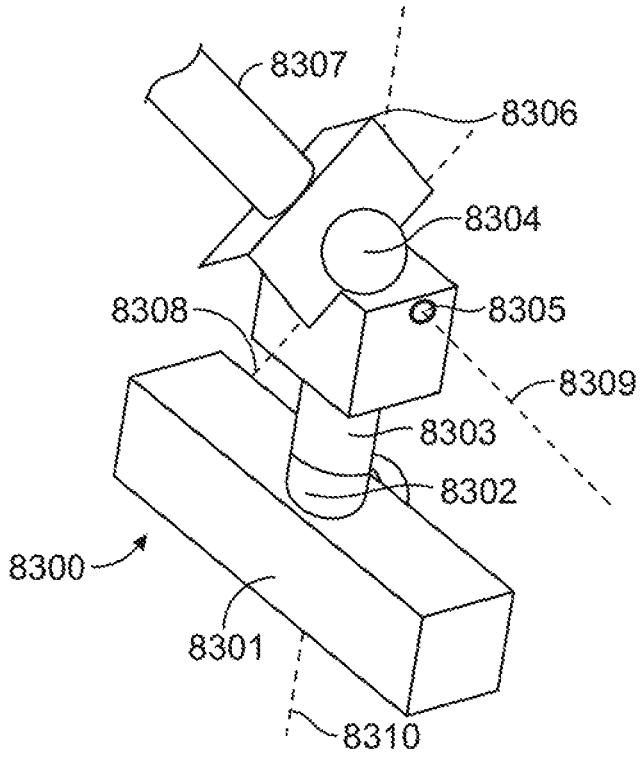
FIG. 83 is a perspective view of an embodiment of a universally jointed attachment.

Referring to FIG. 83, in one embodiment, universally jointed attachment 8300 preferably comprises attachment extension shaft receiver 8301 which is optionally rotatably attached to a universal joint housing 8303 with bearing 8302 mounted between universal join housing 8303 and attachment extension shaft receiver 8301. Universal joint housing 8303 is preferably able to rotate on axis of rotation 8310. Universal joint housing 8303 is preferably rotatably mounted to two portions of universal joint 8304 by both ends of wrist pin 8305, and universal joint housing 8303 is preferably able to rotate about axis of rotation 8309. Universal joint 8304 is preferably rotatably connected to attachment arm base 8306 by, for example, connecting to two portions of universal joint 8304 onto attachment arm base 8306. Preferably attachment arm base 8306 is able to rotate freely about axis of rotation 8308. Attachment arm 8307 is optionally connected to attachment arm base 8306. Attachment arm 8307 is preferably able to freely spin around axis of rotation 8310, and optionally free to spin around axis of rotation 8309, and optionally free to spin around axis of rotation 8308.

Figure 84:
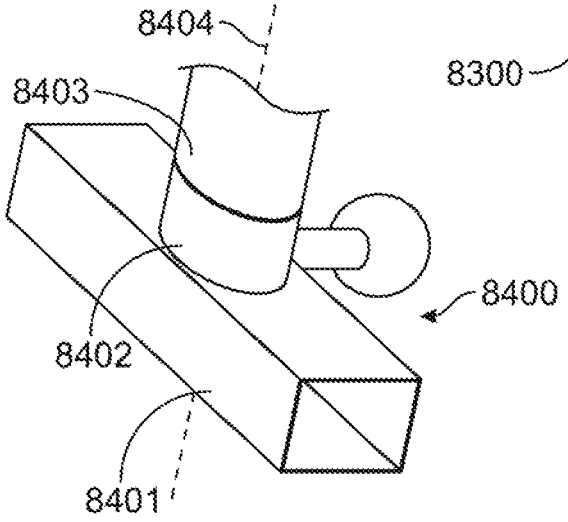
FIG. 84 is a perspective view of an embodiment of a free spinning attachment.

Referring to FIG. 84, in one embodiment, free spinning attachment 8400 preferably comprises attachment extension shaft receiver 8401 which is optionally connectable to an attachment extension (not shown). Attachment extension shaft receiver 8401 is optionally rotatably connected to hearing 8402 and bearing 8402 is optionally rotatably connected to surface 8403. Surface 8403 is preferably able to rotate around axis of rotation 8404.

Figure 85:
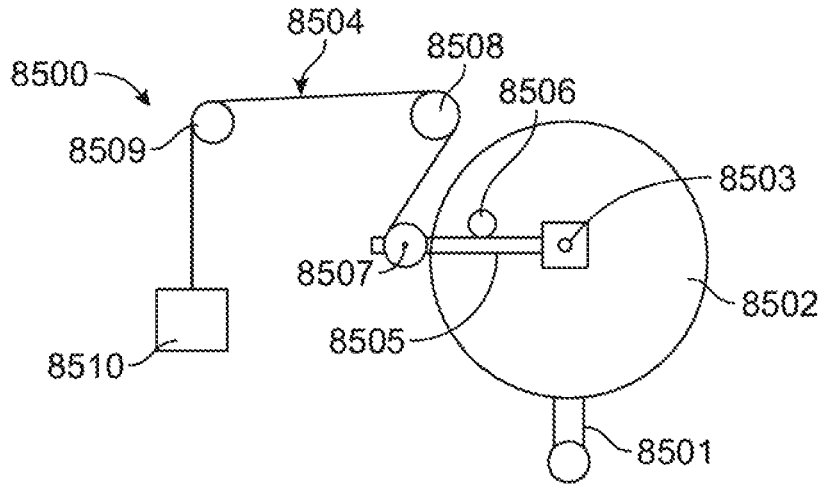
FIG. 85 is a front view of an embodiment of a rotational resistance assembly at rest.
Figure 86:
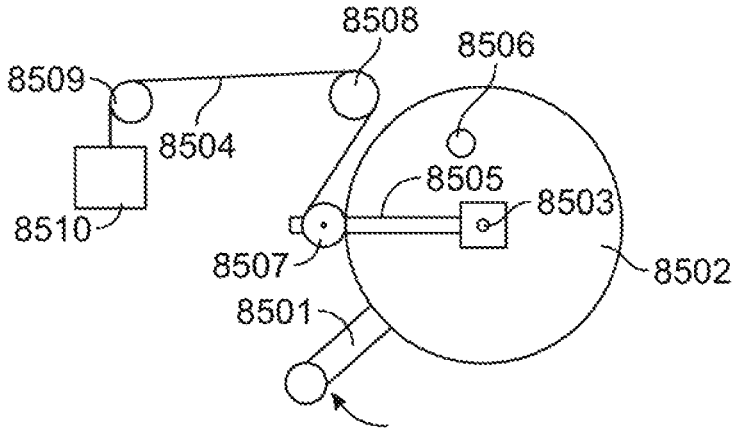
FIG. 86 is a front view an embodiment of a rotational resistance assembly turning clockwise.
Figure 87:
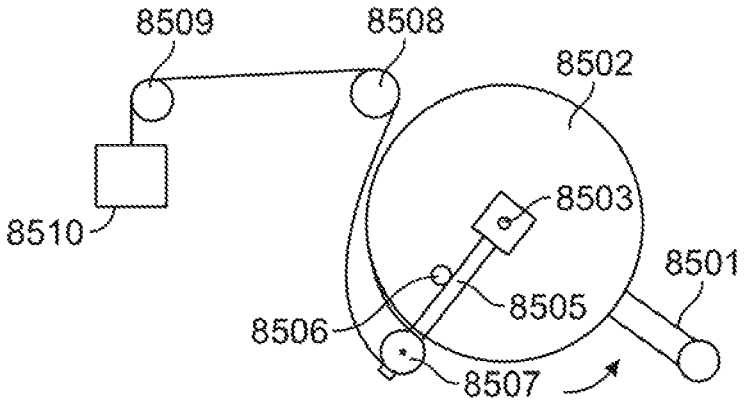
FIG. 87 is a front view of an embodiment of a rotational resistance assembly turning counterclockwise.

Referring to FIGS. 85-87, in one embodiment, rotational resistance assembly 8500 at rest position preferably comprises lever arm 8501 connected to wheel 8502. Wheel 8502 is preferably rotatable around center of rotation 8503. Cable 8504 is preferably connected to the periphery of wheel 8502, such that when wheel 8502 rotates, cable 8504 wraps around the periphery of wheel 8502. First pulley 8507 is preferably rotatably mounted to arm 8505, and optionally arm 8505 is rotatably mounted to the center of wheel 8502. In one embodiment, stopper 8506 is preferably mounted onto the surface of wheel 8502, and is positioned next to arm 8505. Cable 8504 extends from wheel 8502 and passes around first pulley 8507, then passes around second pulley 8508, then cable 8504 passes around third pulley 8509, and attaches to weight 8510. Optionally, an attachment extension (not shown) is connectable to rotational resistance assembly 8500. Optionally arm 8505 is stopped from rotating one direction by a second stopper (not shown).

In one embodiment, weight 8510 is moved by cable 8504 when wheel 8502 is rotated clockwise. Preferably, when wheel 8502 is rotated one direction, second stopper (not shown) stops arm 8505 from rotating the same direction. Optionally, first pulley 5807 remains stationary while wheel 8502 rotates in one direction because of its attachment to arm 8505. Preferably cable 8504 will wrap around wheel 8502 and preferably cause the motion of wheel 8502 to be resisted.

Referring to FIG. 87, in another embodiment, weight 8510 is moved by cable 8504 when wheel 8502 is rotated in another direction. Wheel 8502 is shown therein after it has been rotated in an opposite direction. In one embodiment rotational resistance assemblies embodied in FIG. 85-87 are capable of providing bidirectional rotation resistance. In another embodiment a rotational resistance assembly is capably of attaching an attachment at its center of rotation 8503.

Figure 88:
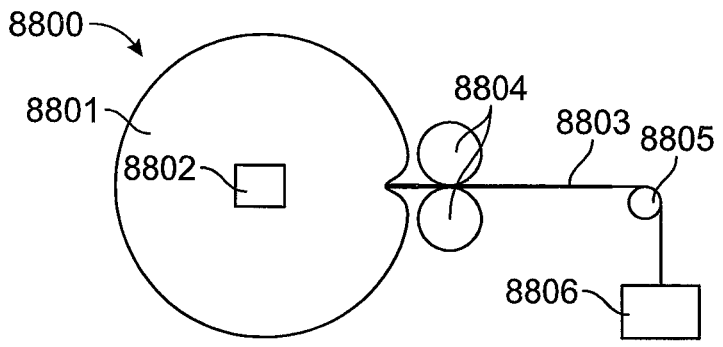
FIG. 88 is a front view of an embodiment of a rotational resistance assembly at rest.

Referring to FIG. 88, in one embodiment, rotational resistance assembly 8800 at resting position, preferably comprises wheel 8801 rotatable around center of rotation 8802. Optionally, wheel 8801 has cable 8803 attached to its periphery. Optionally, first and second pulleys 8804 are rotatably attached nearby on opposing sides of cable 8803. Optionally, cable 8803 passes over third pulley 8805. Optionally, cable 8803 is attached to weight 8806 on its other end. Optionally, wheel 8801 is rotatably mounted on an axle (not shown) with the axle axis of rotation (not shown) being coincidental with wheel center of rotation 8802. Optionally rotational resistance assembly 8800 is attachable to an attachment extension port plug (not shown).

Figure 89:
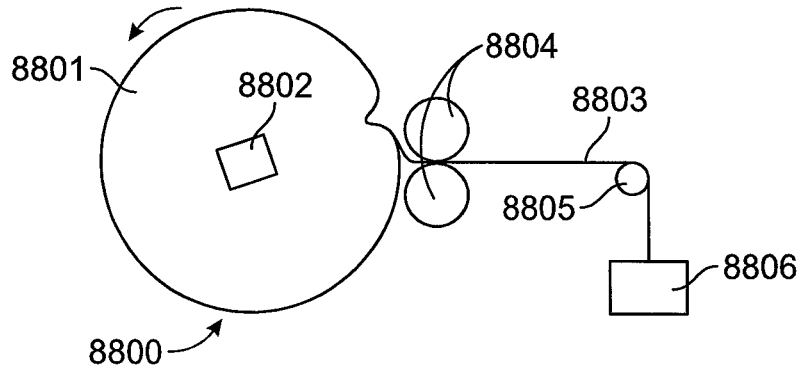
FIG. 89 is a front view of an embodiment of a rotational resistance assembly turning counterclockwise.

Referring to FIG. 89, in one embodiment, rotational resistance assembly 8800 is preferably rotated counterclockwise, and comprises weight 8806 that is lifted by the rotation of wheel 8801.

Figure 90:
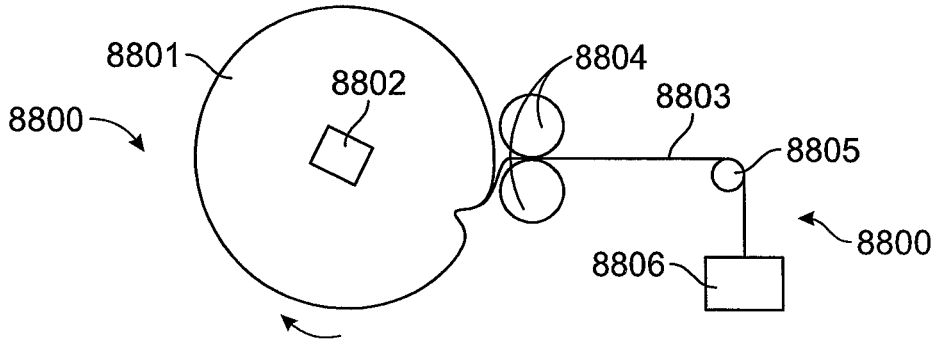
FIG. 90 is a front view of an embodiment of a rotational resistance assembly turning clockwise.

Referring to FIG. 90, in one embodiment, rotational resistance assembly 8800 is preferably rotated clockwise, and comprises weight 8806 that is lifted by the rotation of wheel 8801.

Figure 91:
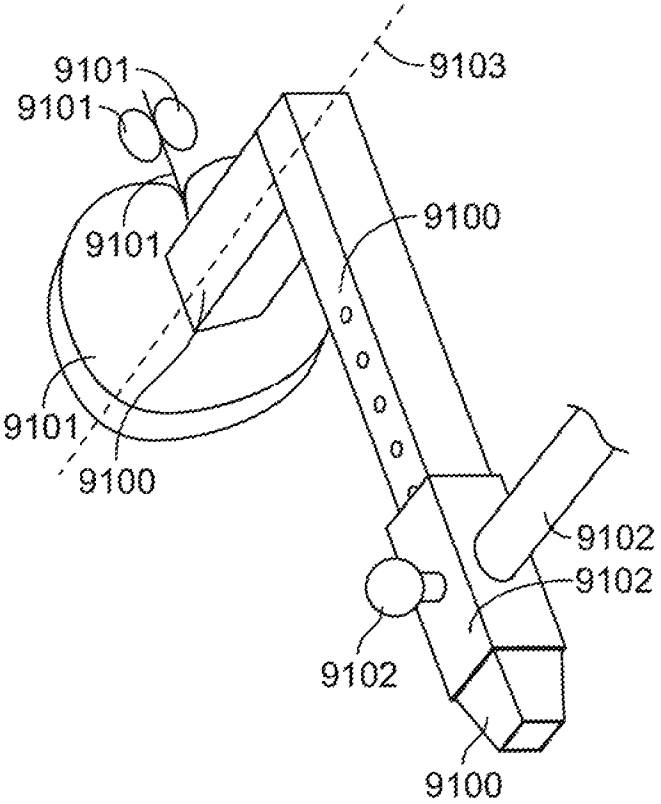
FIG. 91 is a perspective view of an embodiment of a rotational resistance assembly with an attachment extension attached to it, and with an attachment attached to the attachment extension.

Referring to FIG. 91, in one embodiment, attachment extension 9100 is preferably attached to rotational resistance assembly 9101, and attachment 9102 is optionally attached to attachment extension 9100. Preferably, when attachment 9102 is rotated around axis of rotation 9103, a user will have rotational resistance.

Figure 92:
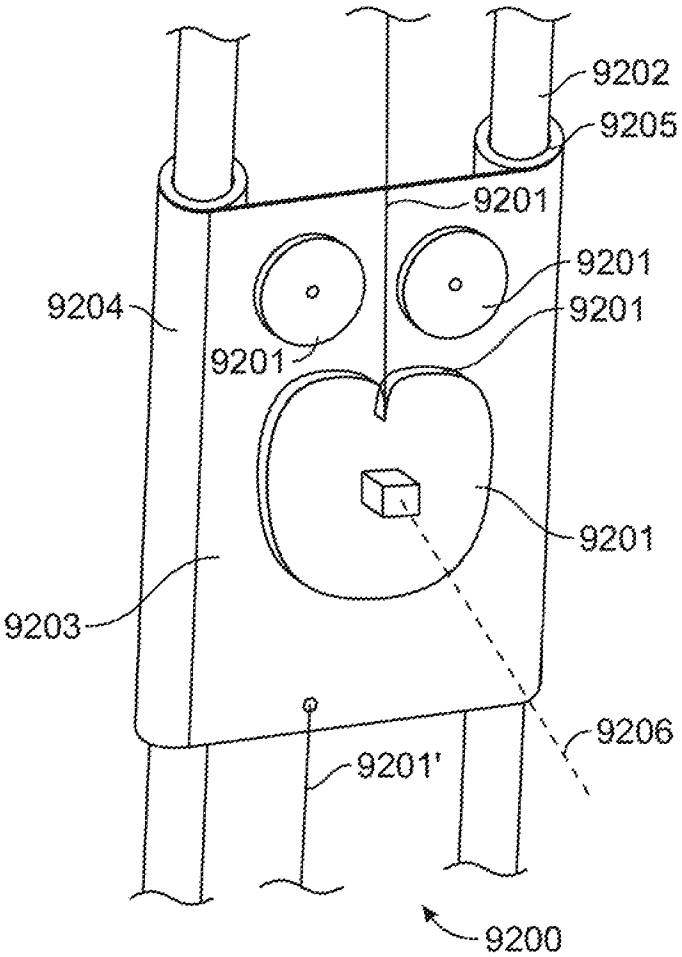
FIG. 92 is a perspective view of an embodiment of a rotational resistance assembly rotatably mounted upon a direct carriage assembly, and direct carriage assembly adjustable in position on frame.

Referring to FIG. 92, in one embodiment, direct carriage assembly 9200 optionally comprises rotational resistance assembly 9201 connected to direct carriage 9203. Optionally, direct carriage 9203 is connected to direct carriage bearing sleeves 9204. Optionally, direct carriage bearing sleeves 9204 comprise bearings 9205 which reduce friction between direct carriage hearing sleeves 9204 and frame 9202. Preferably, the axle (not shown) rotates on axis of rotation 9206. Optionally, direct carriage 9203 is capable of being positioned on frame 9202 at a number of locations.

Figure 93:
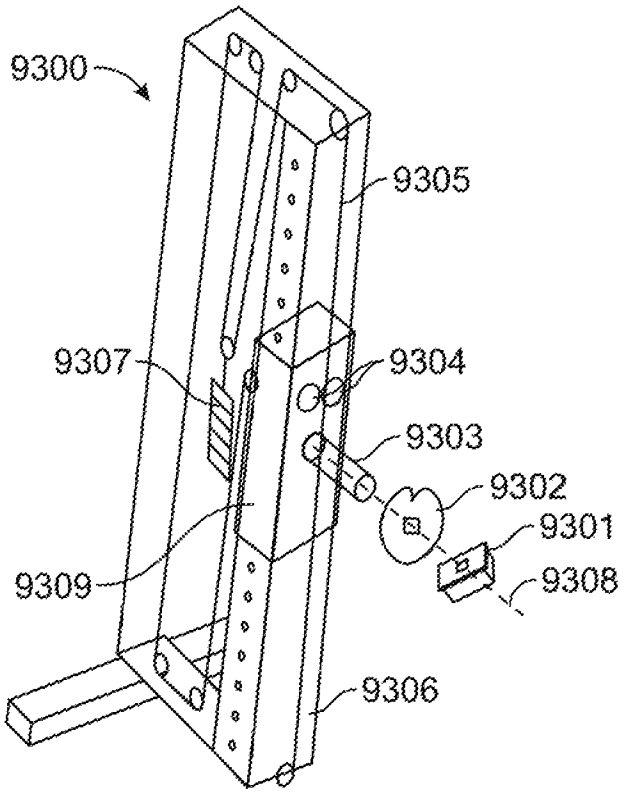
FIG. 93 is a perspective view of an embodiment of a grip twist attachment mounted to a rotational resistance assembly which is rotatably mounted upon a direct carriage assembly, and direct carriage assembly adjustable in position on frame, with axis of rotation directed horizontally, and resistance provided by weight plates.

Referring to FIG. 93, in one embodiment, system 9300 preferably comprises grip twist attachment 9301 rotatably connected to rotational resistance assembly 9302. Optionally, rotational resistance assembly 9302 is rotatably connected to axle 9303 along axis 9308. Axle 9303 is preferably connected to direct carriage 9309. Optionally, direct carriage 9309 is adjustable in height on frame 9306. Preferably, weights 9307 attach to cable 9305 and optionally cable 9305 attaches to rotational resistance assembly 9302. Preferably, a user can rotate grip twist attachment 9301 and weights 9307 will resist the user's rotation. Optionally, a first and a second pulley 9304 are rotatably attached to direct carriage 9309 on opposing sides of cable 9305.

Figure 94:
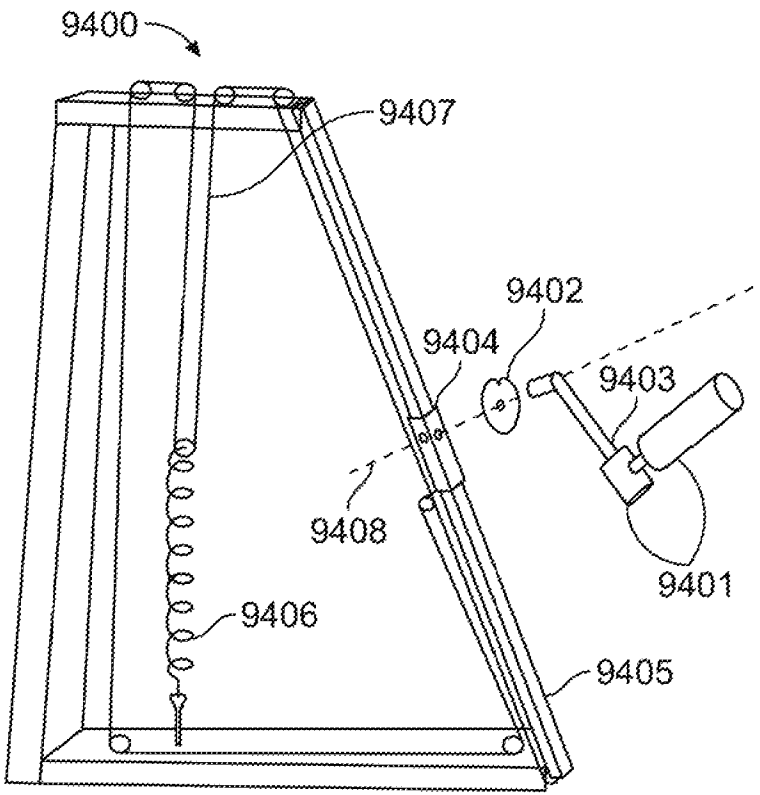
FIG. 94 is a perspective view of an embodiment of a free spin pad attachment attached to an attachment extension and attachment extension attached to a rotational resistance assembly and rotational resistance assembly rotatably mounted upon a direct carriage assembly, and direct carriage assemble adjustable in position on frame, with axis of rotation directed in an angle between horizontal and vertical, and resistance provided by spring.

Referring to FIG. 94, in one embodiment, system 9400 comprises free spinning pad attachment 9401 attached to attachment extension 9403. Optionally, attachment extension 9403 is rotatably attached to rotational resistance assembly 9402. Optionally, rotational resistance assembly 9402 is attached to an axle (not shown) and the axle (not shown) is attached to direct carriage assembly 9404. Preferably the direct carriage assembly is adjustable in height along frame 9405. Optionally, spring 9406 attaches to cable 9407 and preferably resists the rotation of rotational resistance assembly 9402. Optionally, frame 9405 holds direct carriage assembly 9404 such that the axis of rotation 9408 of the rotational resistance assembly is positioned at an angle up from horizontal.

Figure 95:
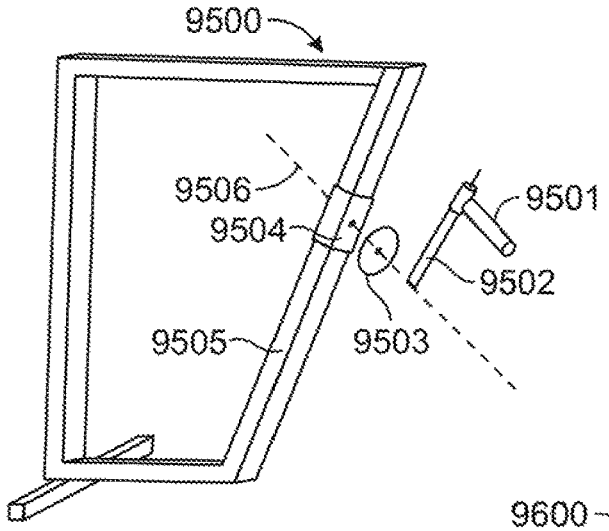
FIG. 95 is a perspective view of an embodiment of a free spin grip attachment attached to an attachment extension and attachment extension attached to a rotational resistance assembly and rotational resistance assembly rotatably mounted upon a direct carriage assembly, and direct carriage assemble adjustable in position on frame, with axis of rotation directed in an angle between vertical and horizontal.

Referring to FIG. 95, in one embodiment, system 9500 comprises free spinning grip attachment 9501 attached to attachment extension 9502. Optionally, attachment extension 9502 is attached to rotational resistance assembly 9503. Optionally, rotational resistance assembly 9503 is attached to an axle (not shown). The axle (not shown) is attached to direct carriage assembly 9504. Optionally, direct carriage assembly 9504 is adjustable in position on frame 9505. Optionally, frame 9505 is positioned at an angle down from vertical. Optionally, axis of rotation 9506 is perpendicular to frame 9505. Preferably, a user rotates free spinning grip attachment 9501 around axis of rotation 9506 in order to lift a resistance source (not shown).

Figure 96:
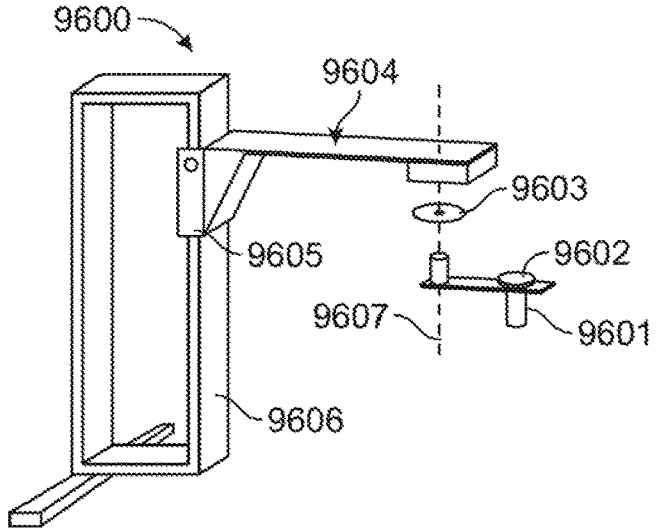
FIG. 96 is a perspective view of an embodiment of a perpendicular attachment attached to an attachment extension and attachment extension attached to a rotational resistance assembly and rotational resistance assembly rotatably mounted upon the frame extension, and frame extension adjustable in height upon the frame, with axis of rotation being vertical.

Referring to FIG. 96, in one embodiment, system 9600 preferably comprises weights (not shown), and a cable (not shown). Optionally, perpendicular attachment 9601 is attached to attachment extension 9602. Optionally, attachment extension 9602 is connected to rotational resistance assembly 9603. Optionally, rotational resistance assembly 9603 is rotationally connected to an axle (not shown). Optionally the axle (not shown) is connected to frame extension 9604. Optionally, frame extension 9604 is attached to direct carriage assembly 9605. Preferably, direct carriage assembly 9605 is adjustable in height on frame 9606. Preferably, when a user rotates perpendicular attachment 9601 around axis of rotation 9607, the cable (not shown) will lift the weights (not shown), preferably causing a rotational resistance to the user's effort.

Figure 97:
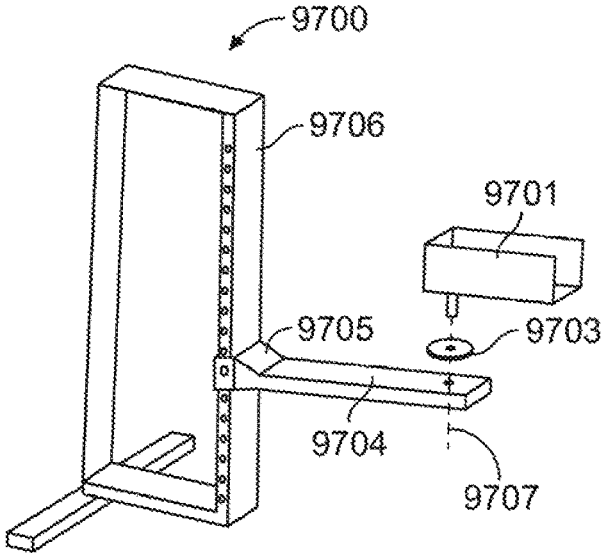
FIG. 97 is a perspective view of an embodiment of a femur rotation attachment attached to a rotational resistance assembly and rotation resistance assembly rotatably mounted upon the frame extension, and frame extension adjustable in height upon the frame, with axis of rotation being vertical.

Referring to FIG. 97, in one embodiment, system 9700 comprises weights (not shown), and a cable (not shown). Optionally, femur rotation attachment 9701 is attached to rotational resistance assembly 9703. Optionally, rotational resistance assembly 9703 is rotationally connected to an axle (not shown). Optionally, the axle (not shown) is connected to frame extension 9704. Optionally, frame extension 9704 is attached to direct carriage assembly 9705. Preferably, direct carriage assembly 9705 is adjustable in height on frame 9706. Preferably, when a user rotates femur rotation attachment 9701 around axis of rotation 9707, the cable (not shown) will lift the weights (not shown), preferably causing a rotational resistance to the user's effort. Preferably, a user can adjust the height of frame extension 9704.

Figure 98:
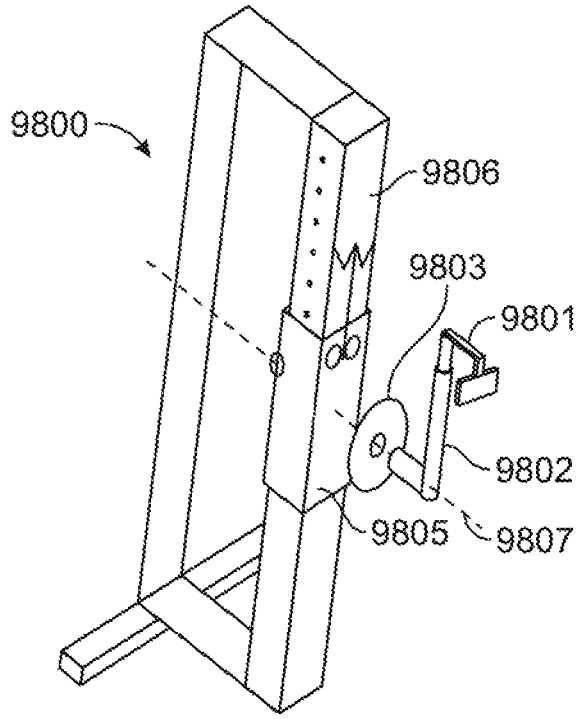
FIG. 98 is a perspective view of an embodiment of a free spinning grip attachment attached to an attachment extension, and the attachment extension attached to a rotational resistance assembly and rotation resistance assembly is rotatably mounted upon a direct carriage assembly, and direct carriage assembly is adjustable in height, with axis of rotation directed in an angle which is horizontal.

Referring to FIG. 98, in one embodiment, system 9800 comprises weights (not shown), and a cable (not shown). Optionally, free spinning grip attachment 9801 is attached to attachment extension 9802. Optionally, attachment extension 9802 is connected to rotational resistance assembly 9803. Optionally, rotational resistance assembly 9803 is rotationally connected to an axle (not shown). Optionally, the axle (not shown) is connected to direct carriage assembly 9805. Preferably, direct carriage assembly 9805 is adjustable in height on frame 9806. Preferably, when a user rotates perpendicular attachment 9801 around axis of rotation 9807, the cable (not shown) will lift the weights (not shown), preferably causing a rotational resistance to the user's effort.

Figure 99:
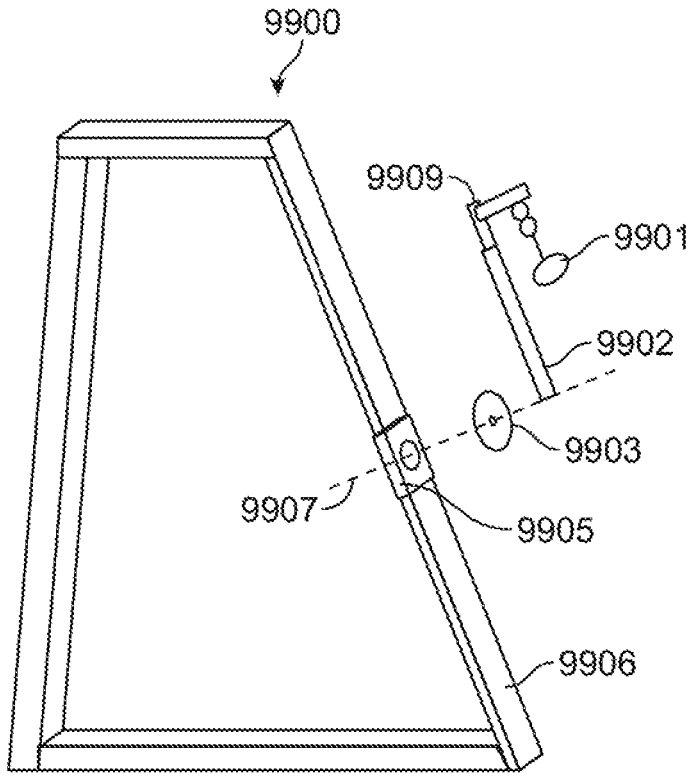
FIG. 99 is a perspective view of an embodiment of a connectable handle attached to an adjustable generic attaching point and adjustable generic attaching point is attached to an attachment extension, with the attachment extension attached to a rotational resistance assembly, the rotational resistance assembly is rotatably attached upon the direct carriage assembly, the direct carriage assembly is adjustable in position upon the frame, with axis of rotation directed at an angle which is between horizontal and vertical.

Referring to FIG. 99, in one embodiment, system 9900 comprises weights (not shown), and a cable (not shown). Optionally, connectable handle 9901 is attached to adjustable generic attaching point 9909. Optionally, adjustable generic attaching point 9909 is connected to attachment extension 9902. Optionally, attachment extension 9902 is connected to rotational resistance assembly 9903. Optionally, rotational resistance assembly 9903 is rotationally connected to an axle (not shown). Optionally the axle (not shown) is connected to direct carriage assembly 9905. Preferably, direct carriage assembly 9905 is adjustable in height on frame 9906. Preferably, when a user rotates connectable handle 9901 around axis of rotation 9907, the cable (not shown) will lift the weights (not shown), preferably causing a rotational resistance to the user's effort.

Figure 100:
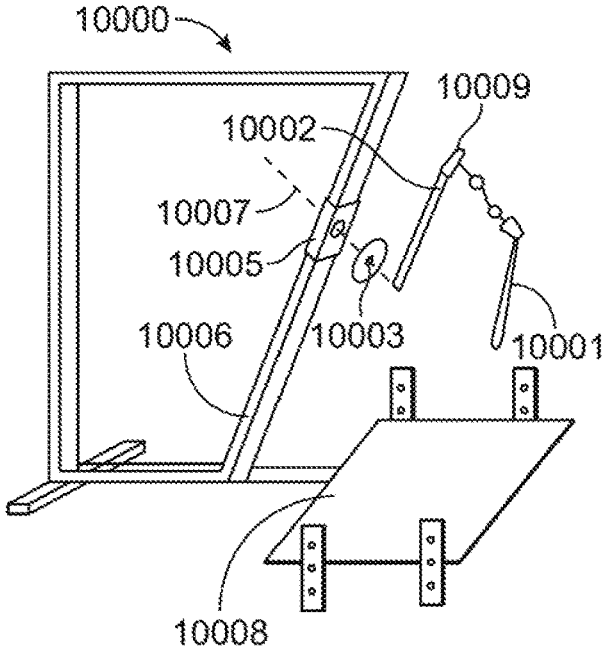
FIG. 100 is a perspective view of an embodiment of a connectable handle attached to a generic attaching point and generic attaching point is attached to an attachment extension, with the attachment extension attached to a rotational resistance assembly, the rotational resistance assembly is rotatably attached upon the direct carriage assembly, the direct carriage assembly is not adjustable in position upon the frame, with axis of rotation directed at an angle which is between horizontal and vertical and adjustable standing platform is mounted to the frame.

Referring to FIG. 100, in one embodiment, system 10000 comprises weights (not shown), and a cable (not shown). Optionally, connectable handle 10001 is attached to generic attaching point 10009. Optionally, generic attaching point 10009 is connected to attachment extension 10002. Optionally, attachment extension 10002 is connected to rotational resistance assembly 10003. Optionally, rotational resistance assembly 10003 is rotationally connected to an axle (not shown). Optionally, the axle (not shown) is connected to direct carriage assembly 10005. Optionally, direct carriage assembly 10005 is not adjustable in height on frame 10006, but is rather secured permanently to frame 10006. Preferably, when a user rotates connectable handle 10001 around axis of rotation 10007, the cable (not shown) will lift the weights (not shown), preferably causing a rotational resistance to the user's effort. Optionally, adjustable standing platform 10008 is connected to frame 10006. Preferably, a user can adjust adjustable standing platform 10008 to a desired height.

Figure 101:
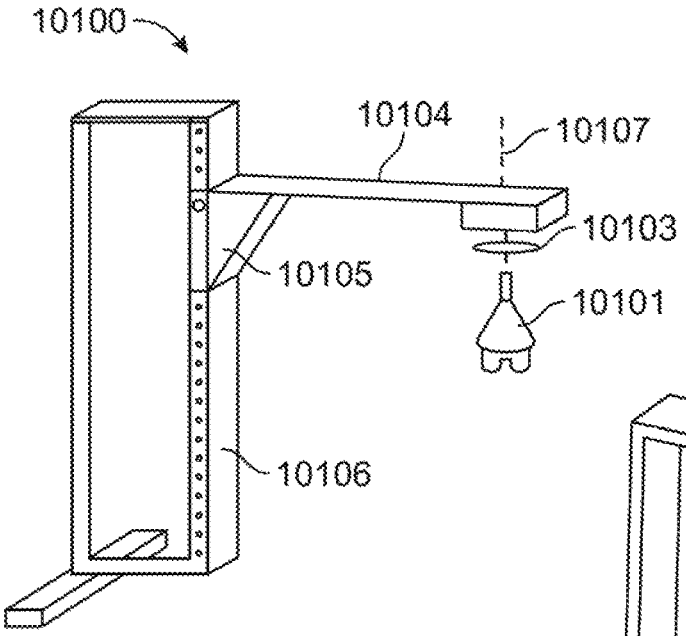
FIG. 101 is a perspective view of an embodiment of a head clamp attachment connected directly to a rotational resistance assembly, with the rotation resistance assemble rotatably connected to a frame extension, the frame extension is adjustable in position on the frame, the axis of rotation is vertical.

Referring to FIG. 101, in one embodiment, system 10100 comprises weights (not shown), and a cable (not shown). Optionally, head clamp attachment 10101 is attached to rotational resistance assembly 10103. Optionally, rotational resistance assembly 10103 is rotationally connected to an axle (not shown). Optionally, the axle (not shown) is connected to frame extension 10104. Optionally, frame extension 10104 is connected to direct carriage assembly 10105. Optionally, direct carriage assembly 10105 is adjustable in height on frame 10106. Preferably, when a user rotates head clamp 10101 around axis of rotation 10107, the cable (not shown) will lift the weights (not shown), preferably causing a rotational resistance to the user's effort.

Figure 102:
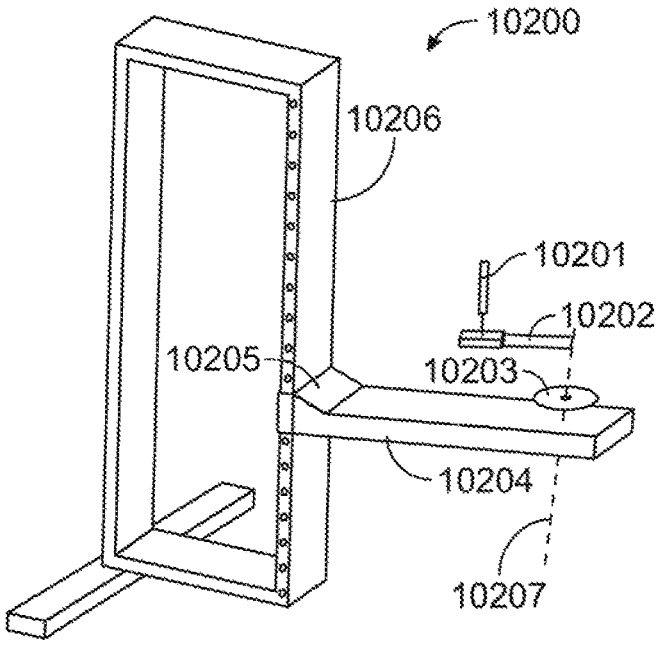
FIG. 102 is a perspective view of an embodiment of a free spin grip attachment attached to an attachment extension, the attachment extension is attached to the rotational resistance assembly, the rotational resistance assembly is rotatably connected to the frame extension, the frame extension is adjustable in position on the frame, the axis of rotation is vertical.

Referring to FIG. 102, in one embodiment, system 10200 comprises weights (not shown), and a cable (not shown). Optionally free spin grip attachment 10201 is attached to attachment extension 10202. Optionally, attachment extension 10202 is connected to rotational resistance assembly 10203. Optionally, rotational resistance assembly 10203 is rotationally connected to an axle (not shown). Optionally, the axle (not shown) is connected to frame extension 10204. Optionally, frame extension 10204 is attached to direct carriage assembly 10205. Preferably, direct carriage assembly 10205 is adjustable in height on frame 10206. Preferably, when a user rotates free spin grip attachment 10201 around axis of rotation 10207, the cable (not shown) will lift the weights (not shown), preferably causing a rotational resistance to the user's effort.

Figure 103:
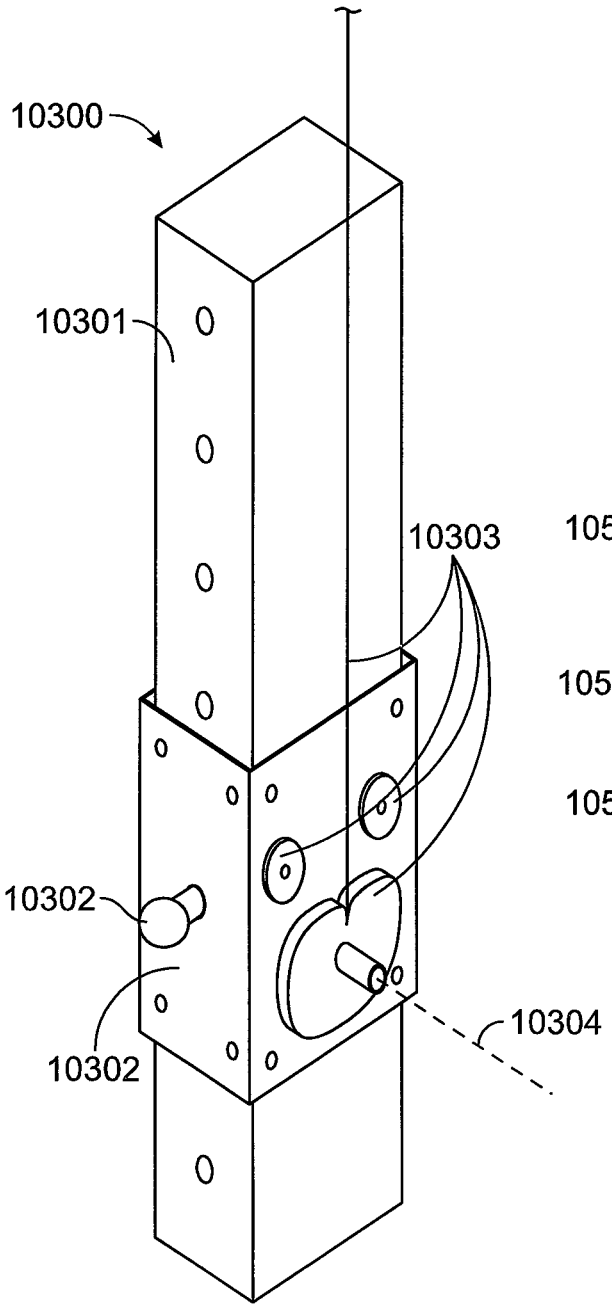
FIG. 103 is a perspective view of an embodiment of a direct carriage assembly with a rotational resistance assembly mounted to the direct carriage assembly. A frame is shown supporting the direct carriage assembly.

Referring to FIG. 103, in one embodiment, system 10300 comprises frame 10301 optionally supporting direct carriage assembly 10302. Optionally, direct carriage assembly 10302 has secured upon it rotational resistance assembly 10303. Preferably, axis of rotation 10304 is perpendicular to the face of the longest side of frame 10301 which direct carriage assembly 10302 is attached to. Optionally, direct carriage assembly 10302 is able to move along frame 10301.

Figure 104:
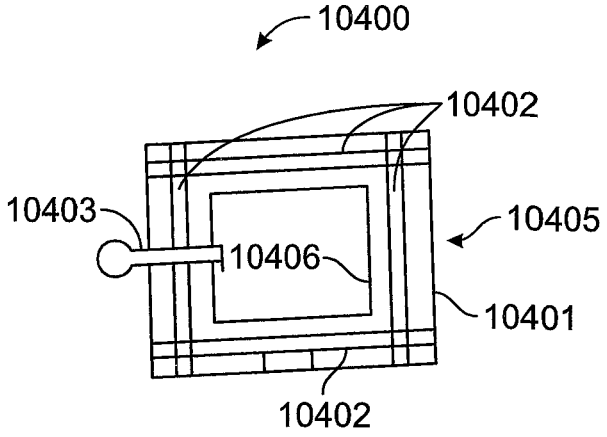
FIG. 104 is a sectional view of an embodiment of a direct carriage assembly on a frame.

Referring to FIG. 104, in one embodiment, system 10400 comprises a direct carriage assembly 10405 optionally comprising direct carriage 10401 with rollers 10402 mounted within direct carriage 10401. Direct carriage lock 10403 is optionally mounted on the surface of direct carriage 10401, and optionally passes through the surface of direct carriage 10401. Frame 10406 is optionally shown for reference as to how rollers 10402 optionally position direct carriage 10401 onto frame 10406. Direct carriage lock 10403 optionally passes through holes in frame 10406 preferably locking direct carriage 10401 in place on frame 10406. Rollers 10402 are optionally rotatably secured to direct carriage 10401. Preferably, when direct carriage assembly 10405 is moved upon frame 10406, rollers 10402 provide a reduction in friction between frame 10406 and direct carriage 10401.

Figure 105:
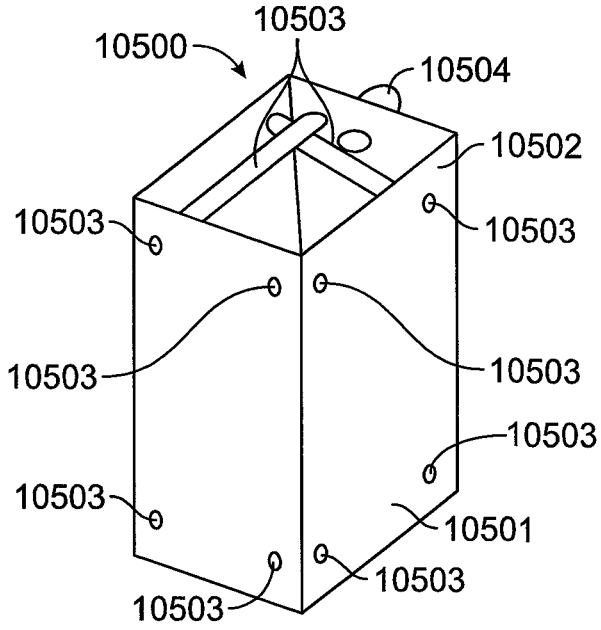
FIG. 105 is a perspective view of an embodiment of direct carriage assembly.

Referring to FIG. 105, in one embodiment, system 10500 comprises direct carriage assembly 10501, optionally comprising rollers 10503 rotatably mounted on direct carriage 10502. Optionally, direct carriage lock 10504 is mounted on the surface of direct carriage 10502 and passes through the surface of direct carriage 10502. Optionally, direct carriage assembly 10501 has an axle (not shown) attached to its surface. Optionally, direct carriage assembly 10501 has a rotational resistance assembly (not shown) secured to its surface. Optionally, direct carriage assembly 10501 has one end of a cable (not shown) attached to it. Optionally, direct carriage assembly 10501 has a cable (not shown) attached to it, and the other end of the cable (not shown) is attached to a counterweight (not shown). Optionally, direct carriage 10502 is movable on the frame (not shown) by, for example, an electric motor assistance system or the like (not shown).

INDUSTRIAL APPLICABILITY

The invention is further illustrated by the following non-limiting examples.

EXAMPLE 1

An exercising apparatus was build out of metal and plastic, significantly similar to the one shown in FIG. 1. When tested to strengthen the body's joints and muscles in a supination, and/or pronation and/or rotational motion, the counteracting force from the machine directly opposed the user's supination, pronation, and rotational forces without any other forces interfering. The various attachments allowed the user to supinate or pronate particular body parts freely, without an opposing force applied to that particular supination or pronation, while pronating and/or supinating and/or rotating other body parts.

The preceding example can be repeated with similar success by substituting the generically or specifically described components and/or operating parameters of this invention for those used in the preceding examples. Note that in the specification and claims, "about" or "approximately" means within twenty percent (20%) of the numerical amount cited. Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A variable resistance exercise apparatus comprising:

a vertical post;

an arm vertically adjustably connected to said vertical post;

a bidirectional rotating element attached to said arm; an attachment extension port mounted through a center of said bidirectional rotating element and being selectively rotatable with said bidirectional rotating element about an attachment extension port axis of rotation; and a counterweight attached to said arm, said counterweight for assisting a user with vertically adjusting said arm;

said bidirectional rotating element being connected to a force transferring material connected to a variable resistance force source;

wherein an exercise attachment is selectively installable into said attachment extension port along said attachment extension port axis of rotation.

2. The variable resistance exercise apparatus of claim 1 wherein said variable resistance force source comprises an adjustable spring.

3. The variable resistance exercise apparatus of claim 2 wherein said adjustable spring comprises a torsion spring.

4. The variable resistance exercise apparatus of claim 3 wherein said torsion spring is connected to a resistance force output.

5. The variable resistance exercise apparatus of claim 4 wherein said resistance force output is disposed at a location where said user of said variable resistance exercise apparatus can connect said exercise attachment to perform a movement against a rotational force.

6. The variable resistance exercise apparatus of claim 1 wherein said variable resistance force source is adjustable.

7. The variable resistance exercise apparatus of claim 1 wherein said force transferring material is selected from the group consisting of a cable, a belt, a chain, a rope, and a rubber band.

8. The variable resistance exercise apparatus of claim 1 wherein said exercise attachment is configured for said user to exert force upon.

9. The variable resistance exercise apparatus of claim 1 wherein said variable resistance force source comprises a piece of polymer.

10. The variable resistance exercise apparatus of claim 9 wherein said piece of polymer is attached to a resistance force output.

11. The variable resistance exercise apparatus of claim 10 wherein said resistance force output is disposed at a location where said user of said variable resistance exercise apparatus can connect said exercise attachment to perform a movement against a rotational force.

12. The variable resistance exercise apparatus of claim 1 wherein said arm comprises a pulley for guiding said force transferring material and said arm is connected to said vertical post via a hinge, said hinge enabling said arm to fold upwards toward said vertical post; wherein a hinge axis is parallel to and not coincident with a rotational axis of said pulley.

13. The variable resistance exercise apparatus of claim 1 wherein said bidirectional rotating element comprises a flat surface that is either fixed in a horizontal plane or tiltable relative to said arm between 0 and 360 degrees about a horizontal axis.

14. The variable resistance exercise apparatus of claim 1 wherein said vertical post comprises a plurality of horizontally oriented slots for adjusting a height of said arm.

15. The variable resistance exercise apparatus of claim 1 wherein said force transferring material comprises a cable, a first end of said cable connected to said bidirectional rotating element, said cable threaded through one or more pulleys connected to said variable resistance force source;

wherein a second end of said cable comprises an attachment point for said user to attach a linear exercise attachment configured for the user to pull said cable against said variable resistance force source.

16. The variable resistance exercise apparatus of claim 1 wherein said bidirectional rotating element comprises a circular wheel.

17. The variable resistance exercise apparatus of claim 1 wherein said arm is vertically adjustable up to approximately 10 feet high above a support surface for the variable resistance exercise apparatus.

18. The variable resistance exercise apparatus of claim 1 wherein said force transferring material is disposed on a periphery of said bidirectional rotating element.

19. The variable resistance exercise apparatus of claim 18 wherein said force transferring material is disposed in a groove on the periphery of said bidirectional rotating element.

20. The variable resistance exercise apparatus of claim 1 wherein said force transferring material wraps either clockwise or counterclockwise around said bidirectional rotating element, thereby providing a bidirectional variable rotational resistance.

21. The variable resistance exercise apparatus of claim 1 wherein a counteracting force provided by said bidirectional rotating element directly opposes the user's supination and/or pronation and/or rotation forces without any other forces interfering.

* * * * *